US009283767B2

(12) United States Patent
Nozawa et al.

(10) Patent No.: US 9,283,767 B2
(45) Date of Patent: Mar. 15, 2016

(54) CARTRIDGE AND SEALING MEMBER

(71) Applicant: SEIKO EPSON CORPORATION, Tokyo (JP)

(72) Inventors: Izumi Nozawa, Matsumoto (JP); Tadahiro Mizutani, Shiojiri (JP); Hiroyuki Nakamura, Shiojiri (JP); Atsushi Kobayashi, Matsumoto (JP); Ryota Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/900,445

(22) Filed: May 22, 2013

(65) Prior Publication Data

US 2013/0314478 A1 Nov. 28, 2013

(30) Foreign Application Priority Data

| | | |
|---|---|---|
| May 23, 2012 | (JP) | 2012-117059 |
| Jul. 6, 2012 | (JP) | 2012-152295 |
| Jul. 23, 2012 | (JP) | 2012-162701 |
| Aug. 8, 2012 | (JP) | 2012-176179 |
| Aug. 31, 2012 | (JP) | 2012-191629 |

(51) Int. Cl.
*B41J 2/175* (2006.01)

(52) U.S. Cl.
CPC ..... *B41J 2/17536* (2013.01); *B41J 2/17523* (2013.01)

(58) Field of Classification Search
USPC ..... 347/84, 85, 86, 87
See application file for complete search history.

(56) References Cited

U.S. PATENT DOCUMENTS

| | | | | |
|---|---|---|---|---|
| 5,854,646 | A | 12/1998 | Barinaga et al. | |
| 6,086,193 | A | 7/2000 | Shimada et al. | |
| 6,145,974 | A | 11/2000 | Shinada et al. | |
| 6,196,671 | B1 | 3/2001 | Breemes, Sr. et al. | |
| 6,203,148 | B1 | 3/2001 | Kishida | |
| 6,220,701 | B1 * | 4/2001 | Umemura | 347/86 |
| 6,250,750 | B1 | 6/2001 | Miyazawa et al. | |
| 6,254,226 | B1 | 7/2001 | Lengyel et al. | |
| 6,290,348 | B1 | 9/2001 | Becker et al. | |
| 6,332,481 | B1 | 12/2001 | Shinada et al. | |
| 6,364,473 | B1 | 4/2002 | Liu | |
| 6,390,613 | B1 | 5/2002 | Liu | |
| 6,585,007 | B2 | 7/2003 | Kubokawa | |
| 6,776,479 | B2 | 8/2004 | Ardito et al. | |
| 6,824,258 | B2 | 11/2004 | Yamamoto et al. | |
| 6,848,776 | B2 | 2/2005 | Nishioka et al. | |
| 6,976,753 | B2 * | 12/2005 | Kuwabara et al. | 347/86 |

(Continued)

FOREIGN PATENT DOCUMENTS

| | | | |
|---|---|---|---|
| EP | 0655336 | A1 | 11/1994 |
| EP | 0847861 | A2 | 2/1997 |

(Continued)

*Primary Examiner* — Anh T. N. Vo
(74) *Attorney, Agent, or Firm* — Stroock & Stroock & Lavan LLP

(57) ABSTRACT

A cartridge or a sealing member is provided to reduce the likelihood that a fluid is leaked outside. The cartridge is configured to supply a fluid to a fluid ejection apparatus. The cartridge has: a fluid accommodation portion; and a fluid supply port connectable with the fluid ejection apparatus. The fluid supply port includes: a fluid exit provided to flow out the fluid to the fluid ejection apparatus; and an opening arranged to connect outside of the fluid supply port with inside of the fluid supply port. The opening is not in contact with a side face of the fluid supply port.

20 Claims, 25 Drawing Sheets

(56) References Cited

U.S. PATENT DOCUMENTS

| | | | | |
|---|---|---|---|---|
| 7,165,835 | B2 | 1/2007 | Ota et al. | |
| 7,237,881 | B2 * | 7/2007 | Hayasaki et al. | 347/86 |
| 7,293,866 | B2 | 11/2007 | Miyazawa et al. | |
| 7,325,909 | B2 | 2/2008 | Yuen | |
| 7,393,088 | B2 | 7/2008 | Sasaki | |
| 7,445,323 | B2 * | 11/2008 | Anderson et al. | 347/86 |
| 7,470,008 | B2 | 12/2008 | Yan | |
| 7,735,983 | B2 * | 6/2010 | Pearson et al. | 347/86 |
| 7,918,547 | B2 | 4/2011 | Hatasa et al. | |
| 7,938,523 | B2 | 5/2011 | Aldrich | |
| 8,142,000 | B2 | 3/2012 | Ishizawa et al. | |
| 8,177,342 | B2 | 5/2012 | Wanibe et al. | |
| 8,366,250 | B2 | 2/2013 | Wanibe et al. | |
| 8,366,251 | B2 | 2/2013 | Wanibe et al. | |
| 8,382,263 | B2 | 2/2013 | Okajima | |
| 8,684,505 | B2 * | 4/2014 | Campbell-Brown et al. | 347/86 |
| 2001/0009431 | A1 | 7/2001 | Kobayashi et al. | |
| 2002/0104578 | A1 | 8/2002 | Kubokawa | |
| 2003/0090553 | A1 | 5/2003 | Jung et al. | |
| 2003/0122909 | A1 | 7/2003 | Ogura et al. | |
| 2005/0041076 | A1 | 2/2005 | Katayama | |
| 2005/0179750 | A1 | 8/2005 | Hayasaki et al. | |
| 2005/0185034 | A1 | 8/2005 | Anma et al. | |
| 2005/0219303 | A1 | 10/2005 | Matsumoto et al. | |
| 2005/0275699 | A1 | 12/2005 | Sasaki | |
| 2006/0132555 | A1 | 6/2006 | Uehara et al. | |
| 2006/0203045 | A1 | 9/2006 | Kobayashi et al. | |
| 2007/0024683 | A1 | 2/2007 | Yan | |
| 2007/0139492 | A1 | 6/2007 | Anderson, Jr. et al. | |
| 2007/0195141 | A1 | 8/2007 | Anma et al. | |
| 2007/0195144 | A1 * | 8/2007 | McNestry | 347/97 |
| 2008/0034712 | A1 | 2/2008 | Miyajima et al. | |
| 2008/0204529 | A1 | 8/2008 | Matsumoto et al. | |
| 2008/0230141 | A1 | 9/2008 | Hattori | |
| 2008/0239037 | A1 | 10/2008 | Inoue et al. | |
| 2008/0284833 | A1 | 11/2008 | Uehara et al. | |
| 2009/0128609 | A1 | 5/2009 | Matsumoto et al. | |
| 2009/0244221 | A1 | 10/2009 | Shimizu | |
| 2009/0322832 | A1 | 12/2009 | Wanibe et al. | |
| 2009/0322838 | A1 | 12/2009 | Wanibe et al. | |
| 2009/0322839 | A1 | 12/2009 | Ishizawa et al. | |
| 2010/0073438 | A1 | 3/2010 | Wanibe et al. | |
| 2010/0208015 | A1 | 8/2010 | Matsumoto et al. | |
| 2010/0302291 | A1 | 12/2010 | Matsumoto et al. | |
| 2010/0309265 | A1 | 12/2010 | Matsumoto et al. | |
| 2010/0309266 | A1 | 12/2010 | Matsumoto et al. | |
| 2011/0037815 | A1 | 2/2011 | Anma et al. | |
| 2011/0169899 | A1 | 7/2011 | Nozawa et al. | |
| 2012/0127247 | A1 | 5/2012 | Anma et al. | |
| 2012/0133713 | A1 | 5/2012 | Camp | |
| 2013/0208044 | A1 | 8/2013 | Matsumoto et al. | |

FOREIGN PATENT DOCUMENTS

| | | | |
|---|---|---|---|
| EP | 1053881 | A1 | 11/2000 |
| EP | 1080918 | A1 | 3/2001 |
| EP | 1095777 | A2 | 5/2001 |
| EP | 1170135 | A1 | 1/2002 |
| EP | 1258361 | A1 | 11/2002 |
| EP | 1707380 | A2 | 10/2006 |
| EP | 2103435 | A2 | 9/2009 |
| EP | 2425981 | A2 | 3/2012 |
| GB | 2288148 | A | 10/1995 |
| JP | 06-106729 | A | 4/1994 |
| JP | 08-112915 | A | 5/1996 |
| JP | 10-095129 | A | 4/1998 |
| JP | 10-250091 | A | 9/1998 |
| JP | 2000-203053 | A | 7/2000 |
| JP | 2001-063085 | A | 3/2001 |
| JP | 2001-130022 | A | 5/2001 |
| JP | 2002-036590 | A | 2/2002 |
| JP | 2002-120376 | A | 4/2002 |
| JP | 2002-225306 | A | 5/2002 |
| JP | 2003-191488 | A | 7/2003 |
| JP | 2005-170027 | A | 6/2005 |
| JP | 2005-349786 | A | 12/2005 |
| JP | 2007-112150 | A | 5/2007 |
| JP | 2008-246896 | A | 10/2008 |
| JP | 2009-061785 | A | 3/2009 |
| JP | 2009-241608 | A | 10/2009 |
| JP | 2010-005957 | A | 1/2010 |
| JP | 2011-110712 | A | 6/2011 |
| JP | 2011-140189 | A | 7/2011 |
| JP | 2011-207066 | A | 10/2011 |
| JP | 2012-035479 | A | 2/2012 |
| JP | 2012-035489 | A | 2/2012 |
| JP | 2012-126100 | A | 7/2012 |
| JP | 2012-136039 | A | 7/2012 |
| KR | 10-1998-081828 | A | 11/1998 |
| WO | 2008/056736 | A1 | 5/2008 |

* cited by examiner

CARTRIDGE AND SEALING MEMBER

FIELD OF THE INVENTION

The present invention relates to cartridge-related technology.

DESCRIPTION OF THE RELATED ART

An ink cartridge configured to contain ink (hereinafter may also be called "cartridge") may be used to supply ink to a printer as one example of a fluid ejection apparatus. The cartridge includes a fluid accommodation portion provided to contain ink and a fluid supply port provided to supply ink in the fluid accommodation portion to the printer. The fluid supply port has one end communicating with the fluid accommodation portion and the other end formed as an opening or a fluid supply opening (for example, U.S. Pat. No. 7,735,983 and JP Patent No. 7938523).

SUMMARY

Technical Problem

The above cartridge may, however, cause ink in the fluid accommodation portion to be leaked out of the cartridge before use, for example, by an impact during transportation. Leakage of ink outside of the cartridge causes various troubles. One possible trouble is the decreasing amount of ink usable by the user. Another possible trouble is adhesion of ink to the user, the printer or the printing medium.

The cartridge prior to attachment to the printer may have a cap attached to a fluid supply opening to prevent leakage of ink from the fluid supply opening. The cartridge with such a cap may, however, have various troubles. One possible trouble is that ink in the cap adheres to the user when the user removes the cap from the cartridge. Another possible trouble is that ink may be leaked outside through the fluid supply opening since the cap is not adequately attached to the cartridge.

The above demands on the cartridge and the cap are not limited to the cartridge configured to contain ink or the cap attached to the cartridge of containing ink, but are commonly applied to any cartridge configured to contain another printing fluid or a printing material other than fluid and any cap attached to such a cartridge. The cartridge and the cap are also required to satisfy the requirements of size reduction, cost reduction, resource saving, ease of manufacture, and improvement of usability.

Solution to Problem

In order to achieve at least part of the foregoing, the present invention provides various aspects and embodiments described below.

(1) According to one aspect of the invention, there is provided a cartridge for supplying a fluid to a fluid ejection apparatus. The cartridge has: a fluid accommodation portion; and a fluid supply port connectable with the fluid ejection apparatus. The fluid supply port includes: a fluid exit provided to flow out the fluid to the fluid ejection apparatus; and an opening arranged to connect outside of the fluid supply port with inside of the fluid supply port. The opening is not in contact with a side face of the fluid supply port. According to the cartridge of this aspect, the opening is not in contact with the side face of the fluid supply port. This arrangement reduces the likelihood that the fluid flowing along the side face reaches the opening. This accordingly reduces the likelihood that the fluid is leaked outside through the opening.

(2) In the cartridge of the above aspect, the opening may be at one end of a passage protruded in the fluid supply port. According to the cartridge of this aspect, the opening is formed at one end of the protruded passage. Even when the fluid flows along the inner surface of the fluid supply port, this arrangement reduces the likelihood that the fluid reaches the opening. This accordingly reduces the likelihood that the fluid is leaked outside through the opening.

(3) In the cartridge of the above aspect, the opening may be located downstream of a specified peripheral part out of periphery of the fluid exit with respect to an outflow direction of the fluid, the specified part being at a closest position to the passage. The cartridge of this aspect further reduces the likelihood that the fluid reaches the opening. For example, in the state of the cartridge that the downstream side is located on the upper side of the upstream side, the opening is located above the periphery member at the closest position (first peripheral member). This accordingly reduces the likelihood that the fluid leaked out of the first peripheral member of the neighborhood of the first peripheral member reaches the opening.

(4) In the cartridge of the above aspect, the fluid supply port and the passage may be integrally formed. The cartridge of this aspect reduces the likelihood that a gap is created between the fluid supply port and the passage by, for example, damage or breakage, compared with the structure that the fluid supply port and the passage are formed by separate member. This accordingly reduces the likelihood that the fluid passes through the gap and flows into the passage.

(5) In the cartridge of the above aspect, the cartridge may have a first surface, a second surface, a third surface and a fourth surface; and a transmission part placed on the first surface, wherein the fluid supplier is provided on the first surface, the fourth surface may be opposed to the first surface, the second surface may be provided between the first surface and the fourth surface, the third surface may be opposed to the second surface, the first surface may have a first end located on the second surface side and a second end located on the third surface side, the transmission part may be closer to the first end than the second end, and the fluid supply port may be closer to the second end than the first end. According to the cartridge of this aspect, the fluid supply port is located on the second end, while the transmission part is located on the first end. In other words, the fluid supply port is located away from the transmission part. This arrangement reduces the likelihood that the fluid flowing out of the fluid supply port adheres to the transmission part. In an application that the first member is used to detect the fluid remaining state (the presence or the absence of remaining fluid or the amount of remaining fluid) by optical means, this prevents reduction of the detection accuracy of the fluid remaining state.

(6) In the cartridge of the above aspect, the opening may be located downstream of the fluid exit with respect to an outflow direction of the fluid. The cartridge of this aspect reduces the likelihood that the fluid reaches the opening. For example, in the state of the cartridge that the downstream side is located on the upper side in the vertical direction than the upstream side, the opening is located above the fluid exit. This reduces the likelihood that the fluid leaked through the fluid exit reaches the opening.

(7) In the cartridge of the above aspect, the opening may be located upstream of the fluid exit with respect to an outflow direction of the fluid. The cartridge of this aspect reduces the likelihood that the opening comes into contact with another member located in the neighborhood of the fluid exit. One example of another member may be a fluid ejection apparatus.

(8) In the cartridge of the above aspect, the cartridge may have a sealing member provided to close the fluid supply section and configured to have a lever, the opening and the lever may be located on an identical side with respect to the fluid exit. When the cartridge of this aspect with the lever located downside in the vertical direction is placed on a specified surface, the position of the cartridge is unstable. This prevents the cartridge with the lever located downside in the vertical direction from being placed on the specified surface. The opening and the lever are located on the same side with respect to the fluid exit. The lever accordingly prevents the opening from being located below the fluid exit and thereby reduces the likelihood that the fluid leaked through the fluid exit reaches the opening.

(9) In the cartridge of the above aspect, the sealing member may have a sealing portion provided to close at least part of the opening. According to the cartridge of this aspect, the sealing portion closes at least part of the opening and thereby reduces the likelihood that the fluid flows outside via the opening.

(10) In the cartridge of the above aspect, the cartridge may have a plurality of the fluid supply ports and a plurality of the openings, the sealing member may have a plurality of the sealing portions provided corresponding to the plurality of openings, and the sealing member may have a first stepped portion between the plurality of sealing portions. According to the cartridge of this aspect, even when the fluid reaches one sealing member, the first stepped member prevents the fluid from further reaching another sealing member.

(11) In the cartridge of the above aspect, the sealing member further may include: a receiver portion configured to receive the fluid exit and provided at a different position from the sealing portion; and a second stepped portion located between the sealing portion and the receiver portion and configured to have at least one of a projection and a recess. According to the cartridge of this aspect, even when the fluid leaked through the fluid exit adhere to the receiver portion, the second stepped portion reduces the likelihood that the fluid flows along the receiver portion and reaches the sealing portion.

(12) In the cartridge of the above aspect, the receiver portion may be in a recessed shape, and the second stepped portion may be formed by a peripheral portion that is part of the receiver portion. The cartridge of this aspect does not require any additional separate member to provide the second stepped portion.

(13) In the cartridge of the above aspect, the fluid exit may have an inclined portion inclined to an outflow direction of the fluid, and the sealing member may have an opposed part inclined along an inclination direction of the inclined portion. According to the cartridge of this aspect, the opposed part is inclined along the inclination direction of the inclined portion of the fluid exit. This structure reduces the volume of the inner chamber that is formed by the sealing member and the fluid supply port to contain the air. This controls the amount of the air that flows from the inner chamber through the fluid exit into the fluid accommodation portion.

(14) In the cartridge of the above aspect, the fluid exit may include: a mounting portion attached to the fluid supply port; a center portion surrounded by the mounting portion; and a non-mounting portion different from the center portion and the mounting portion, the non-mounting portion may be configured to retain the fluid. The cartridge of this aspect enables the fluid to be retained by the non-mounting portion, thus reducing the likelihood that the fluid reaches the opening.

(15) In the cartridge of the above aspect, the sealing member may be in contact with at least part of the center portion. The cartridge of this aspect reduces the volume of the inner chamber that is formed by the sealing member and the fluid supply port to contain the air. This further controls the amount of the air that flows from the inner chamber through the fluid exit into the fluid accommodation portion.

(16) In the cartridge of the above aspect, the sealing member may not be in contact with the center portion. The cartridge of this aspect reduces the likelihood that the fluid adheres to the sealing member.

(17) In the cartridge of the above aspect, the cartridge may have an opening seal member removably attachable to close the opening, the opening seal member may be provided at a position that does not overlap the fluid exit in projection of the cartridge to a plane perpendicular to an outflow direction of the fluid. The cartridge of this aspect has the opening seal member that does not overlap the fluid exit and thereby reduces the likelihood that the fluid leaked through the fluid exit adheres to the opening seal member.

(18) In the cartridge of the above aspect, the cartridge may have a fluid supply opening seal member removably attachable to close a fluid supply opening located at one end of the fluid supply port, the opening seal member and the fluid supply opening sealing member may be partly joined with each other. The cartridge of this aspect enables the user to simultaneously remove the opening seal member and the fluid supply opening sealing member from the cartridge by one single action.

(19) According to another aspect of the invention, there is provided a sealing member configured to cover a fluid supply opening located at one end of a fluid supply port, which includes a fluid exit and an opening connecting to outside. At least part of a surface of the sealing member opposed to the fluid exit is configured to seal the opening. The sealing member of this aspect reduces the likelihood that the fluid flows out via the opening of the fluid supply port.

(20) In the sealing member of the above aspect, the sealing member may not be in contact with the fluid exit. The sealing member of this aspect reduces the likelihood that the fluid adheres to the sealing member.

(21) In the sealing member of the above aspect, the sealing member may be in contact with the fluid exit. The sealing member of this aspect prevents the fluid from being leaked outside through the fluid exit.

(22) In the sealing member of the above aspect, the opening may be at one end of a passage protruded in the fluid supply port, the sealing member being not in contact with the passage. The sealing member of this aspect prevents the passage from being blocked by the sealing member.

(23) In the sealing member of the above aspect, the opening may be formed at one end of a passage protruded in the fluid supply port, the sealing member being in contact with the passage. The sealing member of this aspect reduces the likelihood that the fluid is invaded into the passage and is then leaked outside.

(24) According to another aspect of the invention, there is provided a sealing member configured to cover a fluid supply opening of a fluid supply port. The fluid supply port is protruded outward from a component member of a cartridge and is configured to have the fluid supply opening at one end and a fluid exit, which is placed inside of the fluid supply port and is inclined at least partly to a protrusion direction of the fluid supply port. At least part of the sealing member opposed to the fluid exit is inclined along the inclination of the fluid exit.

The sealing member of this aspect reduces the likelihood that the fluid is leaked out of the sealing member by the inclination of the sealing member.

The invention may be achieved by any of various applications: for example, a cartridge, a sealing member attached to the cartridge, a manufacturing method of the cartridge, a manufacturing method of the sealing member, a fluid ejection system including the cartridge and a fluid ejection apparatus, and a fluid supply system including the cartridge and a communication tube arranged to flow a fluid to the fluid ejection apparatus.

DESCRIPTION OF THE PREFERRED EMBODIMENTS

The following describes embodiments of the invention in the following sequence:

A-H: Various Embodiments:

I: Modification:

A. First Embodiment

A-1. Configuration of Fluid Ejection System

Figure 1:
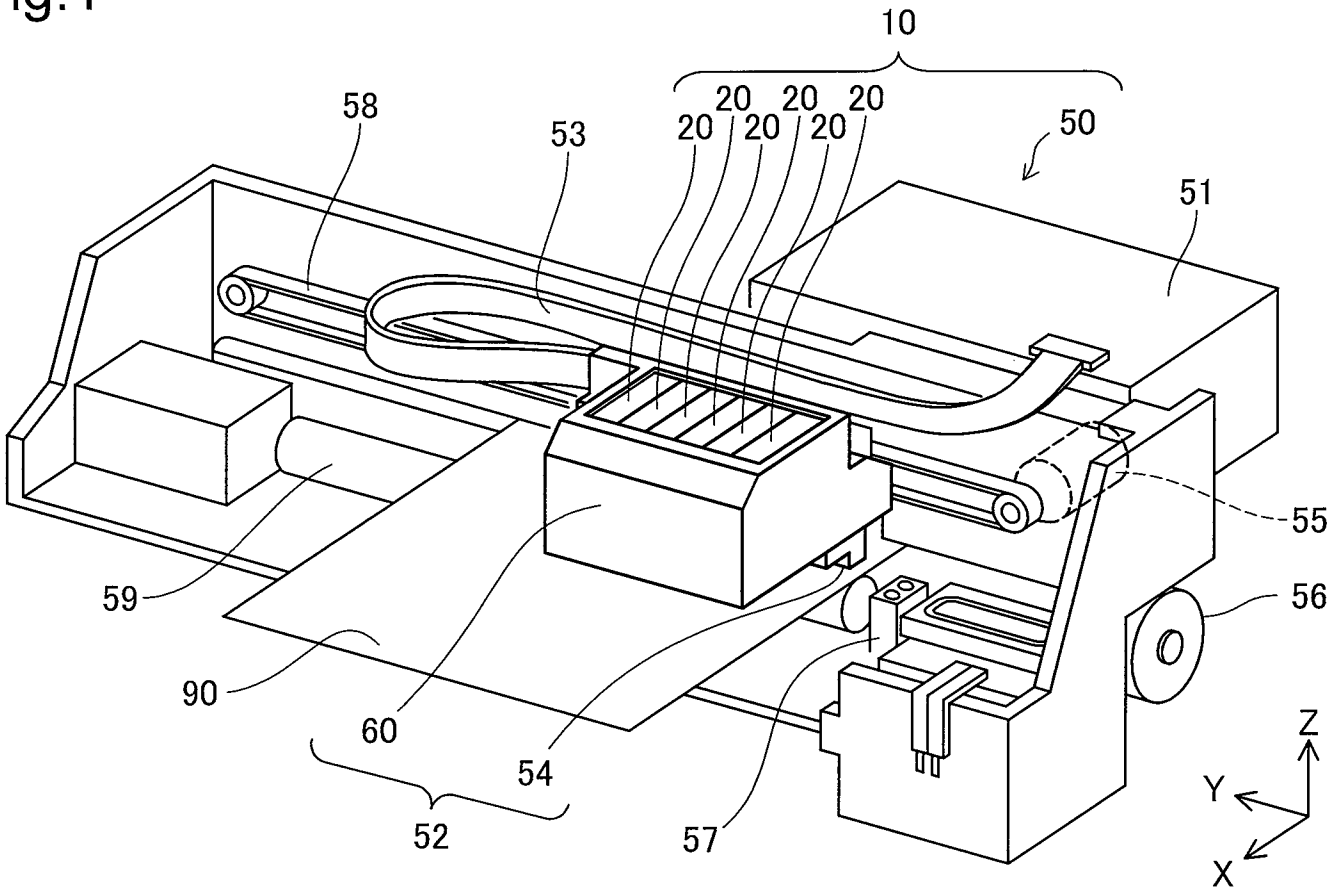
FIG. 1 is a perspective view illustrating the configuration of a fluid ejection system.

FIG. 1 is a perspective view illustrating the configuration of a fluid ejection system 10. XYZ axes orthogonal to one another are shown in FIG. 1. The XYZ axes in FIG. 1 correspond to the XYZ axes in the other drawings. The XYZ axes are added to the subsequent drawings as needed basis. The fluid ejection system 10 includes cartridges 20 and a printer 50 as a fluid ejection apparatus. In the fluid ejection system 10, the cartridges 20 are removably attached to a holder 60 of the printer 50 by the user.

Each of the cartridges 20 internally contains ink. The ink contained in the cartridge 20 is supplied to a head 54 through a fluid supply port and a fluid supply tube (described later). According to this embodiment, a plurality of the cartridges 20 are removably attached to the holder 60 of the printer 50. According to this embodiment, one each of six different types of cartridges 20 corresponding to six colors (black, yellow, magenta, light magenta, cyan and light cyan), i.e., the total of six cartridges 20, are attached to the holder 60. The number of cartridges 20 attached to the holder 60 is, however, not limited to six.

The printer 50 is a small inkjet printer for the personal use. In addition to the holder 60, the printer 50 also includes a controller 51 and a carriage 52 having the holder 60. The carriage 52 also has the head 54. The printer 50 causes ink to be supplied from the cartridge 20 attached to the holder 60 to the head 54 via the fluid supply tube (described later). The head 54 has an ejection mechanism, such as piezoelectric element, and ejects (supplies) ink to a print medium 90, such as paper sheet or label. This enables data, such as characters, graphics and images, to be printed on the print medium 90.

The controller 51 controls the respective parts of the printer 50. The carriage 52 of the printer 50 is arranged to move the head 54 relative to the print medium 90. The controller 51 and the carriage 52 are electrically connected with each other via a flexible cable 53, and the ejection mechanism of the head 54 is operated in response to control signals from the controller 51.

According to this embodiment, the carriage 52 has the holder 60 with the head 54. This type of the printer 50 where the cartridges 20 are attached to the holder 60 on the carriage 52 operated to move the head 54 is called "on-carriage type". According to another embodiment, a stationary holder 60 may be provided at a different place from the carriage 52, and ink may be supplied from each cartridge 20 attached to the holder 60 to the head 54 through a tube. This type of printer is called "off-carriage type".

According to this embodiment, the printer 50 has a main scan feed mechanism and a sub-scan feed mechanism to move the carriage 50 and the print medium 90 relative to each other and enable printing on the print medium 90. The main scan feed mechanism of the printer 50 has a carriage motor 55 and a drive belt 58. The carriage 52 is moved back and forth in a main scan direction by transmitting the power of the carriage motor 55 to the carriage 52 via the drive belt 58. The sub-scan feed mechanism of the printer 50 has a feed motor 56 and a platen 59. The print medium 90 is fed in a sub-scan direction that is orthogonal to the main scan direction by transmitting the power of the feed motor 56 to the platen 59.

A detector 57 is provided at a position outside a printing area of the printer 50 to optically detect the remaining amount of ink contained in the cartridge 20. The detector 57 has a light-emitting element and a light-receiving element provided inside thereof. The controller 51 uses the light-emitting element of the detector 57 to emit light when the cartridge 20 passes through over the detector 57 accompanied with movement of the carriage 52, and detects the ink remaining status (more specifically, presence or absence of ink) in the cartridge 20 based on whether the emitted light is received by the light-receiving element of the detector 57.

According to this embodiment, in the use state (also called "use position") of the fluid ejection system 10, the axis along the sub-scan direction (front-back direction) in which the print medium 90 is fed is specified as X axis, the axis along the main scan direction (left-right direction) in which the carriage 52 is moved back and forth is specified as Y axis, and the axis along the direction of gravity (vertical direction) is specified as Z axis. The use state of the fluid ejection system 10 herein means the state of the fluid ejection system 10 placed on a horizontal plane, and the horizontal plane is a plane parallel to the X axis and the Y axis (XY plane) according to this embodiment.

According to this embodiment, the sub-scan direction (forward direction) is specified as positive X-axis direction and its reverse direction (backward direction) is specified as negative X-axis direction. The direction going from the lower side to the upper side (upward direction) is specified as positive Z-axis direction and its reverse direction (downward direction) is specified as negative Z-axis direction. According to this embodiment, the direction going from the right side to the left side of the fluid ejection system 10 (leftward direction) is specified as positive Y-axis direction and its reverse direction (rightward direction) is specified as negative Y-axis direction. According to this embodiment, the array direction of the plurality of cartridges 20 attached to the holder 60 is the direction along the Y axis (left-right direction, also called "Y-axis direction"). The direction along the X axis (front-back direction) is also called "X-axis direction" and the direction along the Z axis (vertical direction) is also called "Z-axis direction".

A-2. Structure of Holder 60

Figure 2:
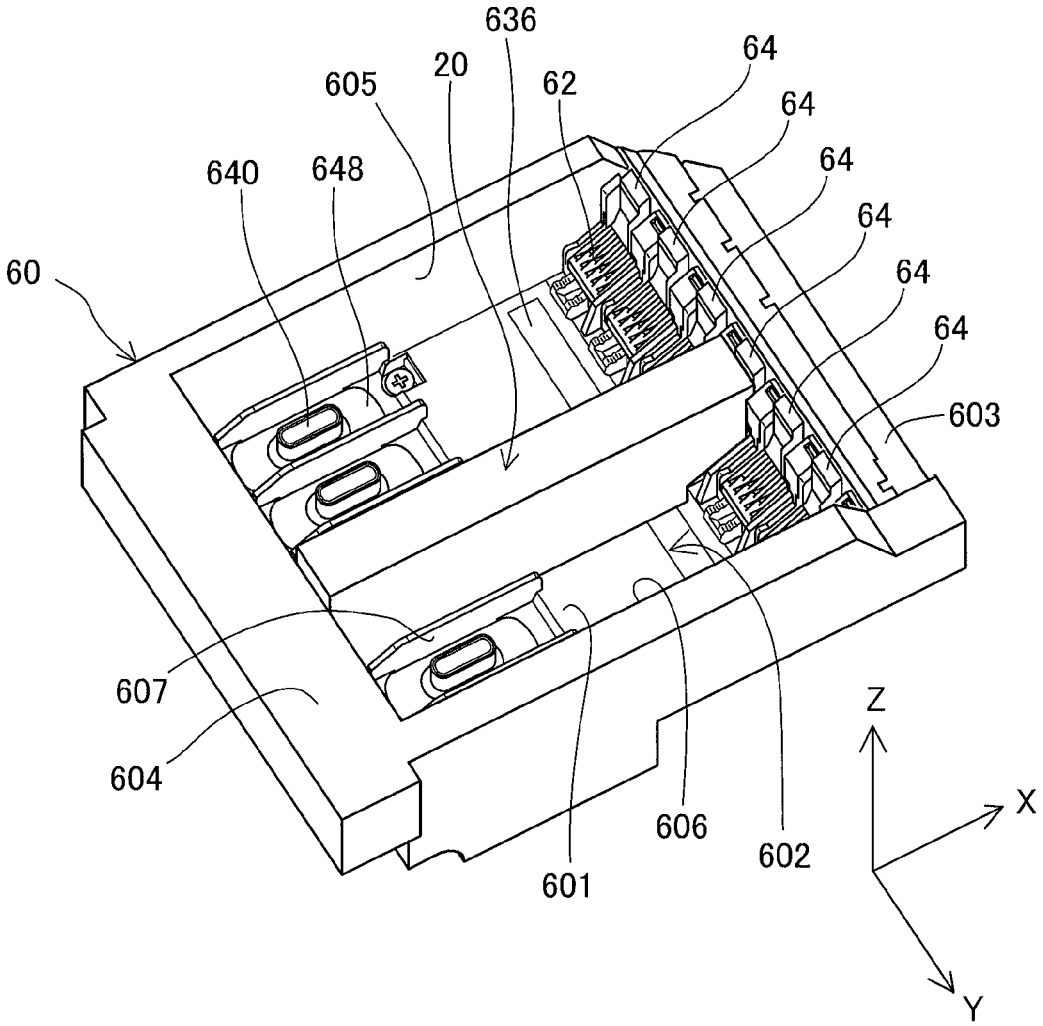
FIG. 2 is a perspective view illustrating a holder with a cartridge attached thereto.

FIG. 2 is a perspective view illustrating the holder 60 with the cartridge 20 attached thereto. The holder 60 has five wall members 601, 603, 604, 605 and 606. A recess is formed by the four wall members 603, 604, 605 and 606 extended in the positive Z-axis direction from the circumference of the wall member 601. This recess serves as a cartridge chamber 602 (also called "cartridge mounting structure 602") to hold the cartridges 20 therein. The cartridge chamber 602 is parted by partition walls 607 into a plurality of slots (mounting spaces) to receive the respective cartridges 20 therein. These partition walls 607 serve as the guide for insertion of the cartridge 20 into the slot, but may be omitted. The wall member 601 also has a through hole 636 formed in a light-transmissive manner to allow optical direction of the ink remaining status by using the detector 57.

The holder 60 has a fluid supply tube 640, a lever 64 and a contact mechanism 62 provided for each slot. Each slot has one side (positive Z-axis side: upper side) open, and the cartridge 20 is attached to and detached from the holder 60 via this open side (upper side).

The fluid supply tube 640 forms a flow path to make the flow of ink from the cartridge 20 to the head 54. The fluid supply tube 640 is connected with a fluid supply port of the cartridge 20 in the state that the cartridge 20 is attached to the printer 50 (in the attached state). An elastic member 648 is provided in the periphery of the fluid supply tube 640. The elastic member 648 seals the periphery of the fluid supply port of the cartridge 20 in the attached state. This structure prevents leakage of ink from the fluid supply port of the cartridge 20 to the periphery.

The lever 64 is used for attachment and detachment of the cartridge 20. The lever 64 locks the cartridge 20 in the state that the cartridge 20 is attached to the holder 60 (in the attached state).

The contact mechanism 62 is electrically connected with a circuit board (described later) of the cartridge 20 in the attached state. The contact mechanism 62 is also electrically connected with the controller 51. Such connection enables various information (e.g., ink color and ink remaining status of the cartridge 20) to be transmitted between the cartridge 20 and the printer 50.

A-3. Appearance Structure of Cartridge 20

Figure 3:
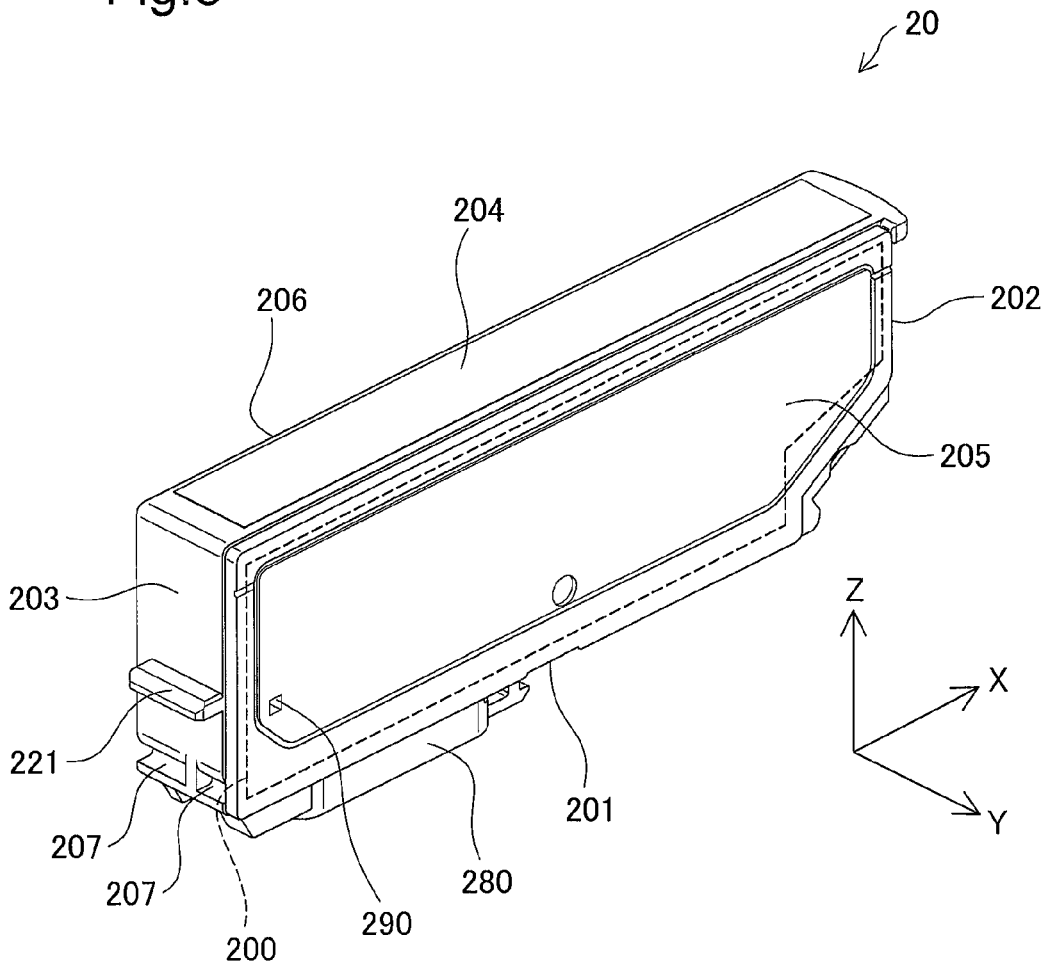
FIG. 3 is a first appearance perspective view of the cartridge.
Figure 4:
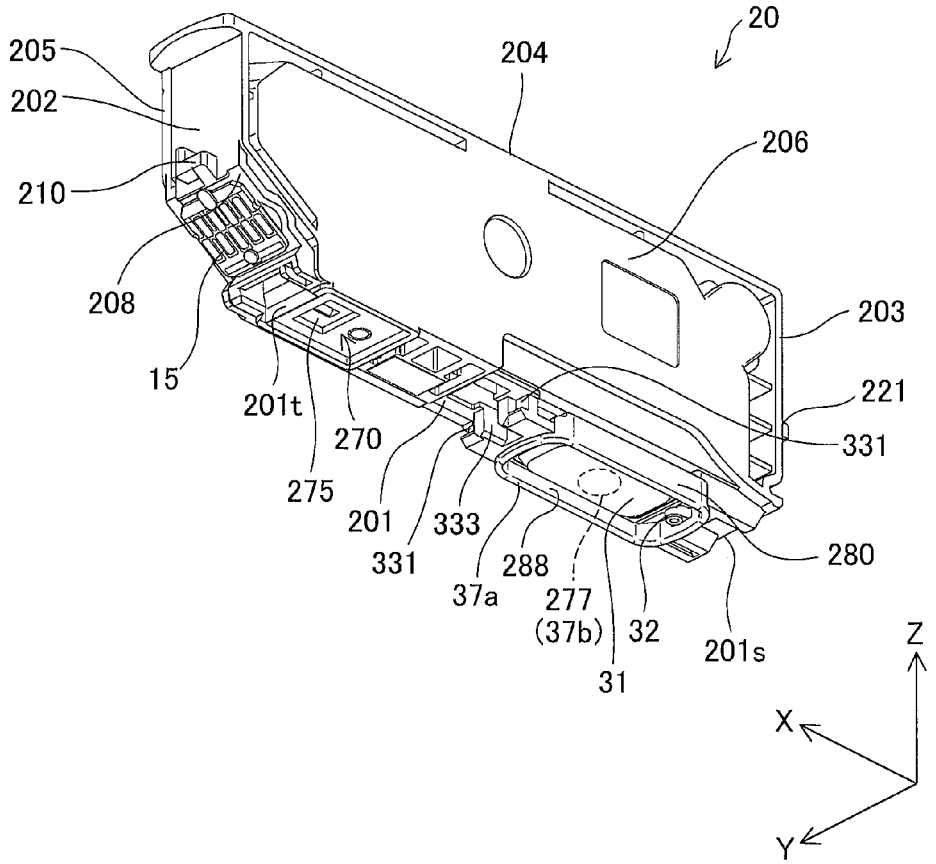
FIG. 4 is a second appearance perspective view of the cartridge.
Figure 5:
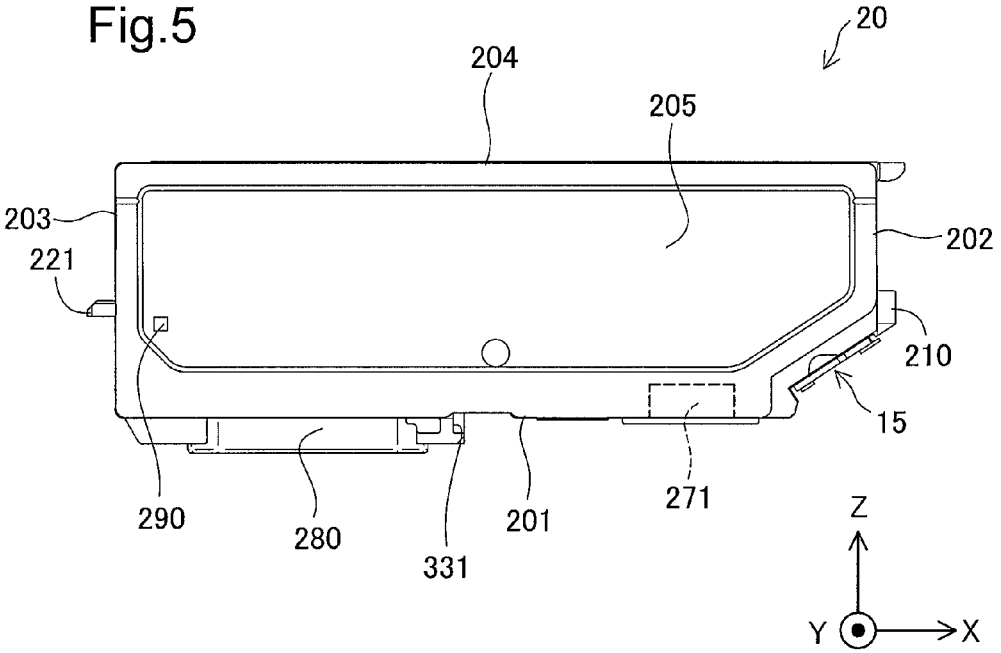
FIG. 5 is a front view of the cartridge.
Figure 6:
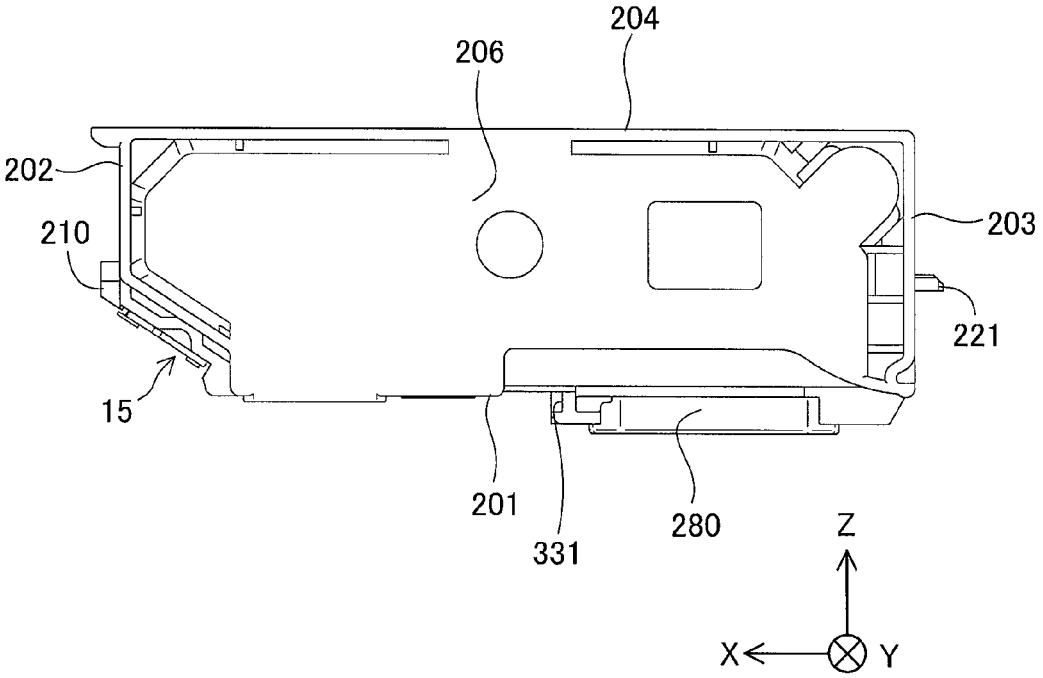
FIG. 6 is a rear view of the cartridge.
Figure 7:
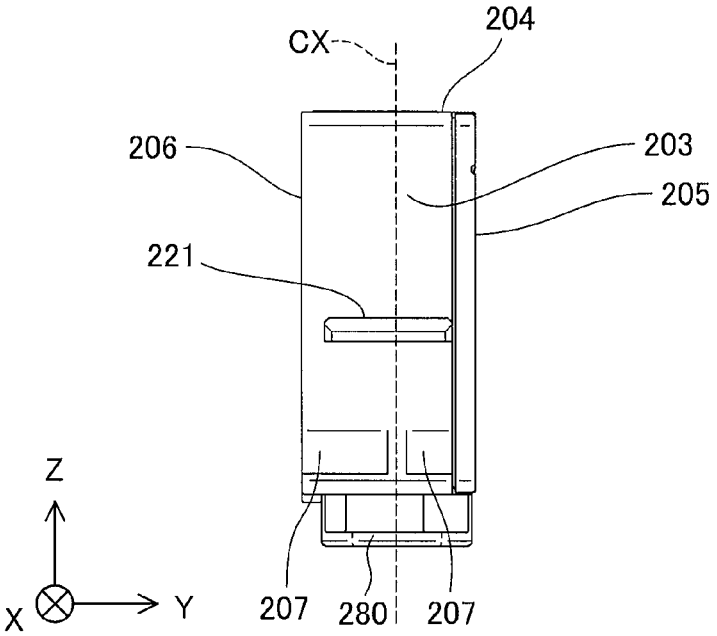
FIG. 7 is a left side view of the cartridge.
Figure 8:
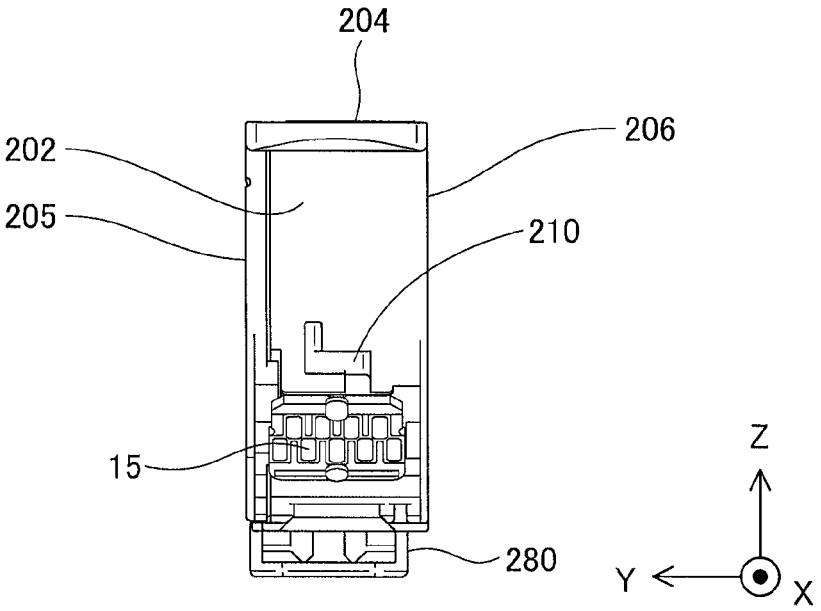
FIG. 8 is a right side view of the cartridge.
Figure 9:
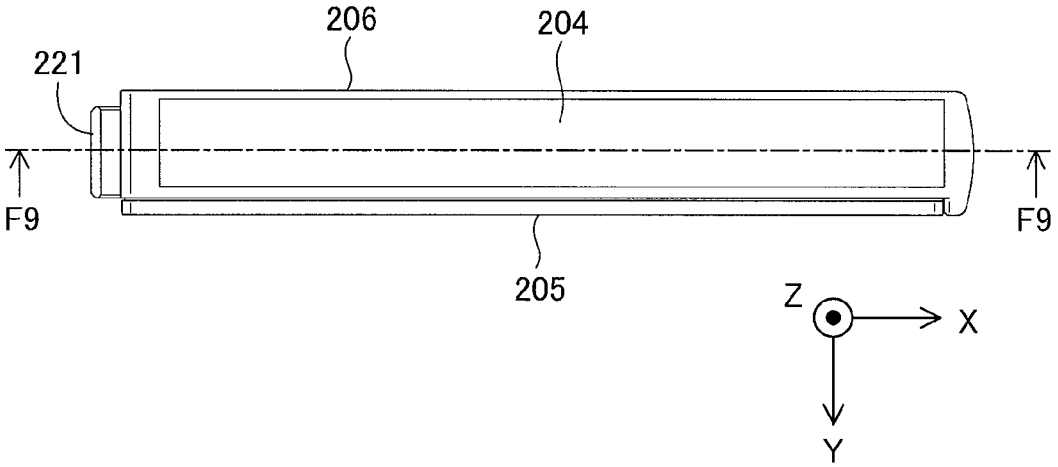
FIG. 9 is a plan view of the cartridge.
Figure 10:
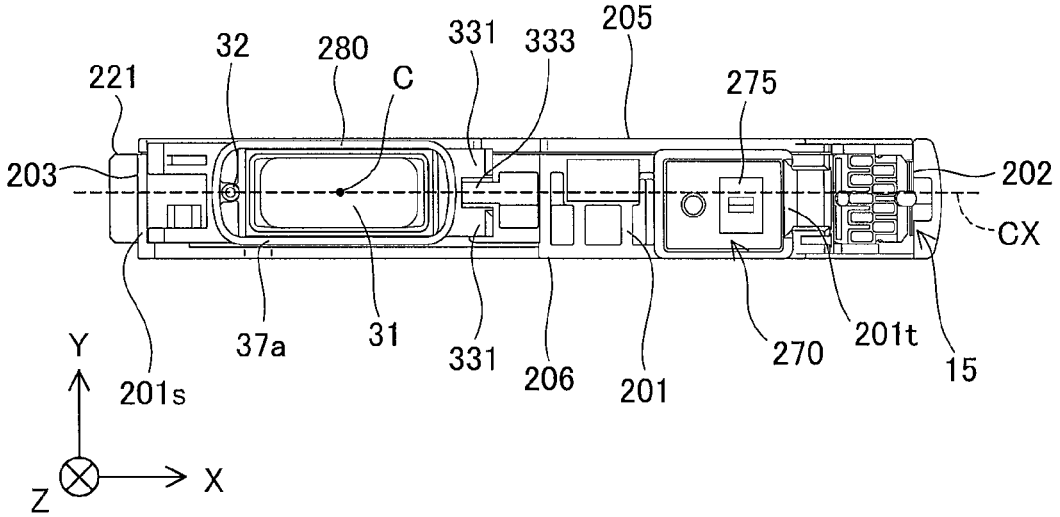
FIG. 10 is a bottom view of the cartridge.

FIG. 3 is a first appearance perspective view of the cartridge 20. FIG. 4 is a second appearance perspective view of the cartridge 20. FIG. 5 is a front view of the cartridge 20. FIG. 6 is a rear view of the cartridge 20. FIG. 7 is a left side view of the cartridge 20. FIG. 8 is a right side view of the cartridge 20. FIG. 9 is a plan view of the cartridge 20. FIG. 10 is a bottom view of the cartridge 20. The cartridge 20 of the embodiment is a semi-sealed type cartridge arranged to intermittently introduce the outside air into a fluid accommodation portion 200 with consumption of ink. The internal structure of the cartridge 20 will be described later.

As shown in FIG. 3, the cartridge 20 includes a fluid accommodation portion 200 arranged to internally contain ink and a fluid supply port 280 arranged to supply ink contained in the fluid accommodation portion 200 to the external printer 50.

As shown in FIGS. 3 to 10, the cartridge 20 has the appearance of approximately rectangular parallelepiped shape. The cartridge 20 has six surfaces 201 to 206. The six surfaces 201 to 206 are arranged to form the outer surface (outer shell) of the cartridge 20. The six surfaces include a first surface 201, a second surface 202, a third surface 203, a fourth surface 204, a fifth surface 205 and a sixth surface 206. The respective surfaces 201 to 206 are substantially flat surfaces. The "substantially flat surface" includes both the surface that is completely flat across the entire area and the surface partly having slight irregularities. In other words, as long as the surface or the wall partly having slight irregularities is recognizable as part of the outer shell of the cartridge 20, such surface is specified as the "substantially flat surface". All of the first to the sixth surfaces 201 to 206 have rectangular outer shape in planar view.

The first surface 201 and the fourth surface 204 are arranged to face each other. The second surface 202 and the third surface 203 are arranged to face each other. The fifth surface 205 and the sixth surface 206 are arranged to face each other. The direction in which the first surface 201 and the fourth surface 204 are opposed to each other is the Z-axis direction (i.e., a direction along a first direction). The direction in which the second surface 202 and the third surface 203 are opposed to each other is the X-axis direction. The direction in which the fifth surface 205 and the sixth surface 206 are opposed to each other is the Y-axis direction. According to this embodiment, the first surface 201 forms the bottom face in the attached state of the cartridge 20. As shown in FIG. 10, one end (side) of the first surface 201 close to the second surface 202 is called first end 201*t*. Another end (side) of the first surface 201 close to the third surface 203 is called second end 201*s*. In the attached state of the cartridge 20, the negative Z-axis direction (first direction) is vertically downward direction.

The second surface 202 intersects with the first surface 201. The third surface 203 also intersects with the first surface 201. The fourth surface 204 intersects with both the second surface 202 and the third surface 203. The fifth surface 205 intersects with all the first to the fourth surfaces 201 to 204. The sixth surface 206 also intersects with all the first to the fourth surfaces 201 to 204. The state that two surfaces "intersect" with each other herein means any of the state that two surfaces actually cross each other, the state that an extension of one surface and the other surface cross each other, and the state that extensions of both the two surfaces cross each other.

As shown in FIGS. 3 and 4, the fluid supply port 280 is protruded from the first surface 201. More specifically, the fluid supply port 280 is extended in the negative Z-axis direction (first direction) from the first surface 201. The fluid supply port 280 is connected with the printer 50. As shown in FIG. 4, the fluid supply port 280 has one end 37*b* that forms a fluid connection port 277 to be connected with the fluid accommodation portion 200 and the other end 37*a* that forms an opening. The other end 37*a* is located on the negative Z-axis side (first direction side) of the one end 37*b*. The fluid supply port 280 also has a flow path to make the flow of ink in the direction along the first direction (i.e., Z-axis direction). The following describes the fluid supply port 280 from another viewpoint. In other words, the fluid supply port 280 is protruded outward from the portion (first surface) of the cartridge 20. The other end 37*a* of the fluid supply port 280 has an opening 288. The direction in which the fluid supply port 280 is protruded is the negative Z-axis direction. The fluid supply tube 640 of the printer 50 is inserted through the opening 288 into the fluid supply port 280. As shown in FIG. 3, the fifth surface 205 has an air intake port 290 formed to introduce the air into the inside of the cartridge 20.

As shown in FIGS. 4 and 10, the fluid supply port 280 includes a fluid exit 31 arranged to make the flow of ink toward the fluid supply tube 640 of the printer 50 and a connection port 32 provided as a port to enable communication between the inside and the outside of the fluid supply port 280. In other words, the connection port 32 serves as an opening to connect the inside with the outside of the fluid supply port 280. The fluid exit 31 is provided to retain ink. In the attached state, the fluid supply tube 640 (FIG. 2) is inserted through the opening 288 as the fluid supply opening into the fluid supply port 280 to come into contact with the fluid exit 31 and thereby allow the flow of ink from the fluid supply port 280 to the fluid supply tube 640. In the unused state before the cartridge 20 is used for the printer 50, the flow path from the fluid accommodation portion 200 to the fluid exit 31 is filled with ink. The cartridge 20 also has a communication path arranged to connect the inside with the outside of the fluid supply port 280. The communication path has one end forming the connection port 32 and the other end forming the air intake port 290 on the fifth surface 205 (FIG. 3). The details of this communication path will be described later. In the attached state, the fluid exit 31 is in contact with the fluid supply tube 640 that is arranged to make the flow of ink to the head 54.

As shown in FIGS. 4 and 10, the first surface 201 has a prism unit 270 provided as a first portion to form part of the first surface 201. The prism unit 270 has a right angle prism. The right angle prism of the prism unit 270 is located inside the fluid accommodation portion 200. As shown in FIGS. 4 to 6 and 10, the prism unit 270 has a transmissive surface 275 provided as a permeable area forming part of the first surface 201 and two surfaces (reflection surfaces) 271 arranged to cross each other at substantially right angle (FIG. 5). The transmissive surface 275 serves to allow transmission of light emitted from the detector 57 (FIG. 1). The transmissive surface 275 also serves to allow transmission of light reflected from the surfaces 271 toward the detector 57. As shown in FIG. 10, the transmissive surface 275 is placed closer to the first end 201*t* rather than the second end 201*s* of the first surface 201. The fluid supply port 280 is, on the other hand, placed closer to the second end 201*s* rather than the first end 201*t* of the first surface 201. More specifically, in order to maximize the distance between the transmissive surface 275 and the fluid supply port 280, the transmissive surface 275 is located near to the first end 201*t* and the fluid supply port 280 is located near to the second end 201*s*.

As shown in FIGS. 4 and 10, the first surface 201 also has a pair of first accommodation portion locking elements 331. The pair of first accommodation portion locking elements 331 are placed at an interval in the Y-axis direction. The pair of first accommodation portion locking elements 331 accordingly form a accommodation portion receiver 333 therebetween as the space defined by the pair of first accommodation portion locking elements 331. In the structure of the cartridge 20 with a cap for closing the opening 288, the pair of first accommodation portion locking elements 331 and the accommodation portion receiver 333 may be used to position the cap relative to the opening 288. The details of this structure will be described later in a second embodiment. In the structure of the cartridge 20 without such a cap, the pair of first accommodation portion locking elements 331 and the accommodation portion receiver 333 may be omitted.

As shown in FIG. 4, the second surface 202 has a first locking element 210 formed as a protrusion. In the attached state, the first locking element 210 is locked by the lever 64 (FIG. 2). As shown in FIG. 3, the third surface 203 has a second locking element 221 formed as a protrusion. In the attached state, the second locking element 221 is inserted in and locked by a through hole (not shown) formed in the wall member 604 (FIG. 2).

As shown in FIGS. 3 and 7, the third surface 203 has a pair of recesses 207. More specifically, the pair of recesses 207 are provided at a location near to the first surface 201-side end of the third surface 203. The pair of recesses 207 are arranged side by side in the Y-axis direction. In the structure of the cartridge 20 with the cap for closing the opening 288, the pair of recesses 207 may be used to attach the cap to the cartridge 20. The details of this structure will be described later in the second embodiment. As shown in FIG. 7, a plane CX is located between the pair of recesses 207. The plane CX passes through center C of the opening 288 (FIG. 10) of the fluid supply port 280 in the Y-axis direction (width direction) and is parallel to the X axis and the Y axis. In the structure of the cartridge 20 without such a cap, the pair of recesses 207 may be omitted.

As shown in FIG. 4, a circuit board 15 is provided on a connection surface 208 arranged to connect the first surface 201 with the second surface 202. The circuit board 15 has a plurality of terminals formed on the surface thereof to come into contact with the contact mechanism 62 (FIG. 2) in the attached state. The circuit board 15 also has a storage unit provided on the rear face thereof to store various information (e.g., ink remaining status and ink color) of the cartridge 20.

A-4. Internal structure of Cartridge 20

Figure 11:
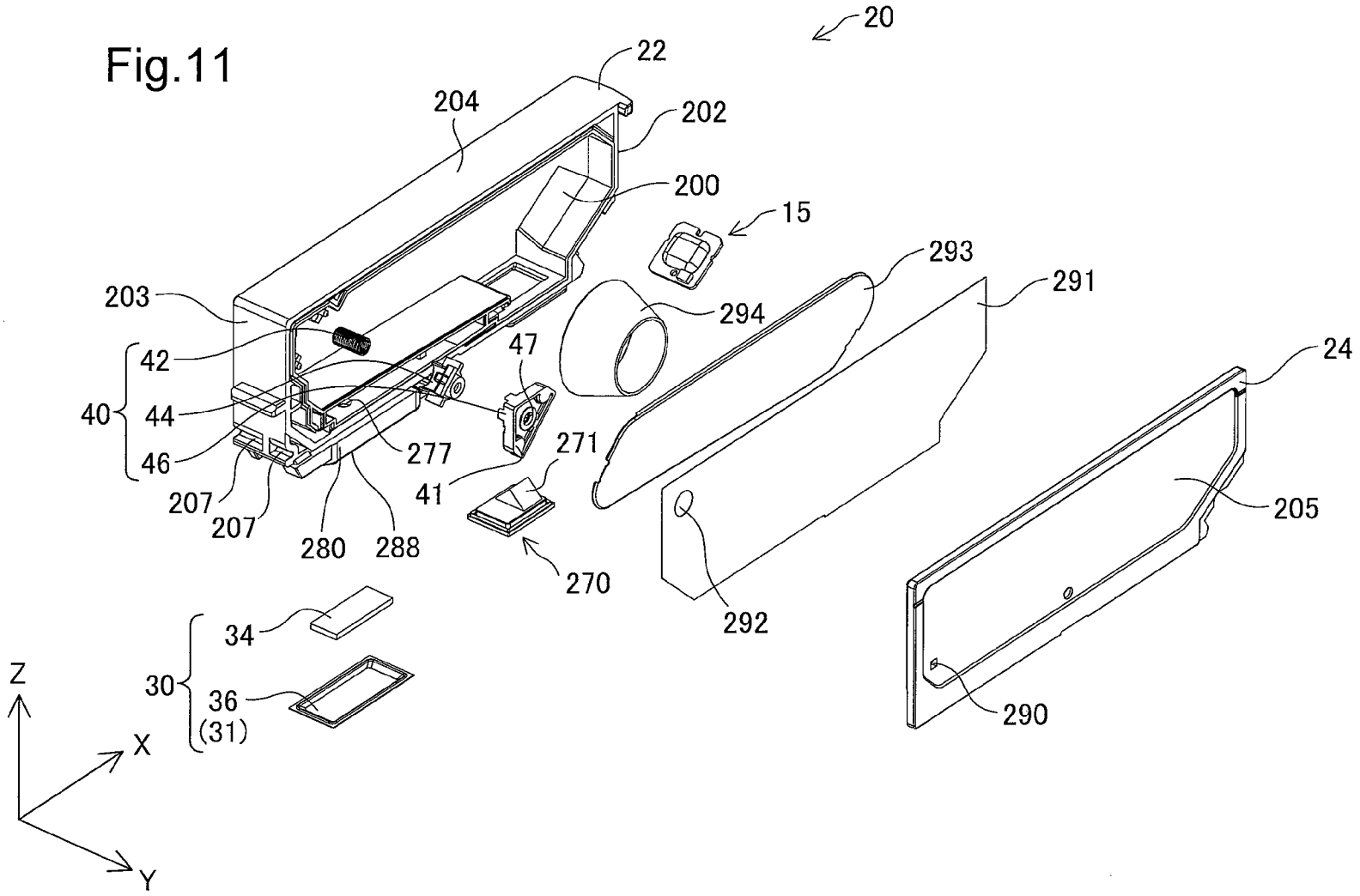
FIG. 11 is an exploded perspective view of the cartridge.
Figure 12:
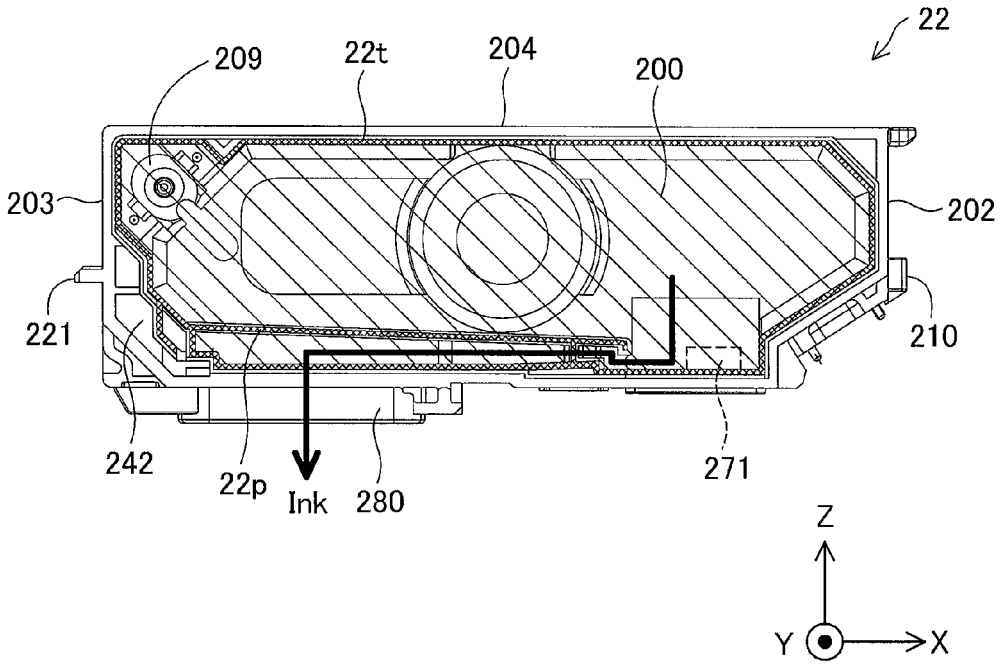
FIG. 12 is a front view of a main member.

FIG. 11 is an exploded perspective view of the cartridge 20. FIG. 12 is a front view of a main member 22. The surface 271 of the prism unit 270 is shown by the broken line in FIG. 12. The flow of ink contained in the fluid accommodation portion 200 through the fluid supply port 280 to outside is also shown by an arrow in FIG. 12. As shown in FIG. 11, the cartridge 20 includes a main member 22 and a lid 24. The main member 22 and the lid 24 form the outer surface (outer shell) of the cartridge 20. The cartridge 20 also includes a valve mechanism 40, a coil spring 294 as a pressing portion, a pressure-receiving plate 293 and a sheet member (film member) 291.

The main member 22 and the lid 24 are made of a synthetic resin, such as polypropylene. The sheet member 291 is made of a synthetic resin (for example, material containing nylon and polypropylene) to have flexibility. The sheet member 291 is thus deformable by external force.

The sheet member 291 has a vent hole 292. This structure enables the air to be taken into the fluid accommodation portion 200 of the cartridge 20 via the air intake port 290, the vent hole 292 and a through hole 47 (described later).

The main member 22 is provided to form the fluid accommodation portion 200 and the fluid supply port 280. The main member 22 is in a recessed shape and has one side open. The sheet member 291 is applied to the main member 22 to cover the open side of the main member 22. More specifically, as shown in FIG. 12, the sheet member 291 is attached air-tight to an end face 22*t* that forms the opening of the main member 22 and to an end face 22*p* of a rib in the fluid accommodation portion 200. This structure forms the fluid accommodation portion 200 for containing ink. In other words, a portion of the wall members of the fluid accommodation portion 200 parting the internal space is formed by the deformable sheet member 291. This allows the volumetric change of the fluid accommodation portion 200. In FIG. 12, for the better understanding, the area where the sheet member 291 is applied is shown by cross hatching, and the area where the fluid accommodation portion 200 is formed is shown by single hatching.

As shown in FIG. 12, the lid 24 is attached to the outer area, which is outside of the area where the sheet member 291 is applied, on the positive Y-axis side end face of the main member 22 by, for example, thermal welding. A first communication chamber 242 is provided in the outer area of the main member 22, which is outside of the area where the fluid accommodation portion 200 is formed, as part of the communication path arranged to connect the inside with the outside of the fluid supply port 280.

A space is defined between the sheet member 291 and the lid 24. This space forms part of the communication path arranged to connect the inside with the outside of the fluid supply port 280.

The pressure-receiving plate 293 is made of a synthetic resin, such as polypropylene. The pressure-receiving plate 293 is placed in contact with the sheet member 291. The coil spring 294 is located inside the fluid accommodation portion 200. More specifically, the coil spring 294 is placed in contact with the pressure-receiving plate 293 and a surface of the main member 22 that is opposed to the pressure-receiving plate 293 (opposed surface). The coil spring 294 presses the pressure-receiving plate 293 in the direction of expanding the volume of the fluid accommodation portion 200. The coil spring 294 is expanded and contracted (moved) along the Y-axis direction.

The valve mechanism 40 serves to introduce the air into the fluid accommodation portion 200 intermittently with consumption of ink in the fluid accommodation portion 200. As shown in FIG. 11, the valve mechanism 40 includes a spring member 42, a lever valve 44 and a cover valve 46. The cover valve 46 is placed in a corner section 209 of the main member 22 (FIG. 12) where the third surface 203 and the fourth surface 204 cross each other and is attached to the main member 22. The cover valve 46 is made of a synthetic resin, such as polypropylene. The cover valve 46 is in a recessed shape and has an open end face 41, to which the sheet member 291 is attached air-tight. The recess of the cover valve 46 communicates with the vent hole 292. The through hole 47 is formed in the bottom of the recess of the cover valve 46 to be penetrated to the back side of the cover valve 46.

The lever valve 44 is pressed against the cover valve 46 by the spring member 42 to close the through hole 47. The lever valve 44 has a portion that is brought into contact with the pressure-receiving plate 293 by displacement. The lever valve 44 may be made of a synthetic resin, such as polypropylene. The lever valve 44 may be formed by double molding using an elastic material such as elastomer and a synthetic resin such as polypropylene.

The fluid supply port 280 communicates with the fluid accommodation portion 200. As shown in FIG. 11, the fluid supply port 280 internally has a supply member 30. The supply member 30 includes a foam (porous member) 34 and a sheet member (filter member) 36. The foam 34 and the sheet member 36 are sequentially arranged from one end 37*b* to the other end 37*a* of the fluid supply port 280. The foam 34 and the sheet member 36 are made of a synthetic resin, such as polyethylene terephthalate. The sheet member 36 is in contact with the fluid supply tube 640 (FIG. 2) in the attached state to supply ink to the printer 50. The sheet member 36 accordingly forms the fluid exit 31.

A-5. Communication Path and Operations of Cartridge 20

Figure 13:
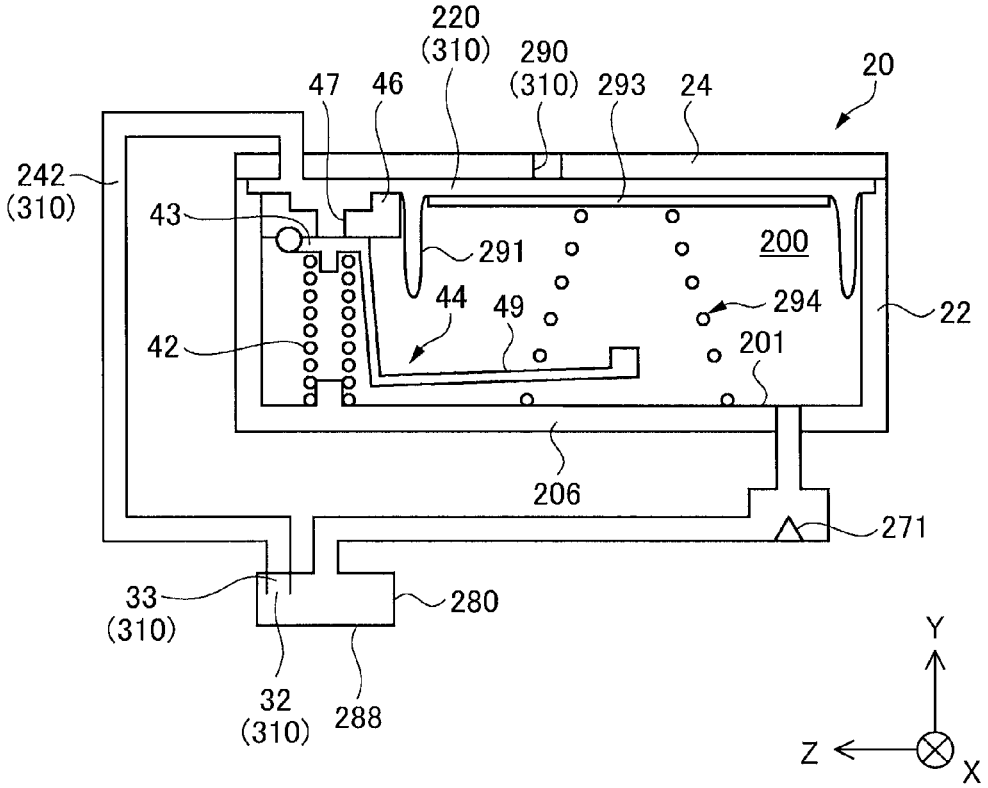
FIG. 13 is a first diagram illustrating the operations of the cartridge.
Figure 14:
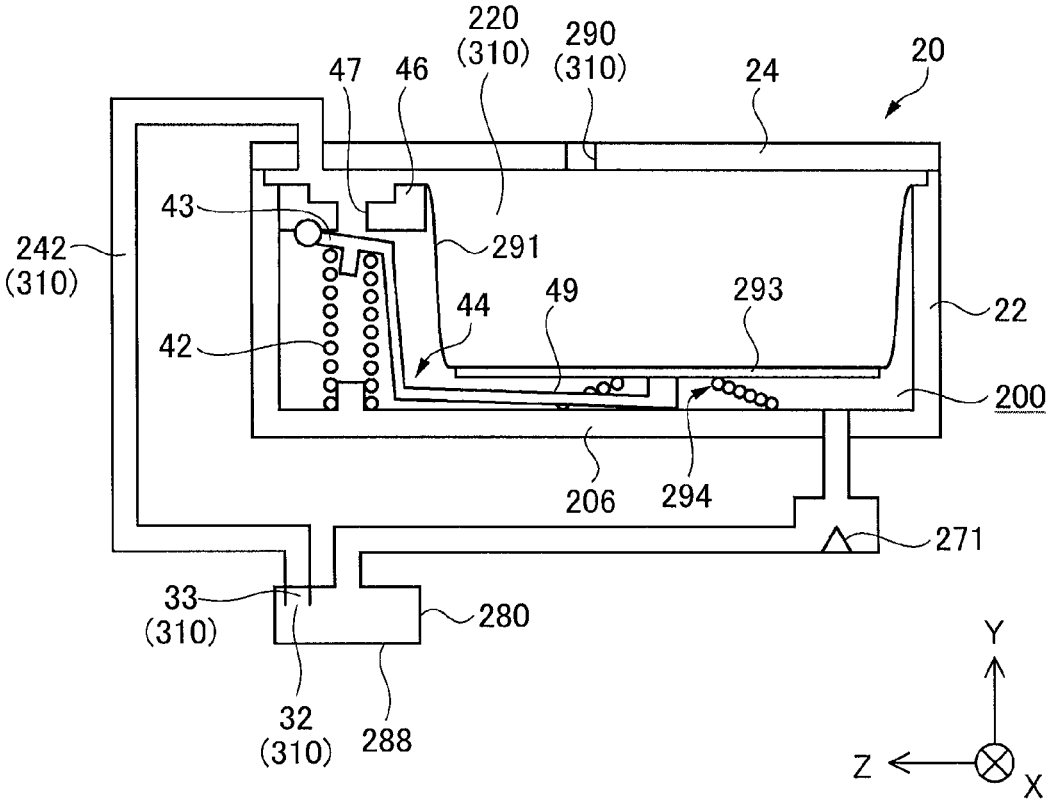
FIG. 14 is a second diagram illustrating the operations of the cartridge.
Figure 15:
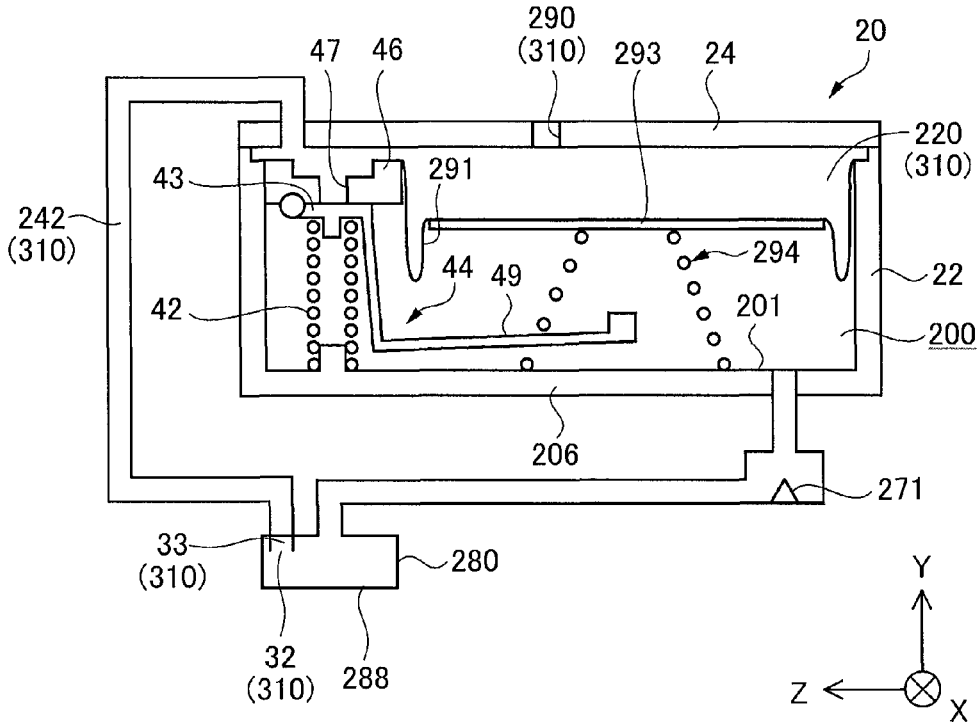
FIG. 15 is a third diagram illustrating the operations of the cartridge.

FIG. 13 is a first diagram illustrating the operations of the cartridge 20. FIG. 14 is a second diagram illustrating the operations of the cartridge 20. FIG. 15 is a third diagram illustrating the operations of the cartridge 20. The diagrams of FIGS. 13 to 15 schematically illustrate the internal state of the cartridge 20 for the better understanding.

Prior to description of the operations of the cartridge 20, the following describes a communication path 310 arranged to connect the inside with the outside of the fluid supply port 280. The communication path 310 has the connection port 32 at one end and the air intake port 290 at the other end. The communication path 310 includes a one-end-side flow path 33, the first communication chamber 242 and an air chamber 220 arranged sequentially in the flow direction of the fluid from the connection port 32 to the air intake port 290. The one-end-side flow path 33 is a passage formed inside the fluid supply port 280. The air chamber 220 is a space defined between the lid 24 and the sheet member 291.

As described above, the presence of the communication path 310 provided in the cartridge 20 effectively prevents an extreme difference between the internal pressure of the fluid supply port 280 (more specifically, the pressure in the portion of the fluid supply port 280 including the opening 288 where the air is present) and the external pressure.

For example, during attachment of the cartridge 20 to the printer 50 (during attachment operation), the elastic member 648 of the holder 60 (FIG. 2) serves to seal the periphery of the opening 288 of the fluid supply port 280. In the state of sealing the periphery of the opening 288, part of the elastic member 648 bits into the fluid supply port 280 to reduce the internal volume of the fluid supply port 280 and increase the internal pressure of the fluid supply port 280. In general, the flow path from the fluid accommodation portion 200 to the fluid exit 31 has a portion of higher flow resistance to prevent leakage of ink from the fluid exit 31 to outside. According to this embodiment, for example, the flow resistance is increased by the foam 34 and the sheet member 36 making the meniscus of the fluid and allowing retention of the fluid. In the state immediately after the periphery of the opening 288 is sealed and the internal volume of the fluid supply port 280 is reduced, the air corresponding to the reduced volume is not sufficiently introduced into the fluid accommodation portion 200. The presence of the communication path 310, however, works to release the air corresponding to the reduced volume to the outside and thereby keeps the internal pressure of the fluid supply port 280 substantially equal to the external pressure.

In the structure of the cartridge 20 without the communication path 310, for example, the compressed air in the fluid supply port 280 gradually flows into the fluid accommodation portion 200 after attachment of the cartridge 20. This may cause the air to enter the fluid accommodation portion 200 unexpectedly and prevent the internal pressure of the fluid accommodation portion 200 from being kept in an adequate pressure range. When the air in the fluid supply port 280 continuously flows into the fluid accommodation portion 200 until the increased internal pressure of the fluid supply port 280 balances with the internal pressure of the fluid accommodation portion 200, the internal pressure of the fluid accommodation portion 200 is increased from the previous level before the air inflow. The user's detachment of the cartridge 20 from the holder 60 in this state reduces the internal pressure of the fluid supply port 280 to the atmospheric pressure. In other words, this reduces the internal pressure of the fluid supply port 280 and may cause ink to be leaked from the fluid accommodation portion 200 of the increased pressure through the supply member 30 to the outside.

In the unused state of the cartridge 20, in order to prevent leakage of ink to the outside, for example, a sealing member (e.g., film or cap) for closing the opening 288 may be attached to the opening 288. In the unused state of the cartridge 20, the cartridge 20 may be stored in a vacuum package in the lower pressure than the atmospheric pressure. When the cartridge 20 with the sealing member is placed in a package and is subjected to pressure reduction, the internal pressure in the air chamber 220 is also reduced. This increases the absolute value of negative pressure in the fluid accommodation portion 200 (i.e., increased to the higher degree of negative pressure). The inside of the fluid supply port 280 is, on the other hand, the space of the limited gas flow to and from the outside and is accordingly kept at the atmospheric pressure immediately after vacuum packaging. This causes pressure imbalance between the internal pressure of the fluid supply port 280 and the internal pressure of the fluid accommodation portion 200 and makes the flow of the air from the fluid supply port 280 into the fluid accommodation portion 200. When the cartridge 20 is taken out of the vacuum package, the internal pressure of the air chamber 220 is returned to the atmospheric pressure and thereby decreases the absolute value of negative pressure in the fluid accommodation portion 200 (i.e., returned to the original degree of negative pressure). The inside of the fluid supply port 280 is, on the other hand, kept in the reduced pressure. This may cause leakage of ink from the fluid accommodation portion 200 toward the fluid supply port 280.

The following describes the operations of the cartridge 20. As shown in FIG. 13, the lever valve 44 includes a valve member 43 configured to close the through hole 47 and a lever member 48 operated to open and close the valve member 43. In the unused state of the cartridge 20 (brand-new state), the fluid accommodation portion 200 is filled with ink. In this state, the valve member 43 of the lever valve 44 is pressed by the spring member 42 to close the through hole 47. The coil spring 294 presses the pressure-receiving plate 293 in the direction of expanding the volume of the fluid accommodation portion 200 (in the positive Y-axis direction). This causes the internal pressure of the fluid accommodation portion 200 to be kept in the lower pressure (negative pressure) than the atmospheric pressure.

As shown in FIG. 14, when the pressure-receiving plate 293 approaches the sixth surface 206 accompanied with consumption of ink in the fluid accommodation portion 200, the pressure-receiving plate 293 presses the lever member 49 toward the sixth surface 206. This separates the valve member 43 from the through hole 47 and thereby allows temporary communication between the outside air and the fluid accommodation portion 200. In other words, the lever valve 44 is in the open position. The outside air then flows through the air intake port 290, the air chamber 220, the vent hole 292 and the through hole 47 into the fluid accommodation portion 200. The volume of the fluid accommodation portion 200 is thus expanded by the amount of air intake as shown in FIG. 15. Simultaneously the degree of negative pressure in the fluid accommodation portion 200 is slightly reduced (toward the atmospheric pressure). Certain air intake into the fluid accommodation portion 200 separates the pressure-receiving plate 293 from the lever member 49 as shown in FIG. 15. The valve member 43 then closes the through hole 47 again. In other words, the lever valve 44 is in the closed position. Increasing the degree of negative pressure in the fluid accommodation portion 200 accompanied with consumption of ink in the fluid accommodation portion 200 temporarily sets the lever valve 44 in the open position, so as to maintain the internal pressure of the fluid accommodation portion 200 in the adequate pressure range.

A-6. Detailed Structure of Fluid Supply Port 280

Figure 16:
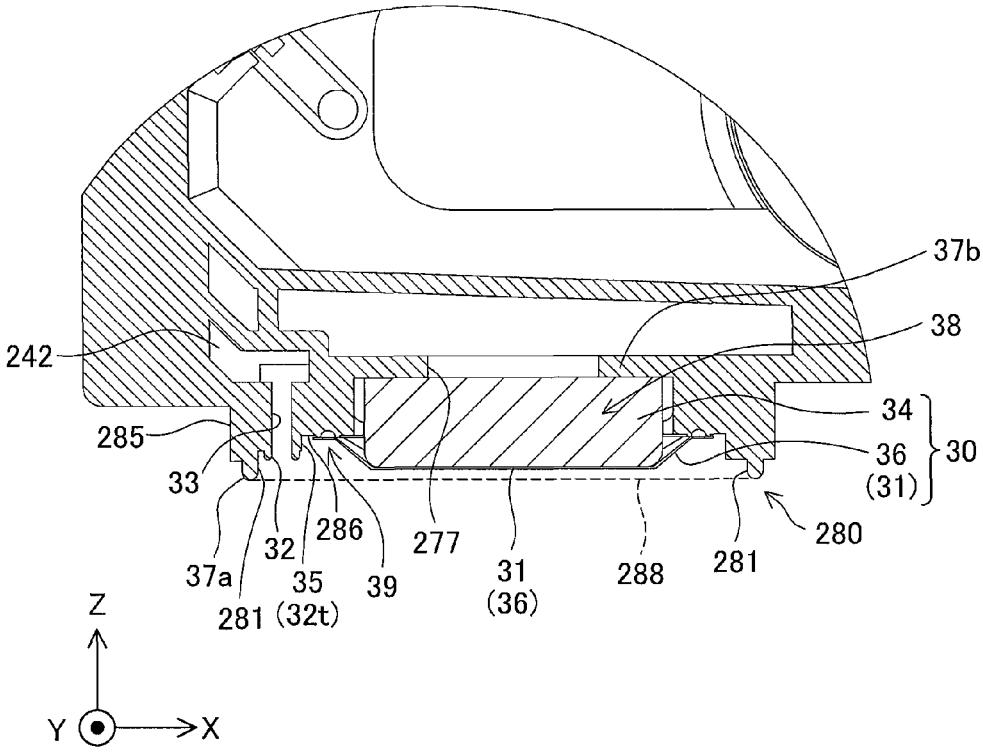
FIG. 16 is a partial cross sectional view of an F9-F9 cross section in FIG. 9.
Figure 17:
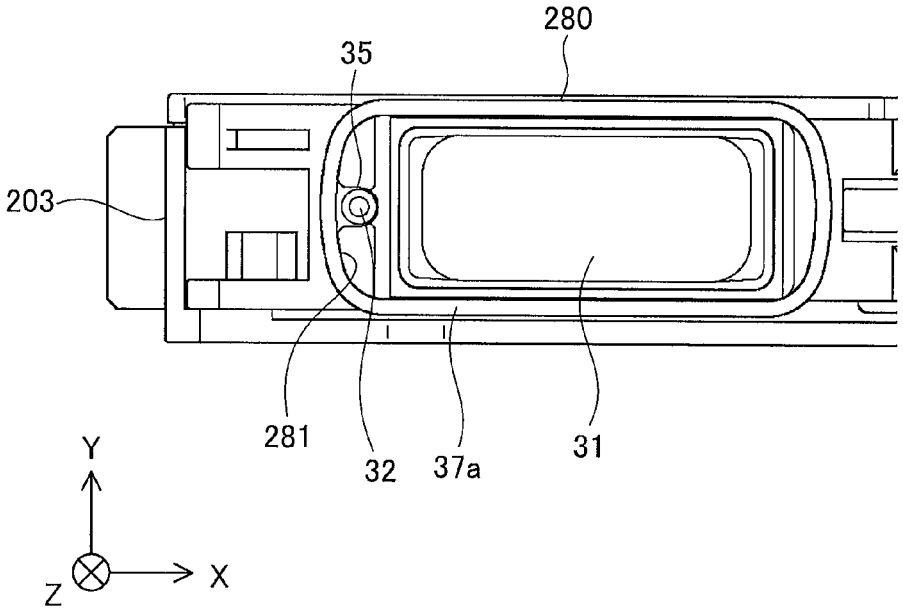
FIG. 17 is a bottom view illustrating the neighborhood of a fluid supply port.

FIG. 16 is a partial cross sectional view of an F9-F9 cross section in FIG. 9. FIG. 16 illustrates the cross section in the neighborhood of the fluid supply port 280. FIG. 17 is a bottom view illustrating the neighborhood of the fluid supply port 280. The fluid supply port 280 includes a supplier main body 285, the fluid exit 31, the one-end-side flow path 33 and an inner wall 35.

The supplier main body 285 forms part of the main member 22. The supplier main body 285 defines and forms an inner flow path (ink flow passage) of the fluid supply port 280. The fluid exit 31 is formed by attaching the sheet member 36 to the supplier main body 285. More specifically, the fluid exit 31 is formed as described below. In the fluid supply port 280, the sheet member 36 is placed to separate a flow path 38 (first flow path 38) located on the one end 37*b*-side from a flow path 39 (second flow path 39) located on the other end 37*a*-side, in the flow path from the fluid connection port 277 formed at one end 37*b* to the opening 288 formed at the other end 37*a*. The sheet member 36 is attached to the supplier main body 285 by, for example, welding. More specifically, the sheet member 36 is attached to a surface 286 parallel to the plane (XY plane) perpendicular to the first direction (negative Z-axis direction), out of the inner wall surface of the supplier main body 285. This structure enables the sheet member 36 to serve as the fluid exit 31. The first flow path 38 is filled with ink. The ink in the first flow path 38 is continuous with the ink in the fluid accommodation portion 200. The sheet member 36 is a porous body. The sheet member forms a meniscus to retain ink. The air is present in the second flow path 39. The one end 37*b*-side is specified as upstream side and the other end 37*a*-side is specified as downstream side with respect to the direction (Z-axis direction) along the first direction (negative Z-axis direction). The fluid exit 31 separately defines and forms the space where ink is contained (first flow path 38) and the space where the air is contained (second flow path 39) to allow ink flow therebetween. This structure causes ink to flow through the fluid exit 31 into the printer 50. The first flow path 38 includes the fluid connection port 277, through which ink in the fluid accommodation portion 200 flows into the fluid supply port 280, at the upstream-side end 37*b* (FIG. 16). The second flow path 39 includes the opening 288 at the downstream-side end 37*a*. The opening 288 is open toward the outside.

As shown in FIG. 17, in projection onto the plane perpendicular to the first direction (negative Z-axis direction), the connection port 32 and the fluid exit 31 are arranged at different positions. More specifically, the connection port 32 is placed closer to the third surface 203 rather than the fluid exit 31. As shown in FIG. 16, the one-end-side flow path 33 including the connection port 32 of the communication path 310 is formed inside the fluid supply port 280. The one-end-side flow path 33 is extended upward from the connection port 32. More specifically, the one-end-side flow path 33 is extended from the connection port 32 along a direction (positive Z-axis direction) opposite to the first direction (negative Z-axis direction). Part of the one-end-side flow path 33 located on the negative Z-axis side (i.e., part including the inner wall 35 as its wall) is protruded inside the fluid supply port 280. This protruded part of the inner flow path (hereinafter may also be called "passage 33") corresponds to the "protruded passage" described in WHAT IS CLAIMED IS.

As shown in FIG. 16, the connection port 32 forms one end of the passage 33 that is protruded toward the opening 288 in the fluid supply port 280. The passage 33 is part of the one-end-side flow path 33 on the negative Z-axis side (ink outflow direction side). The passage 33 is protruded from the inner wall surface of the fluid supply port 280. In other words, the passage 33 is protruded in the inner space of the fluid supply port 280 toward the first direction (ink outflow direction). This passage 33 has a connection port-forming member 32*t* protruded from the inner wall surface of the fluid supply port 280, as its circumferential wall. The connection port-forming member 32*t* is protruded from the surface 286 that is the lower end face of the supplier main body 285. The surface 286 is arranged to surround the foam 34. In other words, part of the ink flow path of the fluid supply port 280 is formed inside of the surface 286. The connection port-forming member 32*t* forms the connection port 32 at its one end. The connection port 32 provided as the opening accordingly forms one end of the passage 33 protruded in the inner space of the fluid supply port 280 (more specifically, negative Z-axis side part of the one-end-side flow path 33). The connection port-forming member 32*t* also forms part of the one-end-side flow path 33. The connection port-forming member 32*t* is integrally formed with the supplier main body 285. The circumferential wall of the connection port-forming member 32*t* defines the inner wall 35 arranged to interfere with the flow of ink running on the wall surface of the fluid supply port 280 and flowing from the fluid exit 31 toward the connection port 32. In other words, according to this embodiment, the inner wall 35 is located between the fluid exit 31 and the connection port 32 out of the wall surface of the supplier main body 285.

As shown in FIGS. 16 and 17, the connection port 32 is arranged away from a circumferential wall 281 (side face 281 of the fluid supply port 280) that defines the opening 288 at the end of the side face of the fluid supply port 280. In other words, the connection port 32 is not in contact with the side face 281 of the fluid supply port 280.

Figure 18:
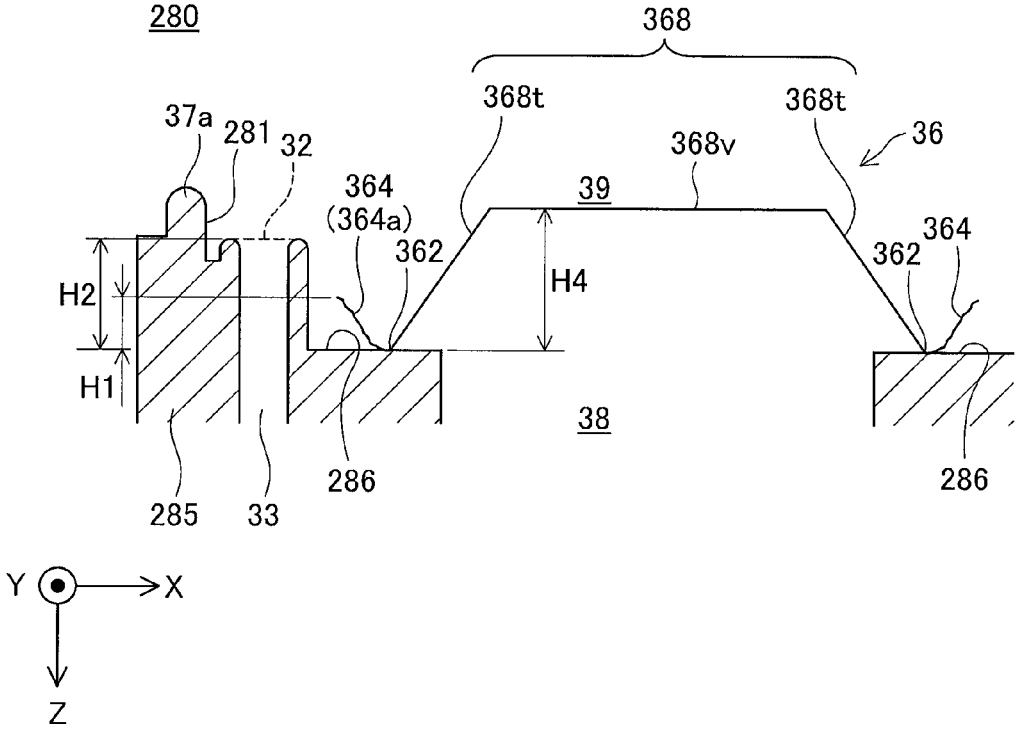
FIG. 18 is a diagram illustrating the further detailed structure of the fluid supply port.

FIG. 18 is a diagram illustrating the further detailed structure of the fluid supply port 280. FIG. 18 schematically illustrates the neighborhood of the connection port 32 of the fluid supply port 280. The detailed structure of the fluid supply port 280 is described with reference to FIG. 18. The sheet member 36 includes a mounting portion 362, a sheet center portion 368 as the center portion and a non-mounting portion 364. The mounting portion 362 is a portion attached to the surface 286 of the supplier main body 285. The mounting portion 362 is attached air-tight to prevent leakage of ink from the first flow path 38 to the second flow path 39. The sheet center portion 368 is a portion surrounded by the mounting portion 362 of the sheet portion 36; namely the sheet center portion 368 is located inside of the mounting portion 362. The sheet center portion 368 is arranged to separate the first flow path 38 from the second flow path 39. The sheet center portion 368 also serves to move ink from the first flow path 38 to the second flow path 39. The sheet center portion 368 includes a first center portion 368*v* perpendicular to the first direction (negative Z-axis direction) and inclined portions 368*t* inclined to the first direction. The inclined portions 368*t* are connected with the mounting portion 362 and the first center portion 368*v*. The sheet center portion 368 is convex downward (toward the negative Z-axis side). The inclined portions 368*t* are accordingly arranged such that part of the inclined portions 368*t* farther away from the mounting portion 362 and nearer to the first center portion 368*v* are located on the lower side (negative Z-axis side). The non-mounting portion 364 is a portion that is located outside of the mounting portion 362 and is not attached to the supplier main body 285.

As shown in FIG. 18, the non-mounting portion 364, the connection port 32, the other end 37*a* and the sheet member 36 are located on the same side (negative Z-axis side) with respect to the surface 286. The non-mounting portion 364, the connection port 32 and the sheet member 36 respectively have a height H1, a height H2 and a height H4 from the surface 286 as the reference plane. The heights H1, H2 and H4 represent the maximum heights of the respective elements. In this case, the fluid supply port 280 satisfies the relationship of H1<H2. The non-mounting portion 364 is accordingly located above the connection port 32. It is not necessary that the entire non-mounting portion 364 is located above the connection port 32, but the requirement is that a first peripheral part 364*a* or a part of the non-mounting portion 364 located nearest to the connection port 32 is located above the connection port 32. The non-mounting portion 364 corresponds to periphery 364 of the fluid exit 31.

The fluid supply port 280 also satisfies the relationship of H4>H2. The connection port 32 is accordingly located below the fluid exit 31.

A-7. Advantageous Effects

In the cartridge 20 according to the embodiment described above, the connection port 32 is not in contact with the side face 281 of the fluid supply port 280 (FIG. 15). This structure effectively reduces the likelihood that ink reaches the connection port 32 even when ink flows along the side face 281. This reduces the potential for leakage of ink through the connection port 32 to the outside.

The connection port 32 forms one end of the passage 33 protruded in the inner space of the fluid supply port 280 (FIG. 15). Even when ink flows along the inner surface of the fluid supply port 280, the connection port-forming member 32*t* (inner wall 35) defining the passage 33 serves as the barrier to reduce the likelihood that ink reaches the connection port 32. This reduces the potential for leakage of ink through the connection port 32 to the outside.

The connection port 32 is located downstream of the first peripheral part 364*a* in the ink outflow direction (negative Z-axis direction) (FIG. 18). This arrangement reduces the likelihood that ink reaches the connection port 32. For example, in the state of the cartridge 20 where the downstream side is located above the upstream side, the connection port 32 is located above the first peripheral part 364*a*. This reduces the likelihood that ink leaked from the first peripheral part 364*a* or the neighborhood of the first peripheral part 364*a* reaches the connection port 32.

The fluid supply port 280 is integrally formed with the passage 33. This structure effectively reduces the likelihood that a gap is created by, for example, damage or breakage to allow communication between the inside of the fluid supply port 280 and the passage 33 at a location other than the connection port 32. This accordingly reduces the potential for ink flow through the gap into the passage 33.

The connection port 32 is located upstream of the fluid exit 31 in the ink outflow direction (negative Z-axis direction) (FIG. 18). This arrangement effectively reduces the likelihood that the connection port 32 or the connection port-forming member 32*t* defining the connection port 32 comes into contact with another member located in the vicinity of the fluid exit 31. Another member may be, for example, the printer 50.

A-8. Other Effects

The cartridge 20 of the above embodiment has the inner wall 35 located between the connection port 32 and the fluid exit 31 (FIG. 16). Even when the cartridge 20 receives external force during, for example, transportation to cause leakage of ink in the fluid accommodation portion 200 through the fluid exit 31 to the outside, the presence of the inner wall 35 effectively interferes with the flow of ink toward the connection port 32. This reduces the likelihood that ink leaked through the fluid exit 31 reaches the connection port 32.

In the cartridge 20, the inner wall 35 is defined by the connection port-forming member 32*t* that has the connection port 32 at one end and internally forms part of the communication path 310 (FIG. 16). This arrangement allows formation of the inner wall 35 simultaneously with formation of part of the communication path 310 including the connection port 32.

In the cartridge 20, the one-end-side flow path 33 is extended from the connection port 32 upward (toward positive Z-axis direction) (FIG. 18). The first peripheral part 364*a* is located above the connection port 32 (on the positive Z-axis side) (FIG. 18). Even when ink in the fluid accommodation portion 200 is leaked through the fluid exit 31 to the outside (for example, to the second flow path 39), this arrangement further reduces the likelihood that the leaked ink flows through the connection port 32 into the communication path 310. For example, in the state of the cartridge 20 that the one end 37*b* is located on the upper side in the vertical direction and the other end 37*a* is located on the lower side in the vertical direction (hereinafter called "first state", which is equivalent to the attached state), even when ink reaches the connection port 32, this arrangement uses the force of gravity to prevent the ink flow toward the one-end-side flow path 33. In a second state of the cartridge 20 that is turned upside down from the first state, the connection port 32 is located above the first peripheral part 364*a* in the vertical direction (FIG. 18). This arrangement effectively reduces the likelihood that ink leaked through the fluid exit 31 reaches the connection port 32 and flows into the communication path 310 in the second state.

The connection port 32 is located above the fluid exit 31 (on the positive Z-axis side) (FIG. 18). In other words, the connection port 32 is located on the inner side (one end 37*b*-side) of the fluid exit 31 in the fluid supply port 280. This arrangement causes the connection port 32 to be located farther away from the opening 288 than the fluid exit 31. This reduces the likelihood that the connection port-forming member 32*t* defining the connection port 32 comes into contact with another member. For example, this prevents the elastic member 648 of the holder 60 from coming into contact with the connection port 32 and thereby blocking the connection port 32 in the course of attachment of the cartridge 20 to the holder 60. This structure accordingly enables the air in the fluid supply port 280 to be released to the outside via the connection port 32 during attachment of the cartridge 20 to the holder 60, thereby reducing an increase in internal pressure of the fluid supply port 280.

In the cartridge 20, the supplier main body 285 is integrally formed with the inner wall 35. This structure reduces the likelihood of creating a gap between the supplier main body 285 and the inner wall 35 by, for example, damage or breakage, compared with the structure that the supplier main body 285 and the inner wall 35 are formed by separate members. This structure enables the inner wall 35 to more effectively interfere with the flow of ink from the fluid exit 31 to the connection port 32.

The connection port 32 is located not in close contact with but away from the circumferential wall 281 (FIGS. 16 and 18). This arrangement advantageously reduces the likelihood that ink flowing along the circumferential wall 281 reaches the connection port 32.

The attachment of the sheet member 36 to the supplier main body 285 forms the fluid exit 31. This arrangement facilitates formation of the fluid exit 31 that is capable of retaining ink therein. The sheet member 36 has the non-mounting portion 364. The presence of this non-mounting portion 364 allows retention of ink. This also reduces the likelihood that ink reaches the connection port 32.

The transmissive surface 275 is provided at the position nearer to the first end 201*t* than the second end 201*s* of the first surface 201, while the fluid supply port 280 is provided at the position nearer to the second end 201*s* than the first end 201*t* of the first surface 201 (FIG. 10). This arrangement reduces the likelihood that ink flowing out of the fluid supply port 280 adheres to the transmissive surface 275. This accordingly prevents reduction of accuracy in optical detection of the fluid remaining status (presence or absence of fluid and the remaining amount of fluid) with the prism unit 270.

B. Second Embodiment

B-1. Structure of Cartridge 13

Figure 19:
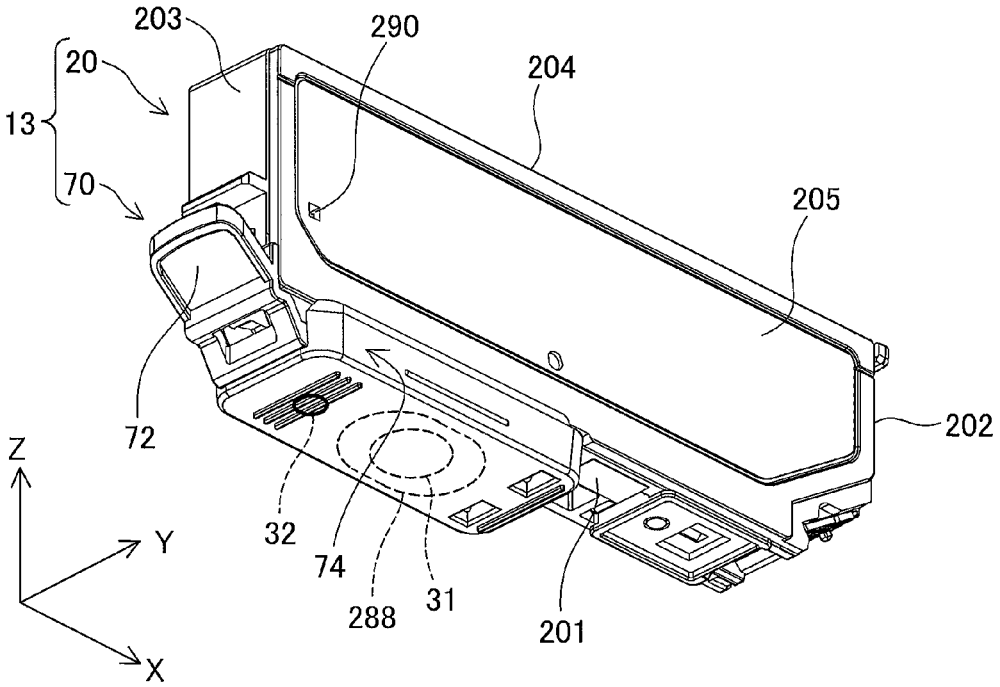
FIG. 19 is a perspective view illustrating a cartridge according to a second embodiment.

FIG. 19 is a perspective view illustrating a cartridge 13 according to a second embodiment. The cartridge 13 of the second embodiment includes a cartridge main body 20 and a cap 70. The cartridge main body 20 of the second embodiment has the same structure as that of the cartridge 20 of the first embodiment. The following accordingly describes the cap 70.

The cap 70 is removably attached to the cartridge main body 20 to cover the opening 288 of the fluid supply port 280. The cap 70 includes a cap main body 74 configured to close the opening 288 and a cap lever 72 used as a lever for detachment of the cap 70 from the cartridge main body 20. When attaching the cartridge main body 20 to the holder 60, the user holds the cap lever 72 and removes the cap lever 72 from the cartridge main body 20. As shown in FIG. 19, the cap lever 72 is protruded outside of the outer surface of the cartridge main body 20. More specifically, the cap lever 72 is protruded outside (on the negative X-axis side) of the third surface 203. The cap lever 72 and the connection port 32 are located on the same side (negative X-axis side) with respect to the fluid exit 31.

Figure 20:
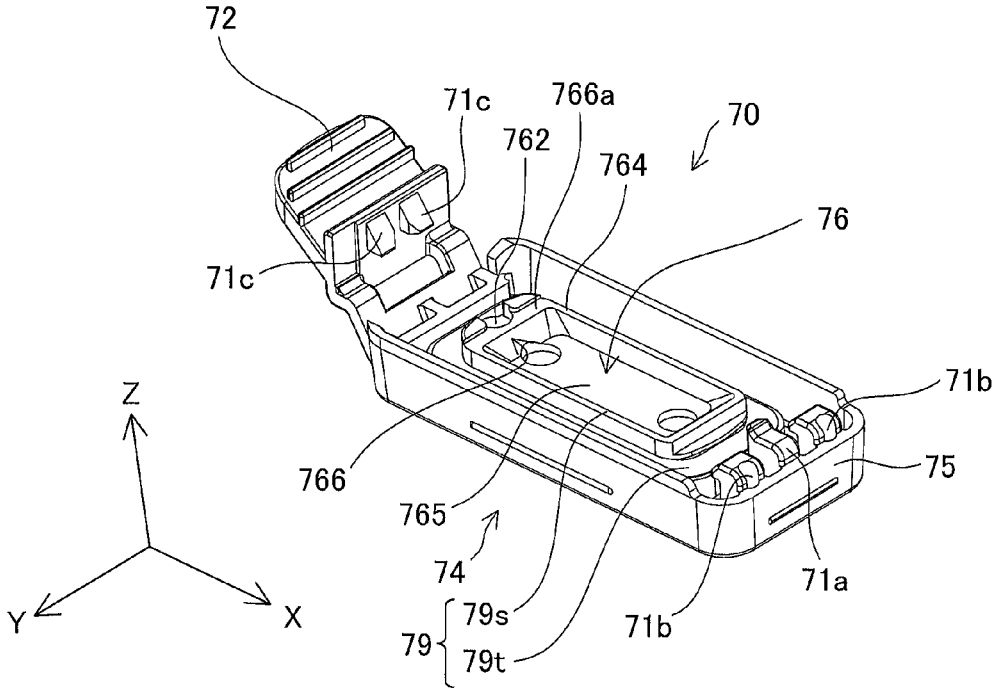
FIG. 20 is a first perspective view of a cap.
Figure 21:
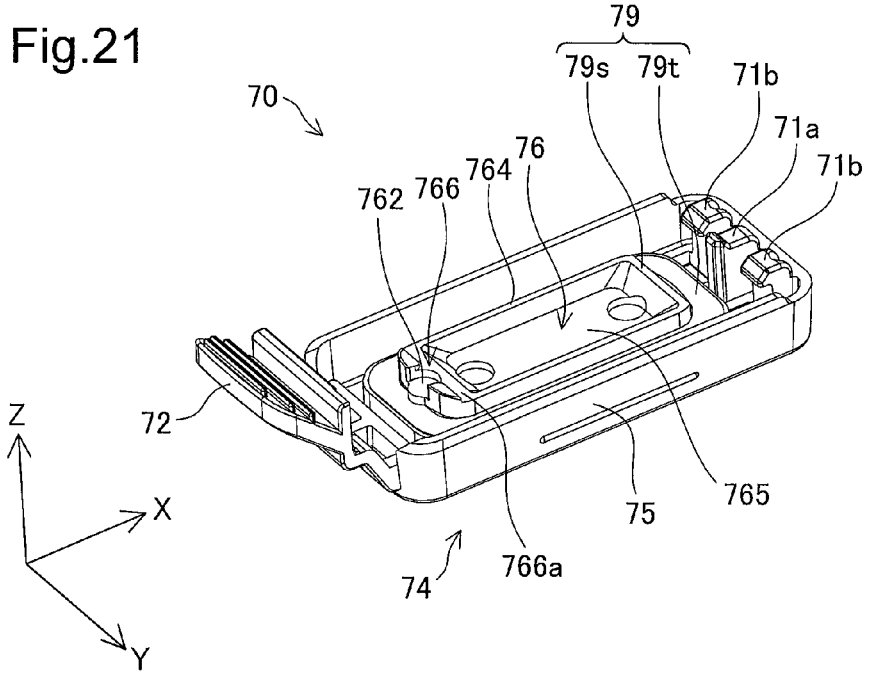
FIG. 21 is a second perspective view of the cap.
Figure 22:
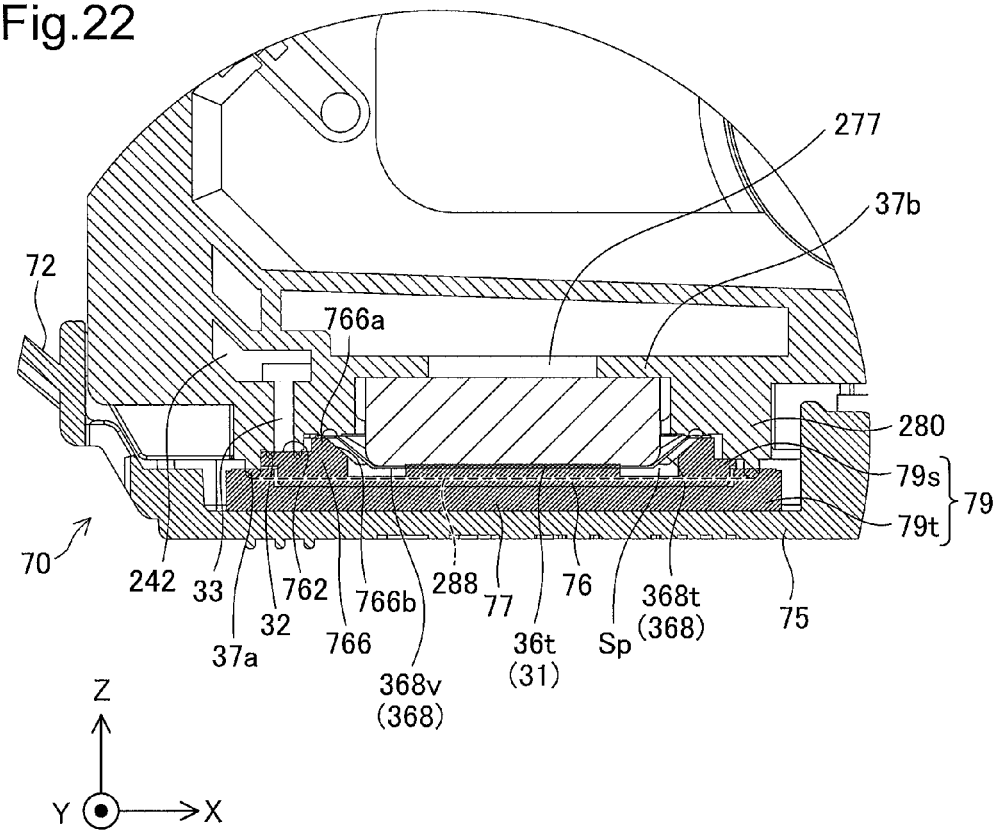
FIG. 22 is a partial cross sectional view of the cartridge.

FIG. 20 is a first perspective view of the cap 70. FIG. 21 is a second perspective view of the cap 70. FIG. 22 is a partial cross sectional view of the cartridge 13. FIG. 22 is a diagram comparable to FIG. 16 of the first embodiment.

As shown in FIGS. 20 and 21, the cap main body 74 includes a base member 75 in a recessed shape, and a first cap member 79 placed in the recess of the base member 75 to be in close contact with the other end 37*a* and thereby close the opening 288. The first cap member 79 is made of, for example, elastomer and has elasticity. The base member 75 and the cap lever 72 are made of a synthetic resin, such as polypropylene.

The cap 70 has a pair of first projections 71*b*, an insertion piece 71*a* and a pair of second projections 71*c*. The pair of first projections 71*b* are placed at an interval in the Y-axis direction. The insertion piece 71*a* is placed between the pair of first projections 71*b*. The insertion piece 71*a* is in a protruded shape. The pair of first projections 71*b* are locked by the first accommodation portion locking elements 331 (FIGS. 4 and 10). More specifically, respective parts of the pair of first projections 71*b* are inserted into the corresponding spaces of the first accommodation portion locking elements 331, so that the pair of first projections 71*b* are locked by the first accommodation portion locking elements 331. The cap 70 is accordingly positioned relative to the cartridge main body 20 in the X-axis direction (longitudinal direction of the first surface 201 of the cartridge main body 20). More specifically, in the attached state that the cap 70 is attached to the cartridge main body 20 (also called "state that the opening 288 is blocked"), when the cap 70 is moved relative to the cartridge main body 20 in the negative X-axis direction, the first accommodation portion locking elements 331 come into contact with the first projections 71*b* to prevent further movement of the cap 70 in the negative X-axis direction.

The insertion piece 71*a* is received in the accommodation portion receiver 333 (FIGS. 4 and 10), so that the cap 70 is positioned relative to the cartridge main body 20 in the Y-axis direction (short-side direction of the first surface 201 of the cartridge main body 20). More specifically, in the attached state, when the cap 70 is moved relative to the cartridge main body 20 in the Y-axis direction, the insertion piece 71*a* comes into contact with the accommodation portion receiving member 333 (more specifically, the surfaces formed by the pair of first accommodation portion locking elements 331) to prevent further movement of the cap 70 in the Y-axis direction.

The pair of second projections 71*c* are provided on an opposed side of the cap lever 72 opposed to the third surface 203. In the attached state, the pair of second projections 71*c* are inserted into the corresponding recesses 207 (FIGS. 3, 7 and 11) provided on the third surface 203. A second positioning member 79*t* of the first cap member 79 thus air-tightly comes into contact with the other end 37*a* where the opening 288 is formed and thereby seals (or caps) the opening 288. The plane that runs through the center of the cap 70 (center of the cap 70 in the Y-axis direction) and that is parallel to the X axis and the Z axis is located between the pair of recesses 207.

As shown in FIGS. 20 to 22, the first cap member 79 has a sealing portion 762 and a receiver member 76. The sealing portion 762 closes the connection port 32 in the attached state that the cap 70 is attached to the cartridge main body 20. The receiver member 76 receives the fluid exit 31 (sheet member 36) in the attached state. The receiver member 76 is in a recessed shape.

The first cap member 79 also has a cap stepped member 766 provided as a second stepped member located between the sealing portion 762 and the receiver member 76. The cap stepped member 766 is formed by a peripheral member 764 of the receiver member 76. The cap stepped member 766 has a projection 766*a*. The projection 766*a* is extended more than a bottom 765 of the receiver member 76 and the sealing portion 762 toward the one end 37*b*-side (positive Z-axis side).

As shown in FIG. 22, in the attached state, the receiver member 76 comes into contact with at least part of the sheet center portion 368. The peripheral member 764 has an opposed part 766*b* that is inclined along the inclination direction of the inclined portions 368*t* of the fluid exit 31. The opposed part 766*b* is formed along the circumferential direction of the peripheral member 764. In other words, the opposed part 766*b* is erected from the periphery of the bottom 765 of the receiver member 76. The inclined portions 368*t* and the opposed part 766*b* may not necessarily have the same inclination angle to the first direction (negative Z-axis direction) but are required to be inclined in the same direction. According to this embodiment, the opposed surfaces of the inclined portions 368*t* and the opposed part 766*b* are arranged substantially parallel to each other.

As shown in FIG. 22, the first cap member 79 has a first positioning member 79*s* that defines the receiver member 76 and the sealing portion 762, and the second positioning member 79*t* that comes into contact with the other end 37*a* as described above.

B-2. Advantageous Effects

According to the second embodiment, the cartridge 13 has the cap 70 provided to close the opening 288. This structure reduces the potential for ink leakage from the opening 288 during, for example, transportation of the cartridge 13. The connection port 32 and the cap lever 72 are located on the same side with respect to the fluid exit 31. This structure causes the unstable attitude when the user places the cartridge 13 with the cap lever 72 facing down, on a specified plane. This accordingly prevents the cartridge 13 with the cap lever 72 facing down from being placed on the specified plane. Even when ink is leaked through the fluid exit 31, this effectively reduces the likelihood that leaked ink reaches the connection port 32. The cap 70 has the sealing portion 762. The presence of the sealing portion 762 reduces the likelihood that ink flows through the connection port 32 into the communication path 310.

The cap 70 has the cap stepped member 766. The presence of the cap stepped member 766 interferes with the ink flow and accordingly reduces the likelihood that ink flows along the receiver member 76 and reaches the sealing portion 762. The cap stepped member 766 is formed by the peripheral member 764 of the receiver member 76. This structure does not require any additional member for providing a step. The receiver member 76 is formed in the recessed shape and the sealing portion 762 is provided outside of the receiver member 76, so that the cap stepped member 766 is readily formed by the peripheral member 764.

The opposed part 766*b* of the cap 70 is inclined along the inclination direction of the inclined portions 368*t* of the fluid exit 31. This arrangement reduces the volume of an inner chamber Sp that is defined by the fluid supply port 280 and the cap 70 to contain the air. This limits the amount of the air flowing through the fluid exit 31 into the fluid accommodation portion 200 even when the inner chamber Sp is compressed and the air contained in the inner chamber Sp flows back to the fluid accommodation portion 200 during attachment of the cap 70 to the cartridge 13. The inner chamber Sp is a space located on the opening 288-side (downstream side) of the fluid exit 31 in the space defined by the fluid supply port 280 and the cap 70. The upstream side and the downstream side herein are specified with respect to the flow direction of the fluid flowing from one end 37*b* to the other end 37*a* of the fluid supply port 280.

The receiver member 76 comes into contact with at least part of the sheet center portion 368. This arrangement further reduces the volume of the inner chamber Sp where the air is present. This further limits the amount of the air flowing from the inner chamber Sp through the fluid exit 31 into the fluid accommodation portion 200. The cap 70 comes into contact with the sheet center portion 368 of the fluid exit 31, so as to prevent leakage of ink through the fluid exit 31.

The cap 70 has the opposed part 766*b* that is inclined along the inclination direction of the inclined portions 368*t* of the fluid exit 31 (FIG. 22). This opposed part 766*b* is formed by the peripheral member 764 of the receiver member 76 (cap stepped member 766). The presence of the opposed part 766*b* reduces the likelihood that ink leaked out of the fluid exit 31 flows out of the cap 70. In other words, the cap 70 has the member 766 erected from the periphery of the surface opposed to the fluid exit 31 toward the fluid exit 31-side (toward the positive Z-axis side). Even when ink leaked out of the fluid exit 31 adheres to and flows along the surface of the cap 70 opposed to the fluid exit 31, this structure retains ink in the receiver member 76. Thus, this structure reduces the potential for ink flow out of the receiver member 76.

The cap 70 has the elements 71*a* and 71*b* for positioning the cap 70 relative to the cartridge main body 20. This structure enables the cap 70 to effectively close the opening 288. The receiver member 76 receives the fluid exit 31 placed therein and thereby reduces the potential for ink flow out of the receiver member 76.

The other structure of the cartridge 13 of the second embodiment is similar to the corresponding structure of the cartridge 20 of the first embodiment and has the similar advantageous effects to those of the first embodiment described above.

C. Third Embodiment

C-1. Structure of Cartridge 13*a*

Figure 23:
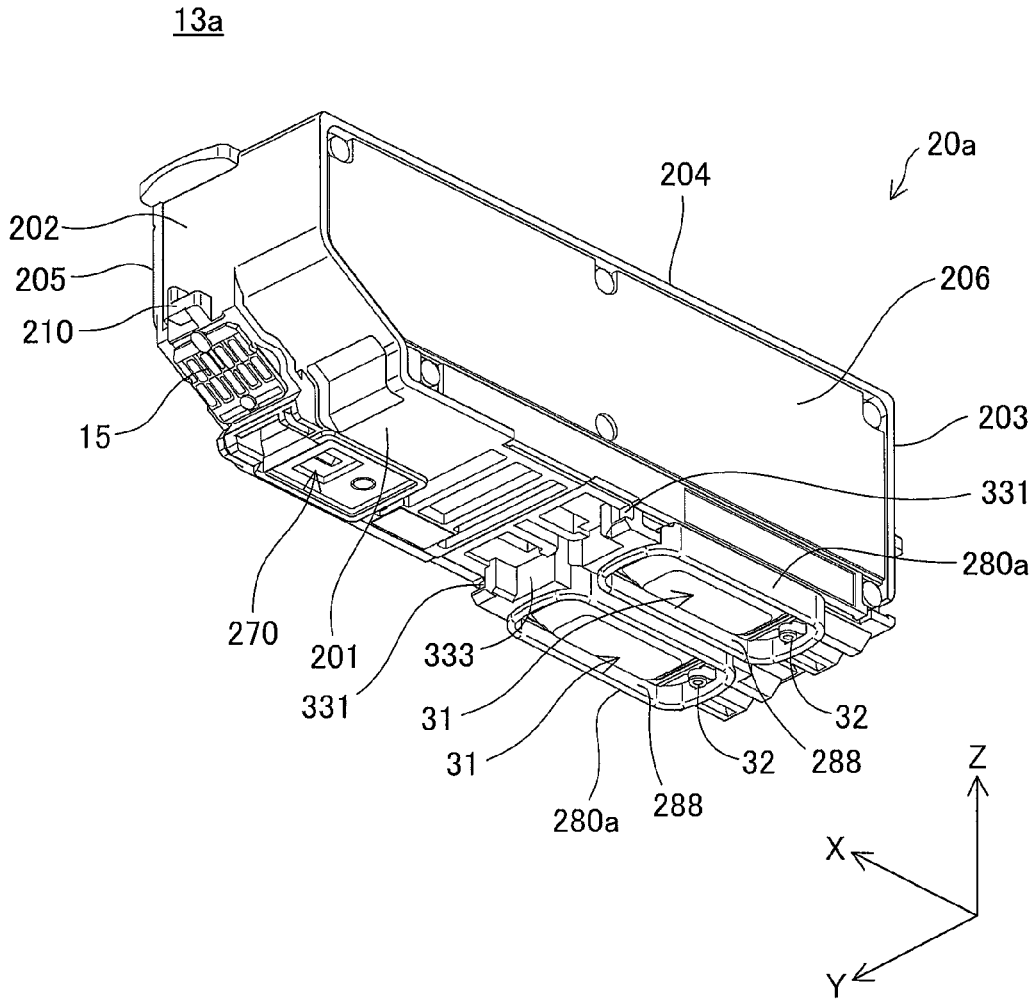
FIG. 23 is a perspective view illustrating a cartridge main body according to a third embodiment.
Figure 24:
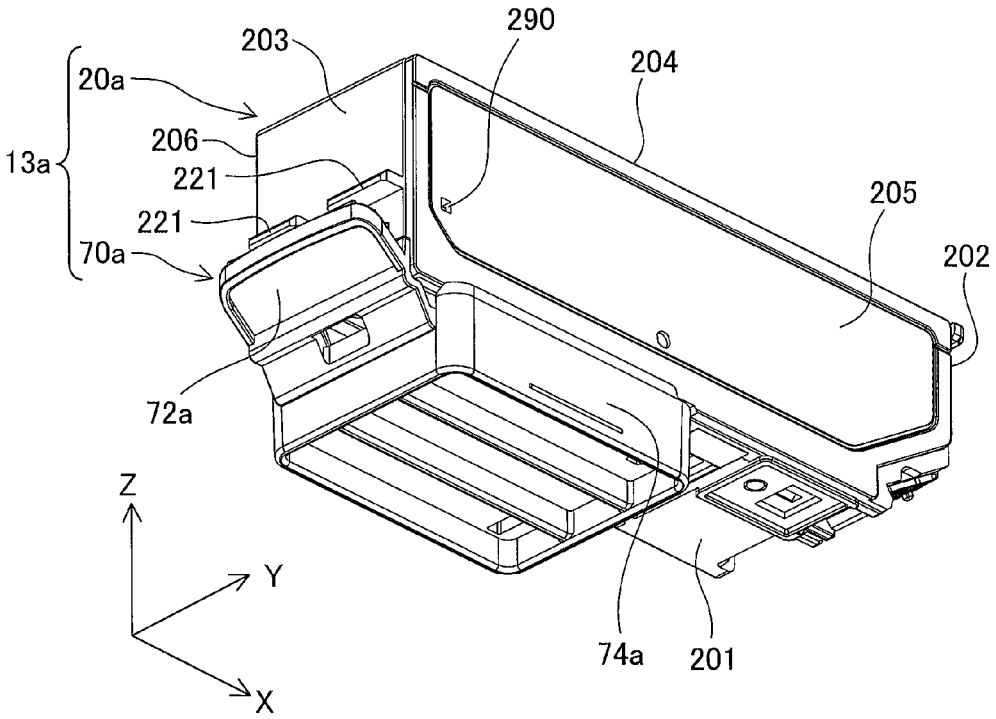
FIG. 24 is a perspective view illustrating a cartridge according to the third embodiment.

FIG. 23 is a perspective view illustrating a cartridge main body 20*a* according to a third embodiment. FIG. 24 is a perspective view illustrating a cartridge 13*a* according to the third embodiment. The cartridge main body 20*a* of the third embodiment has the greater dimension in the Y-axis direction than that of the cartridge 20 (corresponding to the cartridge main body) of the first embodiment. The cartridge main body 20*a* is attached to the holder 60 by using two slots of the holder 60 (FIG. 2). The cartridge main body 20*a* is configured to contain a greater amount of ink than the cartridge 20 of the first embodiment.

As shown in FIG. 23, the cartridge main body 20*a* has two fluid supply ports 280*a* protruded from the first surface 201. The two fluid supply ports 280*a* respectively have substantially the same structure as that of the fluid supply port 280 of the first embodiment. The cartridge 20*a* of the third embodiment is accordingly structured to supply ink as the separate ink flows from the two fluid supply ports 280*a* to the printer 50.

As shown in FIG. 24, the cartridge 13*a* has one single cap 70*a* provided to close the two openings 288. The cap 70*a* includes a cap main body 74 and a cap lever 72*a*, like the cartridge 13 of the second embodiment. The cap lever 72*a* is protruded outside of the third surface 203, like the second embodiment.

Figure 25:
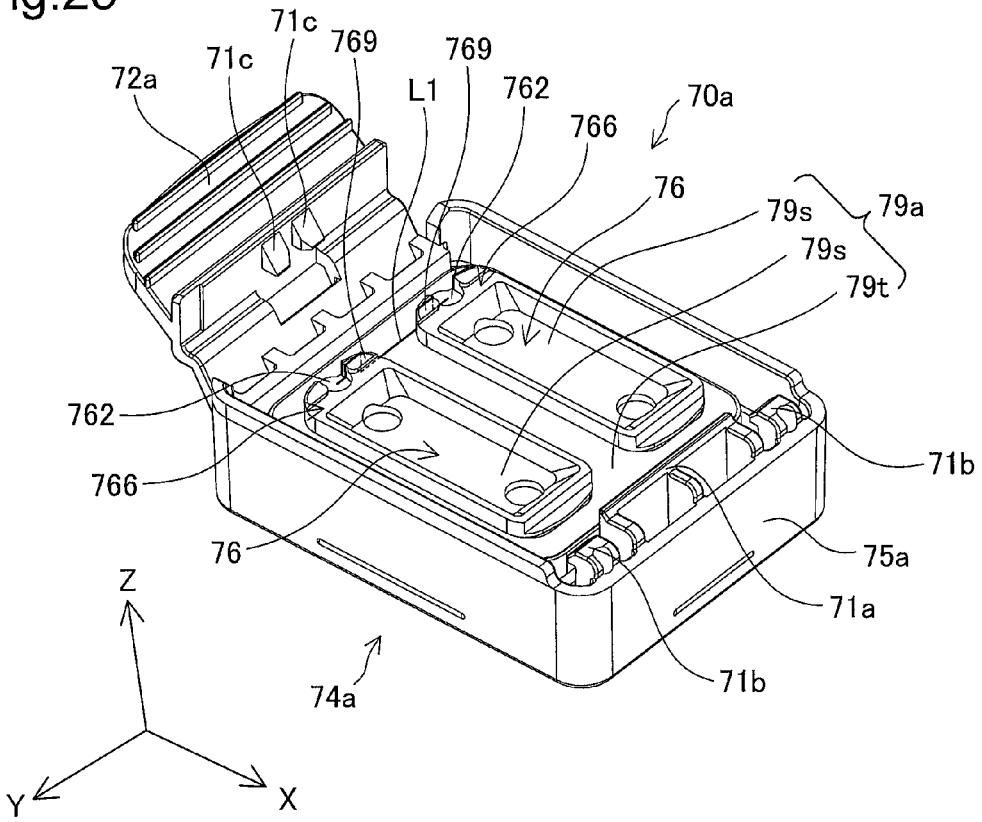
FIG. 25 is a first perspective view of a cap.
Figure 26A:
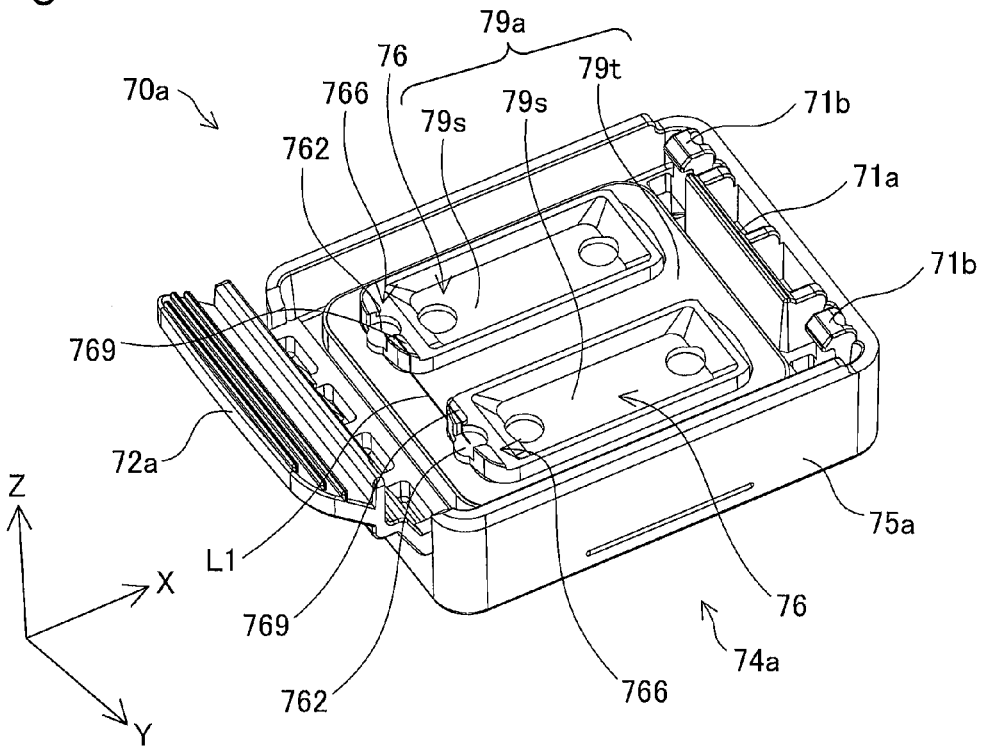
FIG. 26A is a second perspective view of the cap.

FIG. 25 is a first perspective view of the cap 70*a*. FIG. 26A is a second perspective view of the cap 70*a*. The cap 70*a* of the third embodiment has a base member 75*a* in a recessed shape, and a first cap member 79*a* placed in the recess of the base member 75*a* to close the opening 288. The first cap member 79*a* is an elastic member made of, for example, rubber, like the second embodiment. The difference from the first cap member 79 of the second embodiment is that two first positioning members 79*s* are provided on a second positioning member 79*t* corresponding to the two fluid supply ports 280*a*. Each of the first positioning members 79*s* has the similar structure to that of the second embodiment described above and includes the sealing portion 762, the cap stepped member 766 and the receiver member 76.

A stepped member 769 is provided as a first stepped member in the middle of a line L1 (shortest line L1) connecting the two sealing portions 762 along the surface of the cap 70*a*. The stepped member 769 is formed by providing the first positioning member 79*s* including the sealing portion 762 for each of the fluid supply ports 280*a* and placing the two first positioning members 79*s* on the same plane (i.e., on the surface of the second positioning member 79*t*).

C-2. Advantageous Effects

According to the structure of this embodiment, the presence of the stepped member 769 effectively prevents ink reaching one sealing portion 762 from reaching the other sealing portion 762. The other structure of the third embodiment is similar to the corresponding structures of the first and the second embodiments and has the similar advantageous effects to those of the first and the second embodiments described above.

D. Fourth Embodiment

D-1. Structure of Cartridge Main Body 20 and Cap 70*b*

Figure 26B:
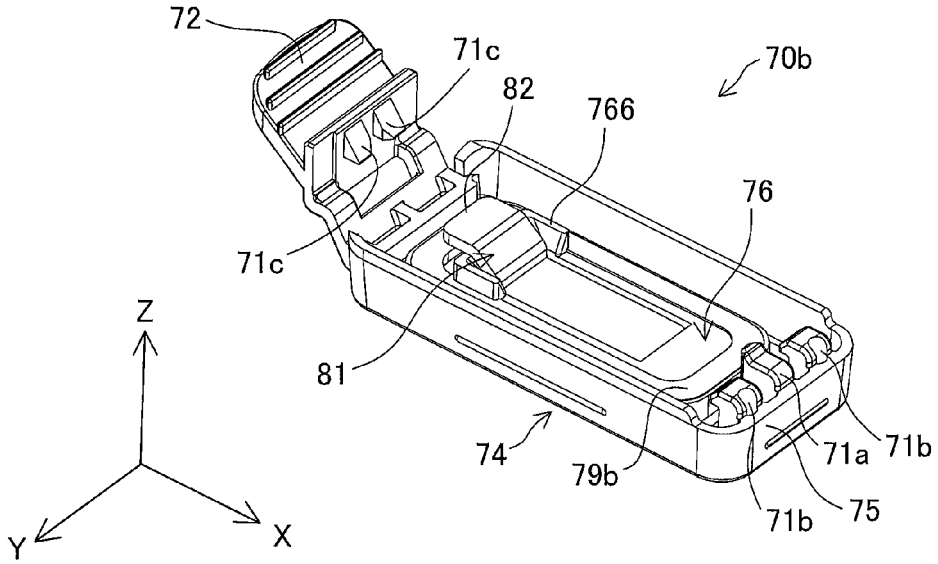
FIG. 26B is a first perspective view illustrating a cap according to a fourth embodiment.
Figure 26C:
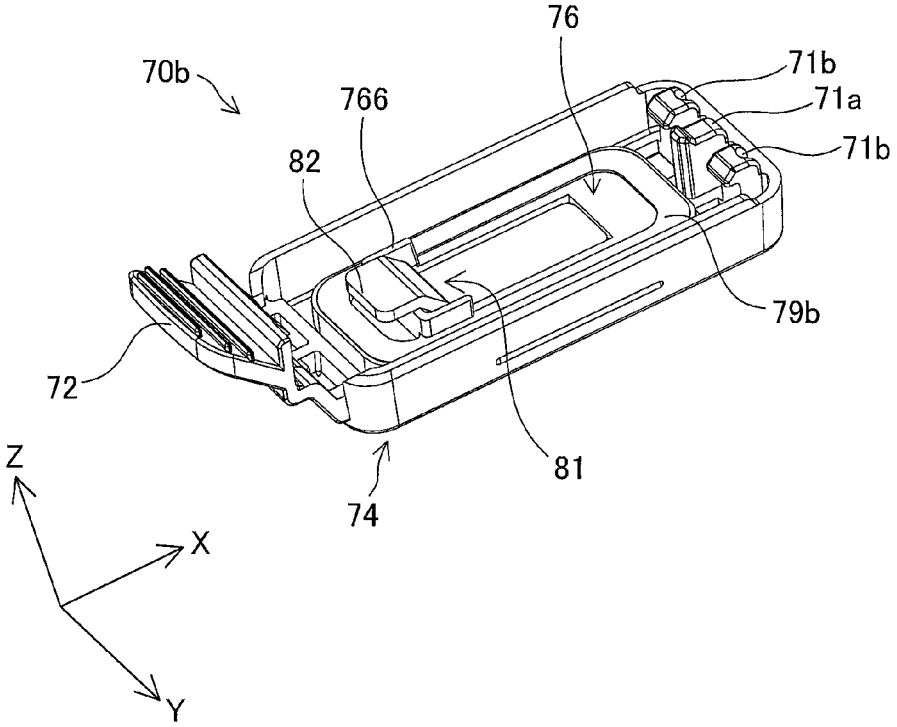
FIG. 26C is a second perspective view illustrating the cap according to the fourth embodiment.
Figure 26D:
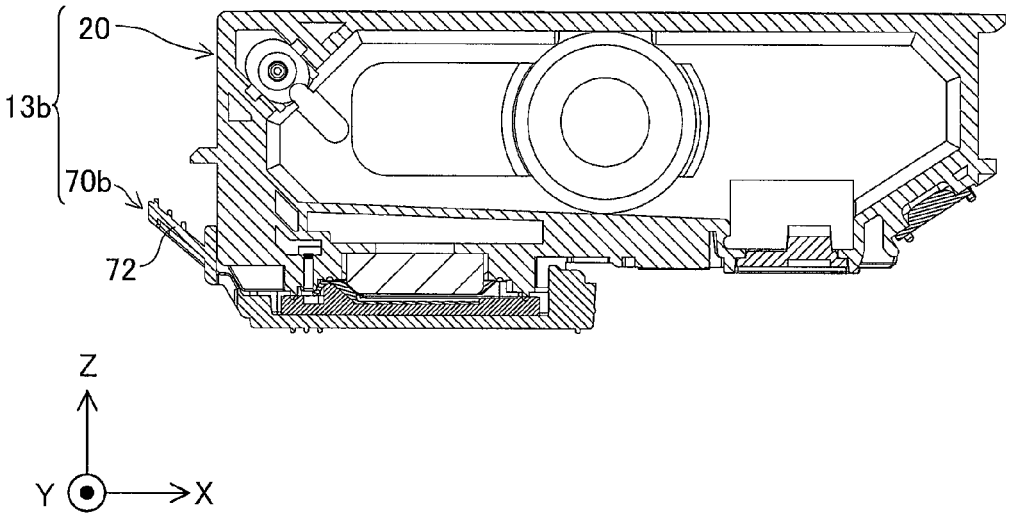
FIG. 26D is a cross sectional view of a cartridge main body with the cap 70*b* attached thereto.
Figure 26E:
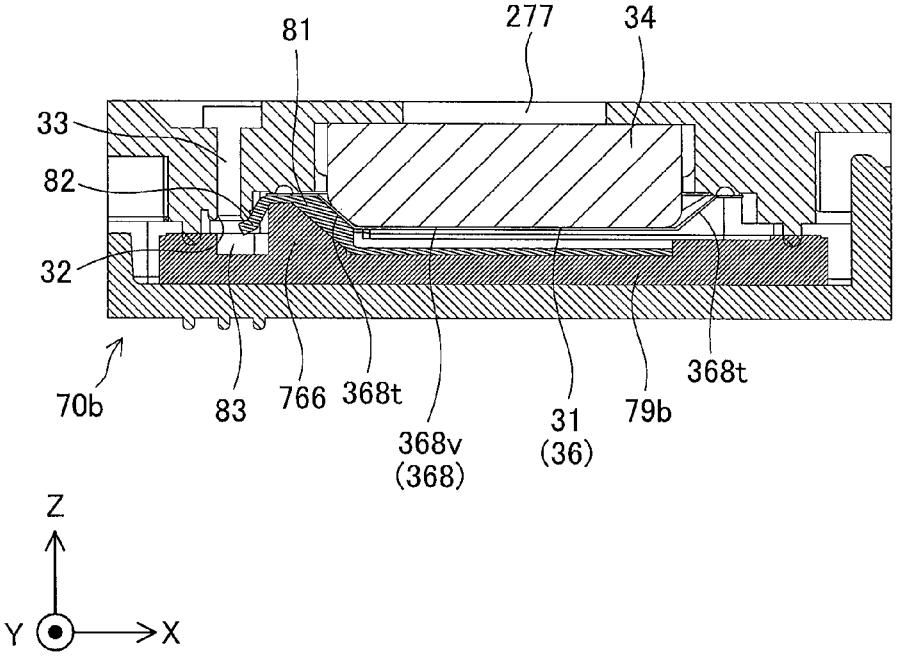
FIG. 26E is an enlarged view of part of FIG. 26D.

FIGS. 26B and 26C are perspective views illustrating a cap 70*b* according to a fourth embodiment. FIG. 26D is a cross sectional view of the cartridge main body 20 with the cap 70*b* attached thereto. FIG. 26E is an enlarged view of part of FIG. 26D. FIG. 26E is comparable to FIG. 16 of the first embodiment.

As shown in FIG. 26D, a cartridge 13*b* of the fourth embodiment includes a cartridge main body 20 and the cap 70*b*, like the cartridge 13 of the second embodiment (FIG. 19). The cartridge main body 20 of the fourth embodiment has the similar structure to that of the cartridge 20 of the first embodiment. The external structure defining the appearance of the cap 70*b* (appearance configuration) of the fourth embodiment is similar to the structure of the cap 70 of the second embodiment (FIGS. 19 to 21). As shown in FIG. 26B, the cap 70*b* has the pair of first projections 71*b*, the insertion piece 71*a* and the pair of second projections 71*c*, like the cap 70 of the second embodiment. The cap 70*b* of the fourth embodiment differs from the cap 70 of the second embodiment mainly by integral formation of a first cap member 79*b*, omission of the sealing portion 762 and addition of a fluid absorbent material 81. The like components to those of the cap 70 of the second embodiment are expressed by the like numerals and symbols and are not specifically described here. Integral formation of the first cap member 79*b* is not essential.

As shown in FIG. 26B, the fluid absorbent material 81 is ink absorbing material placed on the receiver member 76 and the cap stepped member 766. As shown in FIG. 26E, the fluid absorbent material 81 is placed at the position opposed to the fluid exit 31 (sheet member 36). The fluid absorbent material 81 prevents ink leaked through the fluid exit 31 from flowing out to the other part. The fluid absorbent material 81 may be any material serving to retain ink. The material serving to retain ink may be, for example, porous body, such as BELLEATER (manufactured by AION Co., Ltd).

As shown in FIGS. 26B and 26C, the fluid absorbent material 81 is placed over the receiver member 76 and the cap stepped member 766 and is further extended outside of the receiver member 76. More specifically, the fluid absorbent material 81 has one end 82 extended from the cap stepped member 766 toward the connection port 32. The fluid absorbent material 81 is in a sheet shape. The fluid absorbent material 81, in cooperation with the receiver member 76 and the cap stepped member 766, receives the fluid exit 31 (sheet member 36) in the attached state that the cap 70*b* is attached to the cartridge main body 20. In other words, at least part of the wall surface of the receiver member 76 is formed by the fluid absorbent material 81.

As shown in FIG. 26E, according to this embodiment, in the attached state, part of the fluid absorbent material 81 located on the receiver member 76 (hereinafter called "opposed part") is placed not in contact with but away from the first center portion 368*v* of the fluid exit 31 (sheet member 36). In the attached state, the opposed part of the fluid absorbent material 81 and the fluid exit 31 (sheet member 36) are arranged to be opposed to each other in the Z-axis direction. In other words, in the attached state, the opposed part of the fluid absorbent material 81 and the fluid exit 31 (sheet member 36) have the positional relationship to overlap each other in projection to the plane parallel to the Z-axis direction (XY plane).

As shown in FIG. 26E, in the attached state, part of the fluid absorbent material 81 placed on the cap stepped member 766 (hereinafter called "absorbent stepped part") is placed in contact with the inclined portion 368*t* located on the connection port 32-side among the four inclined portions 368*t* of the fluid exit 31 (sheet member 36). In other words, the fluid absorbent material 81 is arranged to be interposed between the cap stepped member 766 and the inclined portion 368*t* of the fluid exit 31.

As shown in FIG. 26E, at least part of the fluid absorbent material 81 is opposed to the connection port 32 in the Z-axis direction. In other words, in the attached state, the fluid absorbent material 81 and the connection port 32 have the positional relationship to overlap each other in projection to the plane parallel to the Z-axis direction (XY plane). The fluid absorbent material 81 (more specifically, its end 82) is placed not in contact with but away from the connection port 32.

D-2. Advantageous Effects

As described above, the cartridge 13*b* of the fourth embodiment includes the cap 70*b* with the fluid absorbent material 81 (FIG. 26D). Even when ink is leaked through the fluid exit 31 (sheet member 36) during, for example, transportation of the cartridge 13*b*, the fluid absorbent material 81 effectively serves to absorb leaked ink. As a result, this reduces the likelihood that ink is leaked outside when the cap 80 is removed from the cartridge 13*b* for use of the cartridge main body 20. This accordingly reduces the possibility that the user's finger is stained with ink.

In the attached state, the fluid absorbent material 81 is placed not in contact with but away from the first center portion 368*v* of the sheet member 36 and is arranged to be at least partly opposed to the first center portion 368*v* in the Z-axis direction. This arrangement enables ink leaked out of the first center portion 368*v* to be absorbed without damaging the first center portion 368*v*, which serves to flow ink to the printer.

In the attached state, part of the fluid absorbent material 81 located on the cap stepped member 766 (absorbent stepped part) is placed in contact with the inclined portion 368*t* located on the connection port 32-side (connection port-side inclined portion 368*t*) among the four inclined portions 368*t* of the fluid exit 31 (sheet member 36) (FIG. 26E). Ink absorbed by the fluid absorbent material 81 can thus move to the fluid exit 31 via the connection port-side inclined portion 368*t*. This enables ink absorbed by the fluid absorbent material 81 to be returned to the fluid exit 31 (sheet member 36). As a result, this reduces the likelihood that ink is leaked outside when the cap 80 is removed from the cartridge 13*b* for use of the cartridge main body 20. This accordingly reduces the possibility that the user's finger is stained with ink. This also reduces the amount of unusable ink. Additionally, the fluid absorbent material 81 is arranged to be interposed between the cap stepped member 766 and the inclined portion 368*t* of the fluid exit 31 (FIG. 26E). This narrows the flow path of ink from the fluid exit 31 to the connection port 32 and thereby reduces the potential for ink flow into the connection port 32.

In the attached state, the fluid absorbent material 81 and the connection port 32 have the positional relationship to at least partly overlap each other in projection to the plane parallel to the Z-axis direction (XY plane) (FIG. 26E). This arrangement accordingly reduces the likelihood that ink flows into the connection port 32 even when ink flows in a cavity 83 formed by the connection port 32 and the cap 70*b* (FIG. 26E). The fluid absorbent material 81 has the part placed not in contact with but away from the connection port 32. This reduces the possibility that ink retained in the fluid absorbent material 81 directly flows into the connection port 32.

D-3. Modifications of Fourth Embodiment

The fourth embodiment described above adopts the fluid absorbent material 81 as the member having the function of retaining (absorbing) ink (FIG. 26B). Alternatively, the receiver member 76 may be configured to have the function (structure) of retaining (absorbing) ink. One example of such structure of retaining ink may be a concavo-convex shape including grooves formed on the surface of the receiver member 76. Such concavo-convex shape creates capillarity to allow ink to be retained in the receiver member 76.

The fluid absorbent material 81 is placed over the receiver member 76 and the cap stepped member 766 in the fourth embodiment described above, but may be placed only on the receiver member 76 or only on the cap stepped member 766. Such modified configuration still allows absorption of ink leaked through the fluid exit 31. In such modification, it is preferable to place the fluid absorbent material 81 at least partly over the area from the part of the cap 70*b* opposed to the fluid exit 31 to the part of the cap 70*b* opposed to the connection port 32 in the inner surface of the cap 70*b*. This modified arrangement also reduces the possibility that ink leaked through the fluid exit 31 flows into the connection port 32.

In the attached state, the part of the fluid absorbent material 81 (opposed part) located on the receiver member 76 is placed not in contact with but away from the first center portion 368*v* of the fluid exit 31 (sheet member 36) according to the above fourth embodiment, but may alternatively be placed in contact with the first center portion 368*v*. The contact arrangement of these two elements 81 and 368*v* enables the fluid absorbent material 81 to more effectively absorb ink.

According to the fourth embodiment described above, in the attached state, the part of the fluid absorbent material 81 (absorbent stepped part) placed on the cap stepped member 766 is placed in contact with the inclined portion 368*t* located on the connection port 32-side among the four inclined portions 368*t* of the fluid exit 31 (sheet member 36). The absorbent stepped part should, however, be in contact with at least one inclined portion 368*t* among the four inclined portions 368*t* and may thus be in contact with a plurality of the inclined portions 368*t*. The contact arrangement of these two elements 81 and 368*t* is not essential. In this latter case, narrowing the gap between the cap stepped member 766 and the inclined portion 368*t* of the fluid exit 31 reduces the potential for ink flow to the outside. Additionally, the fluid absorbent material 81 is arranged to be interposed between the cap stepped member 766 and the inclined portion 368*t* of the fluid exit 31. Alternatively, however, the fluid absorbent material 81 may be arranged to be interposed between the cap stepped member 766 and the mounting portion 362 (FIG. 18). In the latter arrangement, narrowing the gap between the cap stepped member 766 and the inclined portion 368*t* of the fluid exit 31 reduces the potential for ink flow to the outside.

In the attached state, the fluid absorbent material 81 is arranged to at least partly overlap the connection port 32 in projection to the XY plane according to the above fourth embodiment, but alternatively may be arranged to have no overlap. The requirement is that part of the fluid absorbent material 81 is present in the cavity 83 connecting to the connection port 32. This modified arrangement also reduces the amount of ink flowing to the connection port 32.

In the attached state, the fluid absorbent material 81 is arranged, such that one end 82 of the fluid absorbent material 81 is not in contact with the connection port 32 according to the above fourth embodiment, but may be arranged such that one end 82 is in contact with the connection port 32. The contact arrangement of these elements 82 and 32 enables ink to be absorbed by the fluid absorbent material 81 before the ink leaked into the cavity 83 connecting to the connection port 32 flows into the connection port 32.

Figure 26F:
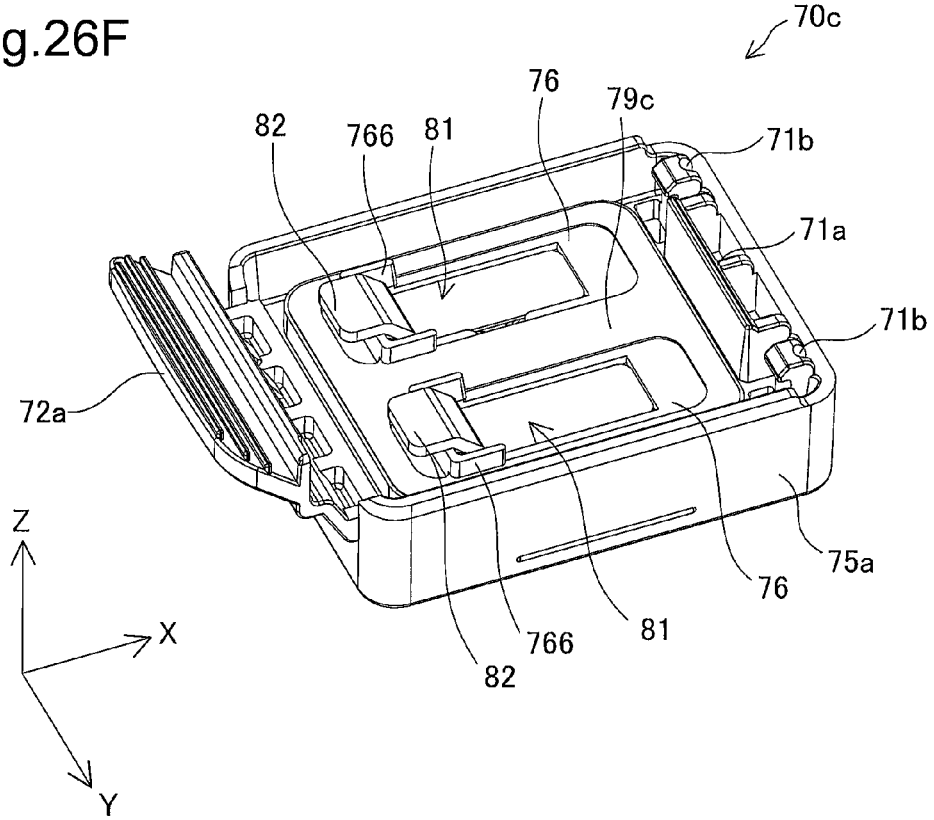
FIG. 26F is a first perspective view of a cap according to one modification.
Figure 26G:
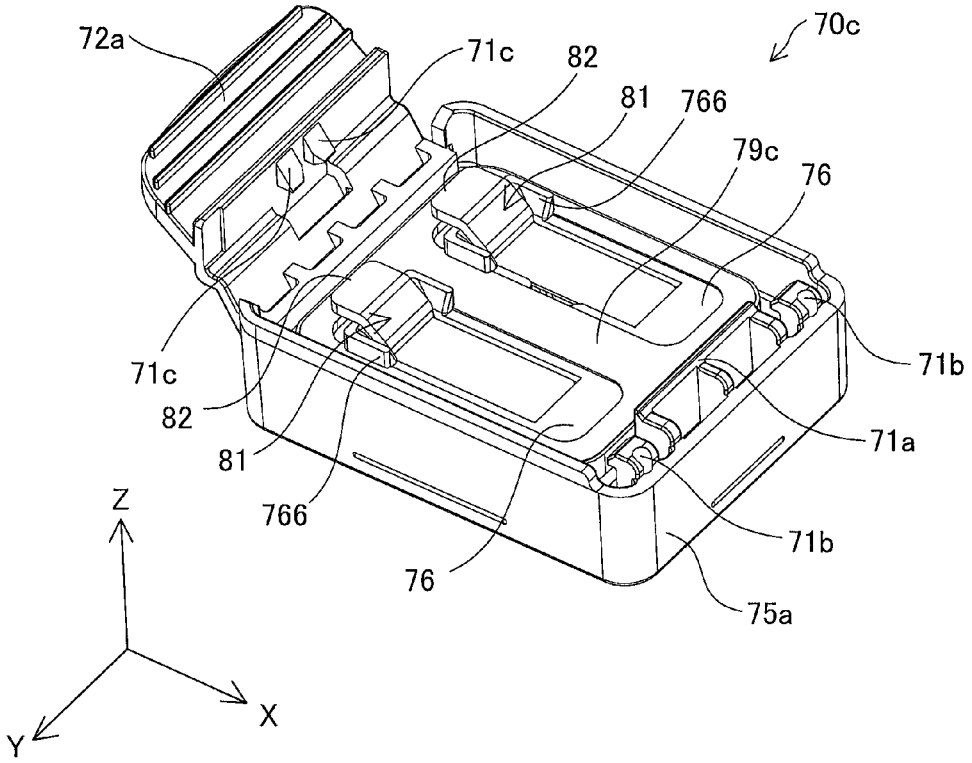
FIG. 26G is a second perspective view of the cap of the modification.

The cap 70 of the fourth embodiment may be modified to be adoptable to the cartridge main body having a plurality of fluid supply ports 280. FIG. 26F is a first perspective view of a cap 70*c* according to one modification. FIG. 26G is a second perspective view of the cap 70*c* of the modification. The cap 70*c* as the modification of the cap 70*b* of the above fourth embodiment is attachable to the cartridge main body 20*a* of the third embodiment (FIG. 23). The cap 70*c* has a first cap member 79*c* that is wider in the Y-axis direction than the first cap member 79 *b* of the fourth embodiment. The first cap member 79*c* has two receiver member 76, two cap stepped members 766 and two fluid absorbent materials 81 corresponding to the two fluid supply ports 280*a* of the cartridge main body 20*a* (FIG. 23). The like components to those of the cap 70*a* of the third embodiment (FIG. 25) are expressed by the like numerals and symbols and are not specifically described here. The similar structure of the cap 70*c* of the modification to that of the cap 70*b* of the fourth embodiment has the similar advantageous effects.

E. Fifth Embodiment

E-1. Recycle Method of Cartridge

A fifth embodiment describes a recycle method of any of the above cartridges 13, 13*a*, 13*b*, 20 and 20*a*.

When ink is consumed and used up in any of the cartridges 13, 13*a*, 13*b*, 20 and 20*a*, the method cleans the inside of the cartridge 13, 13*a*, 13*b*, 20 or 20*a* and refills ink into the cartridge 13, 13*a*, 13*b*, 20 or 20*a* to be reused. The fifth embodiment describes the recycle method to allow reuse of any of the cartridges 13, 13*a*, 13*b*, 20 and 20*a* described above.

In the attached state of the cartridge 13, 13*a*, 13*b*, 20 or 20*a* to the printer 50, the sheet member (film member) 36 of the fluid exit 31 is in contact with the fluid supply tube 640 arranged to make the flow of ink to the head 54.

In the state that the sheet member 36 is in contact with the fluid supply tube 640, the sheet member 36 receives stress from the fluid supply tube 640. This stress may damage the sheet member 36. More specifically, the damage of the sheet member 36 may be, for example, tear or deformation. The user's repeated attachment and detachment of the cartridge 13, 13*a*, 13*b*, 20 or 20*a* to the holder 60 may cause significant damage. Ink refill into the cartridge 13, 13*a*, 13*b*, 20 or 20*a* with the sheet member 36 damaged by, for example, tear or deformation may cause the following troubles. For example, ink may be leaked from the torn part of the sheet member 36. In another example, air bubbles may invade through the deformed part of the sheet member 36 into the head 54 to cause failed ejection from the head 54.

One possible method replaces the sheet member 46 for recycle of the used cartridge 13, 13*a*, 13*b*, 20 or 20*a*.

The sheet member 36 is, however, attached to the supplier main body 285 by, for example, welding and is thus difficult to replace.

The fifth embodiment accordingly describes the method of recycling the used cartridge 13, 13*a*, 13*b*, 20 or 20*a* without replacement of the sheet member 36.

Figure 26H:
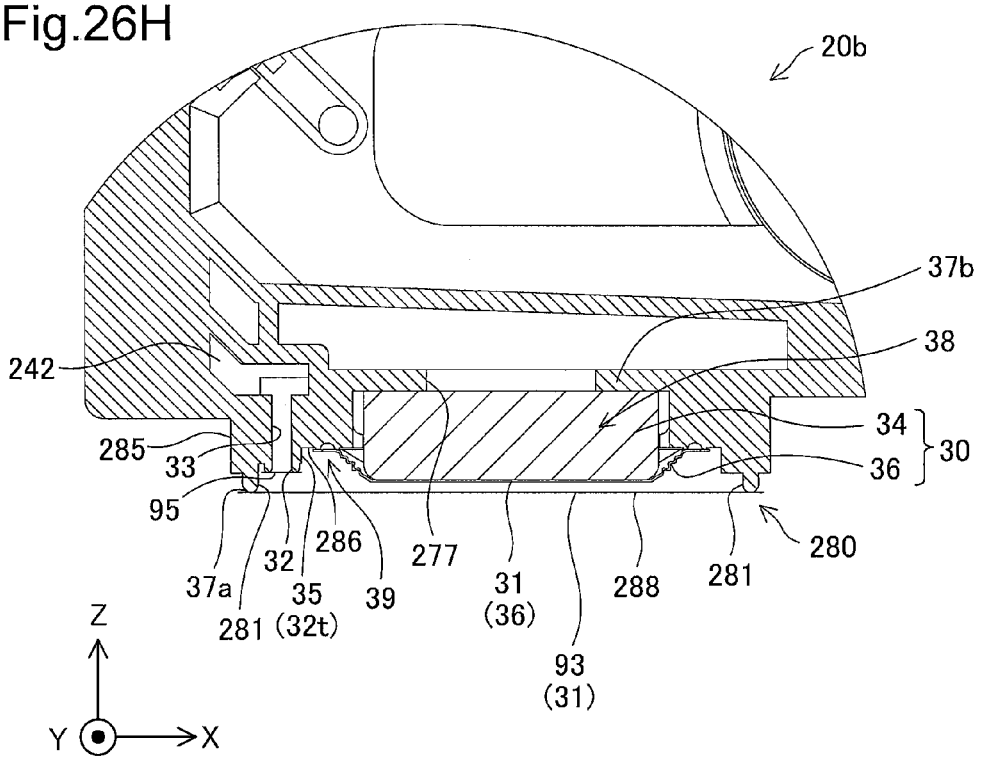
FIG. 26H is an enlarged view illustrating the neighborhood of the fluid supply port according to the fifth embodiment.

FIG. 26H is an enlarged view illustrating the neighborhood of the fluid supply port 280 of a cartridge 20*b* according to the fifth embodiment (recycled cartridge 20*b*). The structure of the cartridge 20*b* is identical with the structure of the cartridge 13, 13*a*, 13*b*, 20 or 20*a* described above, except the structure of the fluid supply port 280. The cartridge 20*b* recycled as described below is called recycled cartridge 20*b*.

As shown in FIG. 26H, the fluid supply port 280 of the fifth embodiment has the opening 288 that is covered with a sheet member (film member) 93 with the sheet member 36 left. More specifically, the sheet member 93 is attached air-tight by, for example, welding to cover the opening 288 without making a gap on the other end 37*a*. The primary difference from sheet members 92 and 94 of FIG. 27 described later is that the sheet members 92 and 94 are made of a liquid impermeable material, while the sheet member 93 of the fifth embodiment is made of a liquid permeable material. Arranging the sheet member 93 such that at least part of the sheet member 93 is in contact with the fluid supply tube 640 enables ink to be supplied to the head 54. The sheet member 93 may be attached to the other end 37*a* to cover the opening 288 in the state that at least part of the sheet member 93 is in contact with the sheet member 36. This arrangement enables ink to move from the sheet member 36 to the sheet member 93 and allows smooth supply of ink through the sheet member 93 to the printer 50. The sheet member 93 has flexibility and may be pressed in by the fluid supply tube 640 to come into contact with the sheet member 31 in the attached state of the cartridge 20*b*. The connection port 32 is closed by a sheet member 95 in the illustrated example of FIG. 26H, but this is not essential. In the illustrated application, the sheet member 95 may be made of the same material as the sheet member 93 or may be made of the same material as the sheet members 92 and 94 illustrated in FIG. 27. The sheet member 93 provided to cover the opening 288 is preferably arranged to form a meniscus of the fluid (ink). This reduces the potential for ink leakage from the sheet member 93 to outside in the non-attached state of the cartridge 20*b* to the printer 50. In the recycled cartridge 20*b*, the sheet member 93 serves as the fluid exit 31 to allow ink flow to the outside (fluid supply tube 640).

E-2. Advantageous Effects

Even when the sheet member (film member) 36 serving as the fluid exit 31 before recycle of the cartridge 13, 13*a*, 13*b*, 20 or 20 is torn, deformed or otherwise damaged during use, the method of this embodiment newly provides the fluid exit 31 without replacing the sheet member 36 of the used cartridge 13, 13*a*, 13*b*, 20 or 20. This facilitates recycle of the cartridge 20*b*.

F. Sixth Embodiment

F-1. Recycle Method of Cartridge

A sixth method describes a method of recycling a used cartridge and a recycled cartridge obtained by recycling a used cartridge.

Figure 26I:
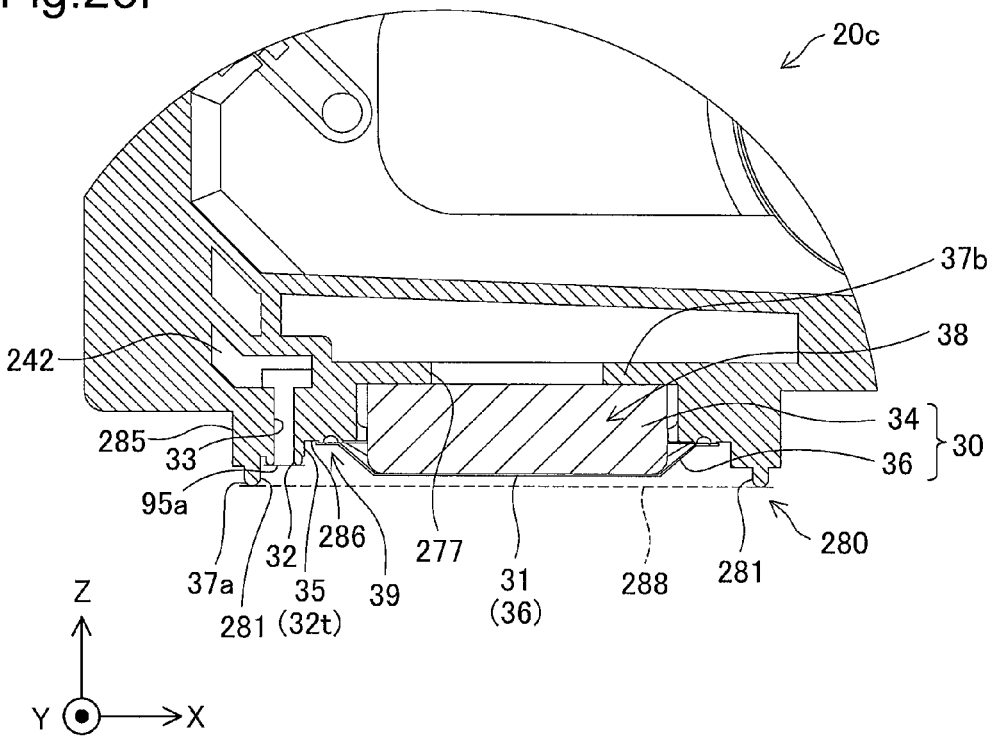
FIG. 26I is a diagram illustrating a recycled cartridge.

FIG. 26I is a diagram illustrating a recycled cartridge 20*c*. FIG. 26I is a diagram comparable to FIG. 16. The recycled cartridge 20*c* of the sixth embodiment differs from the cartridge 20 of the first embodiment (FIG. 16) by the following feature. While the cartridge 20 of the first embodiment has the connection port 32, the recycled cartridge 20*c* has the connection port 32 sealed or covered with a member, such as sheet member 95*a*. The other structure is similar to that of the first embodiment, and the like components are expressed by the like numerals and symbols and are not specifically described here. The sheet member 95*a* is made of a liquid impermeable material.

As described previously, the connection port 32 also serves to prevent leakage of ink caused by the expected pressure imbalance when the cartridge 20 is stored in a vacuum pack.

With the recent trend of environmental consciousness, the method of refilling ink in the used and collected cartridge for recycle and the recycled cartridge have been provided.

In some cases, the recycled cartridge may be marketed without packaging, for environmental consciousness. In other cases, the cartridge may be marketed with packaging but not in a vacuum package, for cost reduction or because of the sufficient degree of deaeration. Such recycled cartridges are unlikely to have leakage of ink caused by the pressure imbalance described above. The connection port 32 accordingly does not serve to prevent leakage of ink caused by the pressure imbalance. The connection port 32 communicates with the air intake port 290, so that there is a possibility that ink entering the connection port 32 is leaked through the air intake port 290.

In the recycled cartridge 20*c* provided by refilling the used cartridge 20, sealing or covering the connection port 32 is preferable. In other words, it is preferable to block the fluid flow passage between the outside and the inside of the fluid supply port 280 (more specifically, the second flow path 39) via the connection port 32. The fluid herein means at least liquid.

Any of various methods described below may be adopted to seal or cover the connection port 32. For example, one available method may use the sheet member 95*a* to seal the connection port 32 as shown in FIG. 26I. Another available method may fill the passage 33 including the connection port 32 with resin or the like. Yet another available method may weld the connection port 32 with resin or the like to close the connection port 32. Yet another available method may weld a member of defining and forming the connection port 32 (i.e., periphery of the connection port 32, connection port-forming member 32*t*) to close the connection port 32. In the recycled cartridge 20*c*, as long as the requirement of sealing or covering the connection port 32 formed in the cartridge 20 or closing the passage 33 is satisfied, any of various methods, e.g., sealing method, covering method or closing method, may be adopted to block the fluid flow passage.

It is desirable that the resin used for sealing or covering the connection port 32 or the sealed or covered connection port 32 is not protruded outside (opening 288-side) of the sheet member 36. In other words, in the recycled cartridge 20*c*, when the member used for blocking the fluid flow passage or the connection port 32 itself is protruded outside (opening 288-side) of the sheet member 36, the protruded part may come into contact with another member, for example, the cap 70, 70*a*, 70*b* or 70*c*, the fluid supply tube 640 or the elastic member 648 and may damage the another member.

F-2. Advantageous Effects

This embodiment blocks the fluid flow passage in the course of recycling the used cartridge 20 with the connection port 32, so as to prevent leakage of ink through the air intake port 290 to the outside during, for example, storage of the recycled cartridge 20*c*.

The resin or another member used for sealing or covering the connection port 32 or the connection port 32 sealed or covered with such member is arranged to be not protruded outside (opening 288-side) of the sheet member 36. This prevents the protruded part from coming into contact with another member, for example, the cap 70, 70*a*, 70*b* or 70*c*, the fluid supply tube 640 or the elastic member 648 and thereby damaging the another member.

F-3. Modifications of Sixth Embodiment

The sixth embodiment blocks the fluid flow passage by sealing or covering the connection port 32 with the resin or another member in the course of recycling the used cartridge 20. According to one modification, the resin or another member used for blocking the fluid flow passage (i.e., blocking member) may be structured to be removable by the user in use. Sealing or covering the connection port 32 before use effectively prevents leakage of ink from the air intake port 290 connecting with the connection port 32 during storage of the recycled cartridge 20*c*. Removing the blocking member at the time of use causes the inside and the outside of the fluid supply port 280 to communicate with each other via the connection port 32. This advantageously prevents leakage of ink due to the possible pressure imbalance when the recycled cartridge 20*c* attached to the holder 60 is detached from the holder 60.

G. Seventh Embodiment

G-1. Recycle Method of Cap 70*b* or 70*c*

Figure 26J:
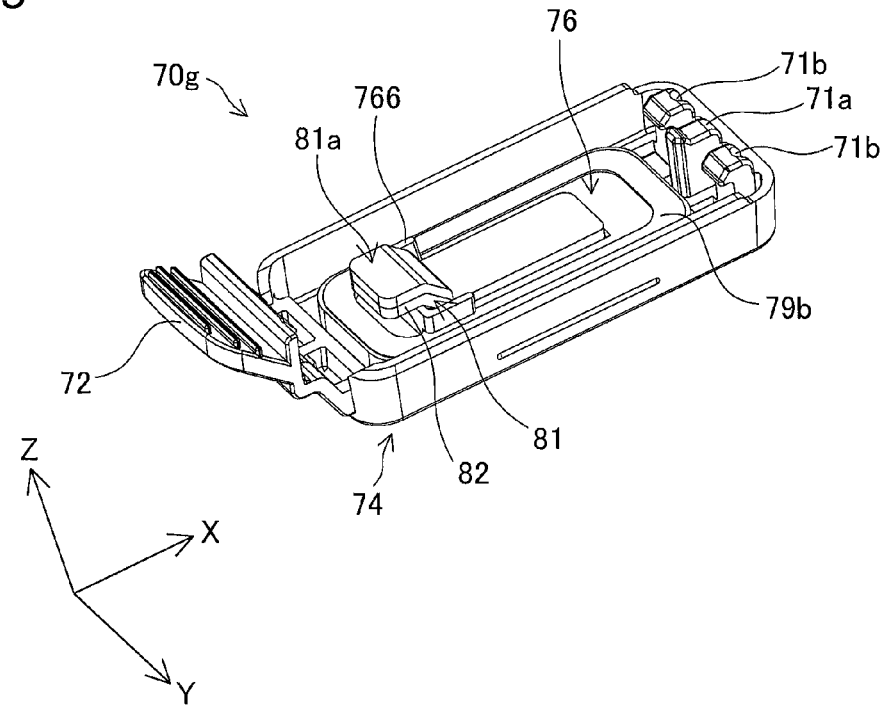
FIG. 26J is a perspective view illustrating a recycled cap.

A seventh embodiment describes a method of recycling the cap 70*b* or 70*c*. FIG. 26J is a perspective view illustrating a recycled cap 70*g*.

The cap 70*b* or 70*c* used as one component member of the cartridge 20 may be reused after cleaning. The seventh embodiment describes the recycle method to allow reuse of the cap 70*b* or 70*c* described above. The cap recycled as described below is called recycled cap 70*g*.

The fluid absorbent material 81 is placed in the cap 70*b* or 70*c* before recycle (FIGS. 26B and 26F). This fluid absorbent material 81 serves to retain fluid leaked out of the fluid exit 31.

Fluid (ink) corresponding to the color of the cartridge 13, 13*a*, 13*b*, 20 or 20*a* to which the cap is attached is thus retained in the fluid absorbent material 81. More specifically, black fluid (ink) is retained in the fluid absorbent material 81 of the cap 70*b* or 70*c* attached to the cartridge of containing black ink; yellow fluid (ink) is retained in the fluid absorbent material 81 of the cap 70*b* or 70*c* attached to the cartridge of containing yellow ink; magenta fluid (ink) is retained in the fluid absorbent material 81 of the cap 70*b* or 70*c* attached to the cartridge of containing magenta ink; light magenta fluid (ink) is retained in the fluid absorbent material 81 of the cap 70*b* or 70*c* attached to the cartridge of containing light magenta ink; cyan fluid (ink) is retained in the fluid absorbent material 81 of the cap 70*b* or 70*c* attached to the cartridge of containing cyan ink; and light cyan fluid (ink) is retained in the fluid absorbent material 81 of the cap 70*b* or 70*c* attached to the cartridge of containing light cyan ink.

The fluid absorbent material 81 may be cleaned for removal of the fluid retained in the fluid absorbent material 81 in the course of recycling the cap 70*b* or 70*c*. The cap 70*b* or 70*c* after cleaning of the fluid absorbent material 81 is called recycled cap 70*b* or 70*c*.

It may be, however, difficult to completely remove the fluid from the fluid absorbent material 81 by cleaning with time elapsed since contact and retention of the fluid in the fluid absorbent material 81. Such incomplete removal may cause the recycled cap 70*b* or 70*c* with some remaining ink to be attached to the cartridge 13, 13*a*, 13*b*, 20 or 20*a* containing a different color ink. For example, the recycled cap 70*b* or 70*c* with the fluid absorbent material 81 retaining black ink may be attached to the cartridge 13, 13*a*, 13*b*, 20 or 20*a* containing light cyan ink. In this case, the fluid absorbent material 81 of the recycled cap 70*b* or 70*c* retaining black ink may come into contact with the sheet member 36 of the cartridge 13, 13*a*, 13*b*, 20 or 20*a* containing light cyan ink to cause color mixing of light cyan and black. Such color mixing may cause a trouble in color reproduction using the fluid ejection system 10 (FIG. 1). Additionally, reattachment of the recycled cap 70*b* or 70*c*, which has once been removed from the cartridge 13, 13*a*, 13*b*, 20 or 20*a*, to the cartridge 13, 13*a*, 13*b*, 20 or 20*a* may cause the user's confusion.

The seventh embodiment accordingly describes the recycled cap 70*g* configured to prevent such color mixing and the user's confusion.

As shown in FIG. 26J, the recycled cap 70*g* of the seventh embodiment has another fluid absorbent material 81*a* additionally placed over the fluid absorbent material 81 described in the fourth embodiment. More specifically, after collection of the used cap 70*b* or 70*c*, the cap 70*b* or 70*c* with the fluid absorbent material 81 is subjected to a specified series of processing including cleaning. The used cap 70*b* or 70*c* is subjected to the specified series of processing without removal of the fluid absorbent material 81 from the cap 70*b* or 70*c*, because it is likely to detach the part of the cap 70*b* or 70*c* where the fluid absorbent material 81 is placed and create dust during removal of the fluid absorbent material 81 from the cap 70*b* or 70*c*. After the specified series of processing, the fluid absorbent material 81*a* is further placed above the fluid absorbent material 81. The fluid absorbent material 81*a* has the same structure as that of the fluid absorbent material 81.

The color of the fluid absorbent material 81*a* may be black or the color (other than white) of ink unused in the printer 50, to which the cartridge 13, 13*a*, 13*bg*, 20 or 20*a* with the recycled cap 70*g* including the fluid absorbent material 81*a* is attached.

G-2. Advantageous Effects

The seventh embodiment described above provides the recycled cap 70*g* that reduces the potential for color mixing and the user's confusion without removal of the fluid absorbent material 81 included in the cap 70*b* or 70*c* before recycle.

More specifically, even when some fluid remains in the fluid absorbent material 81 of the cap 70*b* or 70*c* before recycle, the fluid absorbent material 81*a* is additionally placed over the fluid absorbent material 81 in the course of recycling. This effectively prevents color shift or degradation of color reproduction caused by color mixing in printing on the printing medium 90 using the fluid ejection system 10.

The color of the fluid absorbent material 81*a* is preferably black or the color (other than white) of ink unused in the printer 50, to which the cartridge 13, 13*a*, 13*bg*, 20 or 20*a* with the recycled cap 70*g* including the fluid absorbent material 81*a* is attached, because of the following reason. Even when ink remaining in the fluid absorbent material 81 is mixed with ink contained in the sheet member 36, the cap 70*g* has the new fluid absorbent material 81*a* additionally placed over the fluid absorbent material 81. In other words, the new fluid absorbent material 81*a* without color mixing is placed over the fluid absorbent material 81 with color mixing. This reduces the potential for the user's confusion when the recycled cap 70*g* once removed from the cartridge 13, 13*a*, 13*b*, 20 or 20*a* is reattached to the cartridge 13, 13*a*, 13*b*, 20 or 20*a*. In the case of recycling the cap 70*c* (FIG. 26F), the fluid absorbent material 81*a* is additionally placed over each of the two fluid absorbent materials 81.

G-3. Modifications of Seventh Embodiment

According to the seventh embodiment, the desired color of the fluid absorbent material 81*a* is specified as black or the color of ink unused in the printer 50, to which the cartridge 13, 13*a*, 13*bg*, 20 or 20*a* with the recycled cap 70*g* including the fluid absorbent material 81*a* is attached. The color of the fluid absorbent material 81, instead of the fluid absorbent material 81*a*, may be black or the color of ink unused in the printer 50, to which the cartridge 13, 13*a*, 13*bg*, 20 or 20*a* with the cap 70*b* or 70*c* including the fluid absorbent material 81 is attached. The color of the fluid absorbent material 81 of the cap 70*b* or 70*c* before recycle, as well as the recycled cap 70*g*, may be black or the color (other than white) of ink unused in the printer 50, to which the cartridge 13, 13*a*, 13*bg*, 20 or 20*a* with the cap 70*b* or 70*c* is attached.

H. Other Embodiments

H-1. First Other Embodiment

Figure 27:
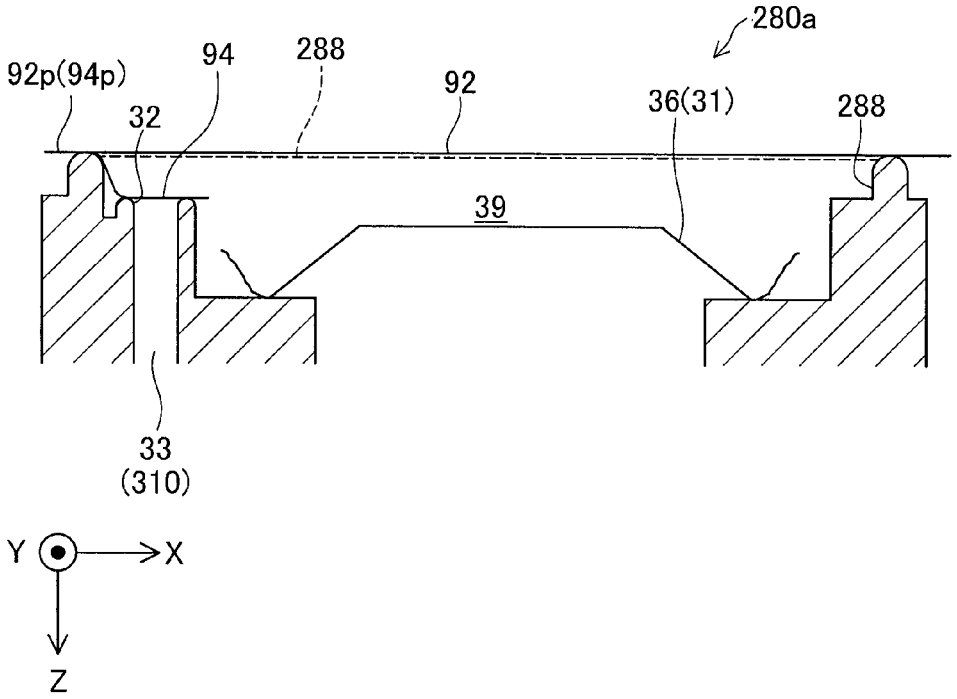
FIG. 27 is a diagram illustrating a first other embodiment.

FIG. 27 is a diagram illustrating a first other embodiment. The cap 70, 70*a*, 70*b*, 70*c* or 70*g* is used to close the connection port 32 and the opening 288 according to the above embodiments, but this configuration is not restrictive. The connection port 32 and the opening 288 may be closed by other sealing members. For example, according to the first other embodiment shown in FIG. 27, a sheet member 92 provided as the fluid supply opening sealing member is arranged to close the opening 288, while a sheet member 94 provided as the opening sealing member is arranged to seal the connection port 32. The respective sheet members (film members) 92 and 94 are made of a liquid impermeable material. The sheet member 94 is preferably made of an air permeable material. This enables the internal pressure of the second flow path 39, where the air is contained, to be kept at substantially the same level as the external pressure, while preventing invasion of ink into the communication path 310. The respective sheet members 92 and 94 are removably attached to close the opening 288 and the connection port 32.

The sheet member 94 is provided at a location not to overlap the fluid exit 31 in projection of the cartridge to the plane perpendicular to the first direction (negative Z-axis direction). When ink adheres to the sheet member 94, ink is likely to scatter and enter the connection port 32 when the sheet member 94 is detached from the connection port 32. In the application of the sheet member 94 made of the air permeable material, wetting the sheet member 94 with ink may cause clogging and degrade the original function of the sheet member 94 (function of air permeation). Positioning the sheet member 94 not to overlap the fluid exit 31, however, reduces the likelihood that ink leaked out of the fluid exit 31 adheres to the sheet member 94. This accordingly reduces the potential trouble described above.

The sheet member 94 has one end 94*p* extended outward from the opening 288. The sheet member 92 also has one end 92*p* extended outward from the opening 288. This arrangement enables the user to readily remove the sheet members 92 and 94 from the cartridge. The respective one ends 92*p* and 94*p* are joined with each other. In other words, the respective one ends 92*p* and 94*p* of the two sheet members 92 and 94 are integrated. This enables the user to simultaneously remove the two sheet members 92 and 94 from the cartridge by one single action.

H-2. Second Other Embodiment

Figure 28:
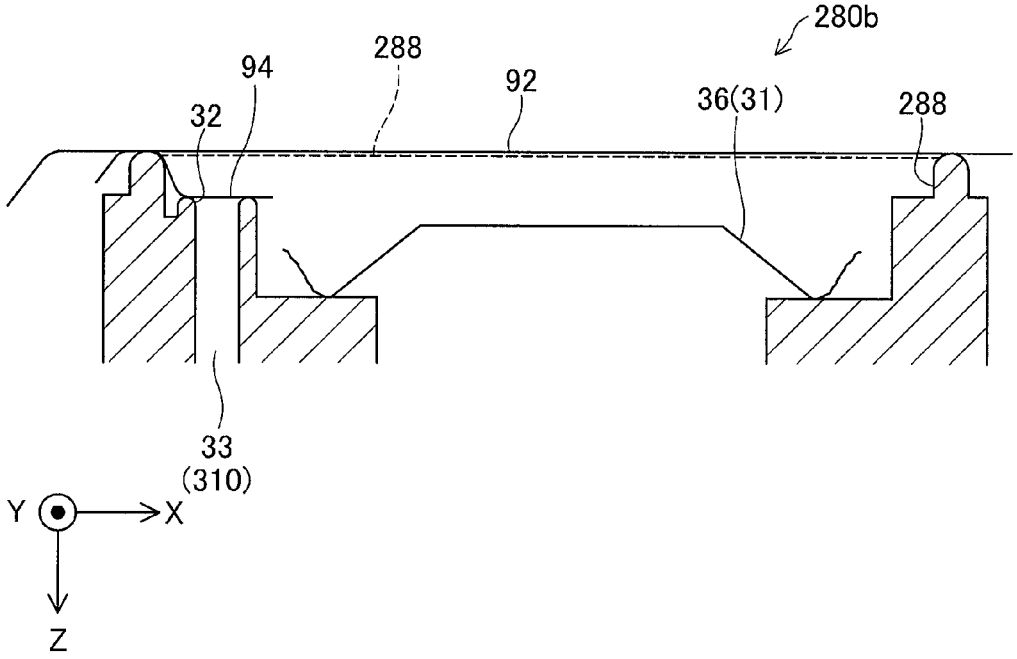
FIG. 28 is a diagram illustrating a second other embodiment.

FIG. 28 is a diagram illustrating a second other embodiment. The differences from the first other embodiment shown in FIG. 27 are that the sheet members 92 and 94 are not joined with each other and the sheet member 92 is longer than the sheet member 94 to be extended further outward from the opening 288. This arrangement enables the user to hold the sheet member 92 and remove the sheet member 92 from the cartridge, prior to the sheet member 94. Removal of the sheet member 94 from the cartridge after the sheet member 92 further reduces the potential for ink flow into the connection port 32.

H-3. Third Other Embodiment

Figure 29:
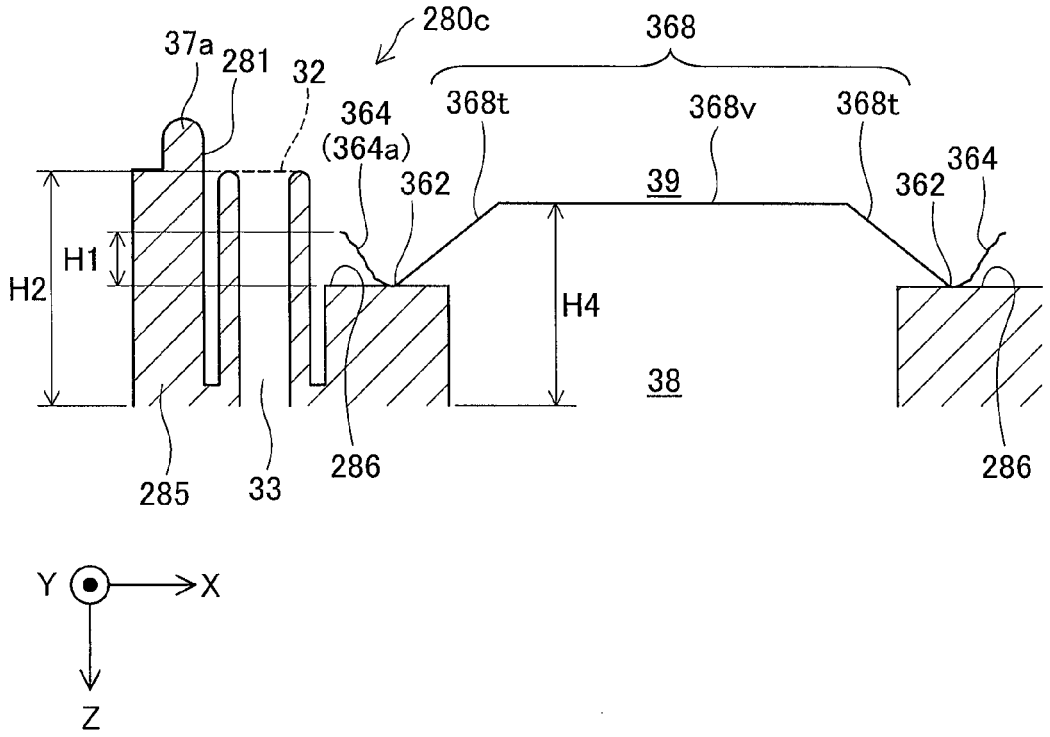
FIG. 29 is a diagram illustrating a third other embodiment.

FIG. 29 is a diagram illustrating a third other embodiment. The first embodiment described above satisfies the relationship of H4>H2, but the relationship of H4<H2 may be satisfied alternatively. The connection port 32 may thus be located below (on the negative Z-axis side) than the fluid exit 31. In other words, the connection port 32 may be located downstream of the fluid exit 31 with respect to the outflow direction of the fluid from the fluid supply port 280. This arrangement further reduces the likelihood that ink leaked through the fluid exit 31 flows through the connection port 32 into the communication path 310. For example, even when ink is leaked out of the fluid exit 31 in the second state of the cartridge (where the positive Z-axis direction is specified as vertically downward direction), the arrangement of the connection port 32 located above the fluid exit 31 in the vertical direction effectively reduces the likelihood that ink reaches the connection port 32.

I. Modifications

Among the components of the respective embodiments described above, the components other than those described in independent claims are additional components and may be omitted as appropriate. The invention is not limited to the above embodiments, but a multiplicity of modifications and variations may be made to the embodiments without departing from the scope of the invention. Some examples of possible modifications are described below.

I-1. First Modification

The above embodiments describe the semi-sealed type cartridges, but the invention may also be applied to other types of cartridges. For example, the invention is applicable to another type of ink cartridge having the fluid accommodation portion 200 configured to always communicate with the outside and yet another type of ink cartridge (ink pack) having the fluid accommodation portion 200 configured to be always sealed.

I-2. Second Modification

According to the above embodiments, the inner wall 35 is formed by the circumferential wall of the connection port-forming member 32*t*, but this is not restrictive. The inner wall 35 may be formed by a wall member erected from the wall surface of parting the inside of the fluid supply port 280 and arranged away from both the fluid exit 31 and the connection port 32. The cartridge 13, 13*a* or 20 may be provided with a restrictor that is located between the connection port 32 and the fluid exit 31 on the wall surface of parting the inside of the fluid supply port 280 to interfere with the ink flow between the connection port 32 and the fluid exit 31. According to the above embodiments, the inner wall 35 serves as the restrictor. The restrictor may otherwise be the concavo-convex shape formed on the wall surface or a retention member (for example, porous member like sponge) provided on the wall surface to retain fluid.

I-3. Third Modification

The connection port sealing member provided for closing the connection port 32, such as the cap 70 or 70*a* or the sheet member 94, is arranged to cover and close the entire area of the connection port 32 according to the above embodiments. This is, however, not restrictive, and at least part of the connection port 32 may be closed by the connection port sealing member. This latter arrangement also reduces the likelihood that ink flows through the connection port 32 into the communication path 310.

I-4. Fourth Modification

The cap stepped member 766 is provided as a projection (FIG. 22) according to the above embodiments, but may be provided as a recess or a combination of a projection and a recess. Any of these structures reduces the likelihood that ink flows along the receiver member 76 and reaches the sealing portion 762.

I-5. Fifth Modification

The cap 70 or 70*a* is in contact with the sheet center portion 368 in the attached state according to the above embodiments, but may not be in contact with the sheet center portion 368. This latter arrangement reduces the likelihood that ink adheres to the cap 70 or 70*a*.

I-6. Sixth Modification

Figure 30:
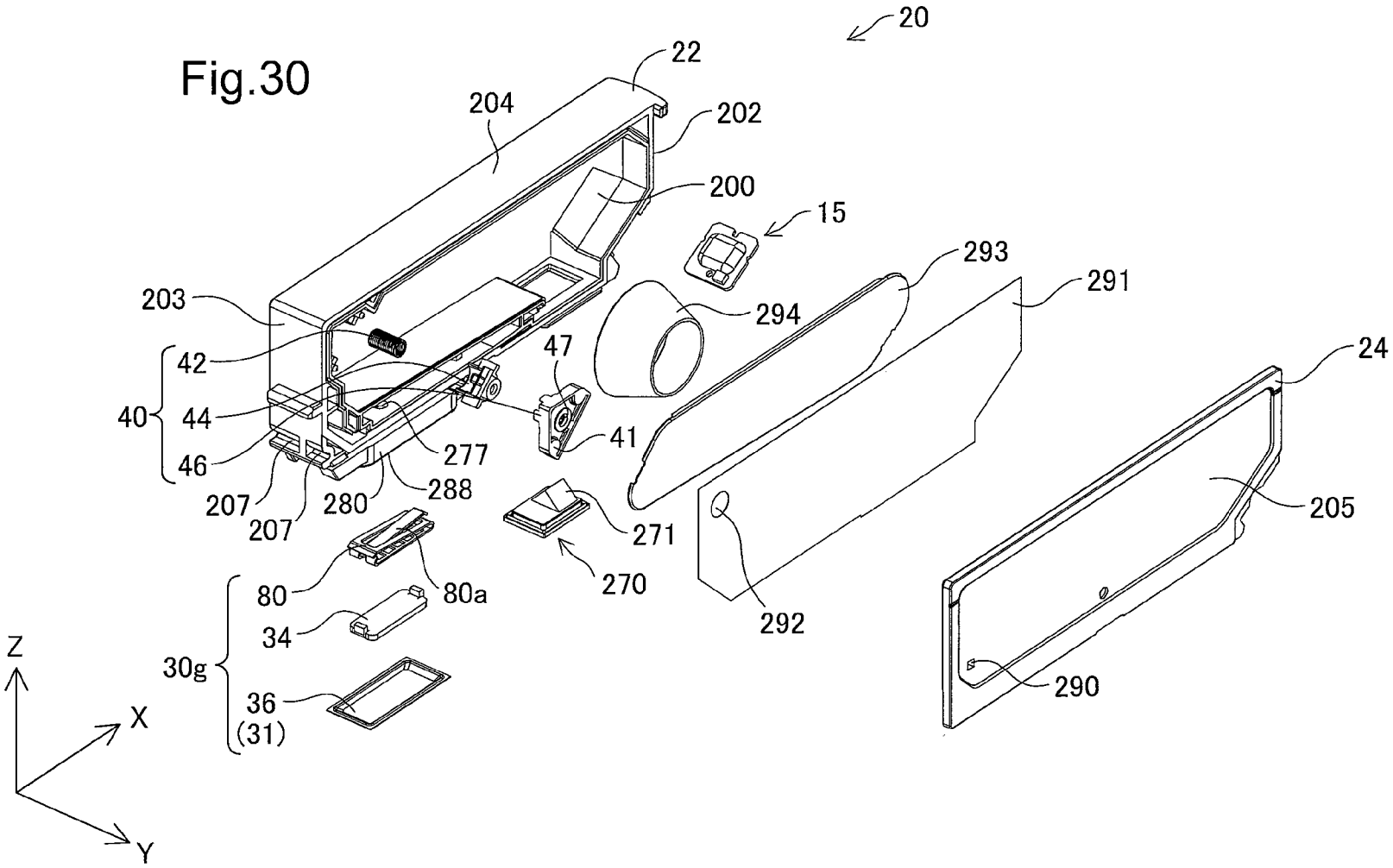
FIG. 30 is a diagram illustrating a supply member according to one modification.
Figure 31:
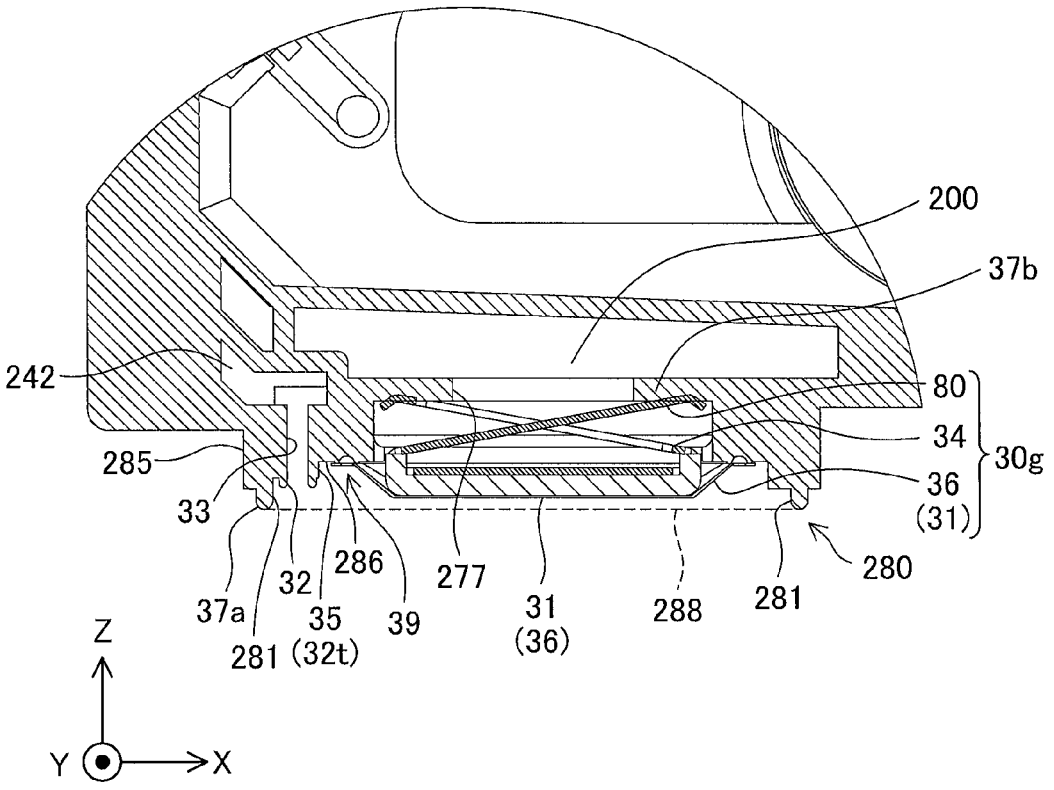
FIG. 31 is a diagram comparable to FIG. 16.

FIG. 30 is a diagram illustrating a supply member 30*g* according to one modification. FIG. 31 is a diagram comparable to FIG. 16. The illustrated example uses the supply member 30*g* of this modification, in place of the supply member 30 of the cartridge 20. The supply member 30*g* may be used for any of the cartridges 20*a* to 20*c* of the other embodiments using the supply member 30. The difference between the supply member 30*g* and the supply member 30 is that the supply member 30*g* additionally has a pressing member 80. The other structure of the supply member 30*g* is identical with that of the supply member 30, and the like components are expressed by the like numerals and symbols and are not specifically described here.

As shown in FIGS. 30 and 31, the foam 34 and the pressing member 80 may be placed inside (on the fluid accommodation portion 200-side, upstream side) of the sheet member 36. The pressing member 80 has a spring element 80*a*. The spring element 80*a* biases (presses) the foam 34 toward the sheet member 36 (toward negative Z-axis side).

In the application of the supply member 30*g* including the pressing member 80, when the cap 70 to 70*c* or 70*g* comes into contact with the sheet member 36 serving as the fluid exit, the sheet member 36 itself or another member (foam 34 or pressing member 80) of the supply member 30 or 30*g* arranged to face the cap 70 to 70*c* or 70*g* across the sheet member 36 may be deformed. Deformation of such member 36, 34 or 80 may cause failed fluid supply from the cartridge 20 or 20*a* to the printer 50. It is accordingly preferable that the sheet member 36 does not come into contact with the cap 70 to 70*c* or 70*g* in the state that the cap 70 to 70*c* or 70*g* is attached to the cartridge 20 or 20*a* to 20*c* to cover the opening 288 (also called "attached state" or "state of sealing the opening 288"). In other words, it is preferable to arrange the cap 70 to 70*c* or 70*g* not in contact with but away from the supply member 30 or 30*g* placed in the fluid supply port 280 or 280*a* of the cartridge 20 or 20*a* to 20*c*, in the attached state.

I-7. Seventh Modification

The present invention is not limited to the inkjet printer or its ink cartridge but is also applicable to any fluid ejection apparatus that consumes a fluid other than ink and a cartridge (fluid accommodation portion) used for such fluid ejection apparatus. For example, the invention is applicable to a cartridge used for any of the following various fluid ejection apparatuses:

(1) image recording apparatus, such as a facsimile machine;

(2) color material ejection apparatus used to manufacture color filters for image display apparatus, e.g., liquid crystal display;

(3) electrode material ejection apparatus used to form electrodes of, for example, organic EL (electroluminescence) display and field emission display (FED);

(4) fluid ejection apparatus configured to eject a bioorganic material-containing fluid used for manufacturing biochips;

(5) sample ejection apparatus used as precision pipette;

(6) ejection apparatus of lubricating oil;

(7) ejection apparatus of resin solution;

(8) fluid ejection apparatus for pinpoint ejection of lubricating oil on precision machinery including watches and cameras;

(9) fluid ejection apparatus configured to eject transparent resin solution, such as ultraviolet curable resin solution, onto the substrate in order to manufacture a hemispherical microlens (optical lens) used for, for example, optical communication elements;

(10) fluid ejection apparatus configured to eject acidic or alkaline etching solution in order to etch the substrate; and

(11) fluid ejection apparatus equipped with fluid consumption head for ejecting a very small volume of droplets of another arbitrary fluid.

The "droplet" herein means the state of fluid ejected from the fluid ejection apparatus and may be in a granular shape, a teardrop shape or a tapered threadlike shape. The "fluid" herein may be any material consumable by the fluid ejection apparatus. The "fluid" may be any material in the liquid phase. For example, liquid-state materials of high viscosity or low viscosity, sols, gel water, various inorganic solvents and organic solvents, solutions, liquid resins and liquid metals (metal melts) are included in the "fluid". The "fluid" is not restricted to the liquid state as one of the three states of matter but includes solutions, dispersions and mixtures of the functional solid material particles, such as pigment particles or metal particles, solved in, dispersed in or mixed with a solvent. Typical examples of the fluid include ink described in the above embodiments and liquid crystal. The "ink" includes general water-based inks and oil-based inks, as well as various liquid compositions, such as gel inks and hot-melt inks.

I-8. Eighth Modification

The foregoing describes various embodiments and modifications, but the invention may also be applicable to any of the following aspects.

For the purpose of reference, the numerals and symbols used in the embodiments are shown in parentheses after the corresponding components.

Aspect 1:

A cap (70, 70*a*) attached to a cartridge (20, 20*a*) that includes: a fluid accommodation portion (200) configured to contain a fluid inside; a fluid supply port (280) provided to have an opening (288) that allows the fluid to flow outside and a fluid exit (31) that is located inside of the fluid supply port (280) and allows the fluid to flow from the fluid accommodation portion (200) to outside; and a communication path (310) arranged to have a one-end opening (connection port 32)

located inside of the fluid supply port (200) and allow communication between outside and inside of the fluid supply port (280), the cap (70, 70*a*) comprising a cap main body (74) provided to close the opening (288), wherein the cap main body (74) has a sealing portion (762) arranged to close at least part of the one-end opening (32) in an attached state that the cap (70, 70*a*) is attached to the cartridge (20, 20*a*).

The cap of this aspect reduces the likelihood that the fluid enters the communication path via the one-end opening even when the fluid is leaked out of the fluid accommodation portion in the attached state.

Aspect 2:

The cap (70, 70*a*) according to aspect 1, further comprising:

a cap lever (72, 72*a*) used to remove the cap (70, 70*a*) from the cartridge (20, 20*a*) and protruded outward from an outer surface (203) of the cartridge (20, 20*a*) in the attached state that the cap (70, 70*a*) is attached to the cartridge (20, 20*a*); and a receiver member (76) provided to receive the fluid exit (31), wherein the sealing portion (762) and the cap lever (72, 72*a*) are located on an identical side with respect to the receiver member (76).

The cap of aspect 2 effectively prevents the cartridge from being placed on a specified surface with the cap lever located downside in the vertical direction. This further reduces the likelihood that the fluid adhering to the receiver member reaches the sealing member.

Aspect 3:

The cap (70, 70*a*) according to aspect 2, further comprising:

a cap stepped member (766) located between the sealing member and the receiver member and configured to have at least one of a projection (766*a*) or a recess.

According to the cap of aspect 3, the presence of the cap stepped member reduces the likelihood that the fluid flows along the receiver member and reaches the sealing member even when the fluid leaked out of the fluid exit adheres to the receiver member.

Aspect 4:

The cap (70, 70*a*) according to aspect 3, wherein the receiver member (76) is in a recessed shape, and the cap stepped member (765) is formed by a peripheral member (764) of the receiver member (76).

The cap of aspect 4 does not require any additional separate member to provide the cap stepped member.

Aspect 5:

The cap (70, 70*a*) according to any one of claims 1 to 4, wherein the fluid exit (31) has an inclined portion (368*t*) that is inclined to a predetermined direction (first direction), the cap (70, 70*a*) further comprising:

an opposed part (766*b*) opposed to the inclined portion (368*t*) in the attached state, wherein the opposed part (766*b*) is inclined along an inclination direction of the inclined portion (368*t*) in the attached state that the cap (70, 70*a*) is attached to the cartridge (20, 20*a*).

The cap of aspect 5 reduces the volume of the inner chamber that is formed by the cap and the fluid supply port to contain the air, in the attached state. This controls the amount of the air that flows from the inner chamber through the fluid exit into the fluid accommodation portion.

Aspect 6:

The cap (70*a*) according to any one of claims 1 to 5, wherein the cartridge (20*a*) has a plurality of the fluid supply ports (280*a*), and the cap (70*a*) has a plurality of the sealing portions (762) provided corresponding to a plurality of the one-end openings (32), the cap (70*a*) further comprising a stepped member (969) provided on a line (L1) that connecting the respective sealing portions (762) along the surface of the cap (70*a*).

According to the cap of aspect 6, the presence of the stepped member effectively prevents the fluid reaching one sealing member from reaching the other sealing member.

Aspect 7:

A cap (70*b*, 70*c*) attached to a cartridge (20, 20*a*) that includes: a fluid accommodation portion (200) configured to contain a fluid inside; a fluid supply port (280) provided to have an opening (288) that allows the fluid to flow outside and a fluid exit (31) that is located inside of the fluid supply port (280) and allows the fluid to flow from the fluid accommodation portion (200) to outside; and a communication path (310) arranged to have a one-end opening (connection port 32) located inside of the fluid supply port (200) and allow communication between outside and inside of the fluid supply port (280), the cap (70*b*, 70*c*) comprising a cap main body (74) provided to cover the opening (288), wherein the cap main body (74) has a fluid absorbent material (81).

According to the cap of aspect 7, the fluid absorbent material absorbs the fluid leaked out of the opening (280) and thereby prevents the fluid from being leaked outside.

In the cap of aspect 7, the fluid absorbent material (81) is preferably placed on the side opposed to the fluid exit (31) in the attached state that the cap is attached to the cartridge (20). More specifically, it is further preferable to place at least part of the fluid exit (31) at the position opposed to the fluid exit. This enables a greater portion of ink leaked out of the fluid exit to be absorbed by the fluid absorbent material.

I-9. Ninth Modification

The cap 70, 70*a*, 70*b* or 70*c* is used for the cartridge 13, 13*a* or 20 having the connection port 32 and the inner wall 35 according to the above embodiments and modifications, but may also be applicable to another cartridge having a fluid supply opening. In such applications, the cap 70, 70*a*, 70*b* or 70*c* closes the fluid supply opening (opening 2889 and thereby reduces the likelihood that ink is leaked out of the cap 70, 70*a*, 70*b* or 70*c*. For example, the cap 70, 70*a*, 70*b*, 70*c* may be attached to a cartridge without the connection port 32. In this application, even when ink is leaked out of the fluid exit, the cap closes the fluid supply opening and thereby reduces the potential for ink flow to the outside. More specifically, the cap 70, 70*a*, 70*b* or 70*c* has the opposed part 766*b* inclined along the inclination direction of the inclined portions 368*t* of the fluid exit 31 (FIG. 22). This structure further reduces the likelihood that ink flows out of the cap. In another example, the cap 70, 70*a*, 70*b*, 70*c* may be attached to a cartridge with the connection port 32 but without the inner wall 36. This reduces the likelihood that ink is leaked out through the connection port 32. The foregoing fundamentally describes the cartridge 13, 13*a* or 20 and the cap 70, 70*a*, 70*b* or 70*c* as separate components, but the term "cartridge 13, 13*a* or 20" may be used in the form including the cap 70, 70*a*, 70*b* or 70*c*.

What is claimed is:

1. A cartridge for supplying a fluid to a fluid ejection apparatus, the cartridge comprising:
an air intake port;
an air chamber in communication with the air intake port;
a fluid accommodation portion in communication with the air chamber via a valve member; and
a fluid supply port connectable with the fluid ejection apparatus,
the fluid supply port comprising:
a fluid exit in communication with the fluid accommodation portion and configured to flow out the fluid from the fluid accommodation portion to the fluid ejection apparatus;
a circumferential wall that defines an opening of the fluid supply port and an inner space of the fluid supply port; and
a connection port protruded and opened in the inner space of the fluid supply port in communication with the air chamber and configured to release the air in the inner space of the fluid supply port.

2. The cartridge according to claim 1, wherein
the circumferential wall and the connection port are integrally formed.

3. The cartridge according to claim 1, further comprising:
a first surface, a second surface, a third surface and a fourth surface; and
a transmission part placed on the first surface, the transmission part configured to allow transmission of light, wherein
the fluid supply port is provided on the first surface,
the fourth surface is opposed to the first surface,
the second surface is provided between the first surface and the fourth surface,
the third surface is opposed to the second surface,
the first surface has a first end located on the second surface side and a second end located on the third surface side,
the transmission part is closer to the first end than the second end, and
the fluid supply port is closer to the second end than the first end.

4. The cartridge according to claim 1, wherein an end of the connection port is located downstream of the fluid exit with respect to an outflow direction of the fluid.

5. The cartridge according to claim 1, wherein an end of the connection port is located upstream of the fluid exit with respect to an outflow direction of the fluid.

6. The cartridge according to claim 1, further comprising:
a sealing member provided to close the fluid supply port and having a lever, wherein an end of the connection port and the lever are each located on an identical side with respect to the fluid exit.

7. The cartridge according to claim 6, wherein
the sealing member has a sealing portion provided to close the connection port.

8. The cartridge according to claim 7, the fluid supply port being a first supply port, the opening being a first opening, the sealing portion of the sealing member being a first sealing portion, the fluid exit being a first fluid exit,
the cartridge further comprising:
a second fluid supply port that includes a second opening, wherein
the sealing member further has a second sealing portion provided corresponding to the second opening, and
the sealing member further has a first stepped portion between the first and second sealing portions.

9. The cartridge according to claim 8, wherein
the sealing member further includes:
a receiver portion configured to receive the first fluid exit and provided at a different position from the first sealing portion; and
a second stepped portion located between the first sealing portion and the receiver portion and configured to have at least one of a projection and a recess.

10. The cartridge according to claim 9, wherein
the receiver portion is in a recessed shape, and
the second stepped portion is provided by a peripheral portion that is part of the receiver portion.

11. The cartridge according to claim 6, wherein
the fluid exit has an inclined portion inclined to an outflow direction of the fluid, and
the sealing member has an opposed part inclined along an inclination direction of the inclined portion.

12. The cartridge according to claim 1, wherein
the fluid exit includes:
a mounting portion attached to the fluid supply port;
a center portion surrounded by the mounting portion; and
a non-mounting portion different from the center portion and the mounting portion, wherein
the non-mounting portion is configured to retain the fluid.

13. The cartridge according to claim 1, further comprising:
an opening seal member removably attachable to close the connection port, wherein
the opening seal member is provided at a position that does not overlap the fluid exit in projection of the cartridge to a plane perpendicular to an outflow direction of the fluid.

14. The cartridge according to claim 13, further comprising:
a fluid supply opening sealing member removably attachable to close the opening of the fluid supply port, wherein
the opening seal member and the fluid supply opening sealing member are partly joined with each other.

15. A sealing member configured to cover a fluid supply opening located at one end of a fluid supply port of a cartridge for supplying a fluid to a fluid ejection apparatus, the sealing member comprising:
a portion to seal the fluid supply opening of the fluid supply port of the cartridge wherein the cartridge comprises:
an air intake port;
an air chamber in communication with the air intake port;
a fluid accommodation portion in communication with the air chamber via a valve member; and
the fluid supply port connectable with the fluid ejection apparatus,
the fluid supply port including:
a fluid exit in communication with the fluid accommodation portion and configured to flow out the fluid from the fluid accommodation portion to the fluid ejection apparatus;
a circumferential wall that defines the fluid supply opening of the fluid supply port and an inner space of the fluid supply port; and
a connection port protruded and opened in the inner space of the fluid supply port, in communication with the air chamber and configured to release the air in the inner space of the fluid supply port.

16. The sealing member according to claim 15, wherein
the sealing member is not in contact with the fluid exit.

17. The sealing member according to claim 15, wherein
the sealing member is in contact with the fluid exit.

18. The sealing member according to claim 15 wherein:

the sealing member is not in contact with the connection port.

19. The sealing member according to claim 15, the cartridge further including:

a passage protruded in the fluid supply port, the passage forming the one end side portion including the opening, wherein the sealing member is in contact with the connection port.

20. The sealing member according to claim 15, wherein the fluid exit is placed inside of the fluid supply port, the fluid exit having an inclined portion, the inclined portion being inclined to a protrusion direction of the fluid supply port, the sealing member further comprising:

a sealing member-side inclined portion opposed to the fluid exit and being inclined along the inclination of the inclined portion.

* * * * *